US005656807A

United States Patent [19]

Packard

[11] Patent Number: 5,656,807

[45] Date of Patent: Aug. 12, 1997

[54] 360 DEGREES SURROUND PHOTON DETECTOR/ELECTRON MULTIPLIER WITH CYLINDRICAL PHOTOCATHODE DEFINING AN INTERNAL DETECTION CHAMBER

[76] Inventor: Lyle E. Packard, 245 C Shore Line Rd., Barrington, Ill. 60010

[21] Appl. No.: 532,155

[22] Filed: Sep. 22, 1995

[51] Int. Cl.[6] ..... H01J 43/00

[52] U.S. Cl. ..... 250/214 VT; 313/103 R; 313/105 R; 313/534

[58] Field of Search ..... 250/214 VT, 207, 250/385.1, 374; 313/105 CM, 105 R, 104, 103 CM, 103 R, 544, 542, 541, 534, 533, 532, 528, 523

[56] References Cited

U.S. PATENT DOCUMENTS

| | | | |
|---|---|---|---|
| 2,141,322 | 12/1938 | Thompson | 179/171 |
| 2,160,798 | 5/1939 | Teal | 250/166 |
| 2,234,801 | 3/1941 | Gorlich | 250/166 |
| 3,188,468 | 6/1965 | Packard | 250/71.5 |
| 3,260,876 | 7/1966 | Manley et al. | 313/68 |

(List continued on next page.)

FOREIGN PATENT DOCUMENTS 60-30064 7/1985 Japan .

OTHER PUBLICATIONS

"Instrumentation For Internal Sample Liquid Scintillation Counting" Lyle E. Packard, Liquid Scintillation Counting, Proceedings Of A Conference held at Northwestern University Aug. 20–22, 1957, pp. 50–60 Editors Carlos G. Bell, Jr. and F. Newton Hayes, Pergamon Press (1958).

"The DEP Hybrid Photomultiplier Tube", L. Boskma, R. Glazenborg and R. Schomaker, Proceedings of the 5th International Conference on Calorinmetry in Brookhaven, New York (Sep. 1994).

"Photonic Approaches To Burn Diagnostics", Stephen A. May Biophotonics International, pp. 44–50 (May/Jun. 1995.

"Multiplexing Expands Yield From Fluorescence Analysis", anon., Biophotonics International, pp. 18 $ 20 (Mar./Apr. 1995).

"Development 25—Hollow Photocathode PMT" (no author, no date).

*Primary Examiner*—Edward P. Westin
*Assistant Examiner*—John R. Lee
*Attorney, Agent, or Firm*—J. Robert Cassidy, P.S.

[57] ABSTRACT

A 360° surround photon detector/electron multiplier having: i) a continuous annular inner wall formed of thin light-transmissive material defining an internal coaxial detection chamber; ii) an annular enclosed evacuated envelope integral with the inner wall; iii) a cylindrical photocathode positioned adjacent the vacuum side of the inner wall; and iv), an electron multiplier assembly housed within the envelope for multiplying photoelectrons emitted from the photocathode and operable as a plurality of adjacent, circumferentially arrayed electron multipliers, each including an output terminal. The outputs originating from various segments of the photocathode may be utilized with coincidence circuitry requiring simultaneous detection of light events in at least two different sections of the photocathode in order to eliminate spurious signals such as result from thermal electron emissions from the photocathode. The outputs may also be utilized to facilitate use in spectroscopic analysis, differentiating portions of the spectrum of light reaching the photocathode through an optional composite cylindrical array of adjacent light filters, each having different wavelength bandpass characteristics, which may be aligned with the electron multiplier sections and positioned within the detection chamber in close proximity to, and surrounded by, the inner wall of the envelope. Where possible, light-emitting sources or samples are placed within the detection chamber. Optionally, a reflector is positioned coaxially within the detection chamber to facilitate detection of light emanating from sources outside the detection chamber—e.g., i) external scintillation or luminescent samples, etc.; or ii), astronomical or other external light sources requiring collimators, microscopes, telescopes or the like.

34 Claims, 18 Drawing Sheets

U.S. PATENT DOCUMENTS

| | | | |
|---|---|---|---|
| 3,415,990 | 12/1968 | Watson | 250/71.5 |
| 3,859,528 | 1/1975 | Luitwieler, Jr. et al. | 250/328 |
| 3,944,832 | 3/1976 | Kalish | 250/361 |
| 4,002,909 | 1/1977 | Packard et al. | 250/328 |
| 4,142,101 | 2/1979 | Yin | 250/363 R |
| 4,143,291 | 3/1979 | Morales | 313/103 R |
| 4,330,731 | 5/1982 | Garin et al. | 313/104 |
| 4,347,458 | 8/1982 | Tomasetti et al. | 313/103 R |
| 4,420,689 | 12/1983 | Rogers et al. | 250/385 |
| 4,614,871 | 9/1986 | Driscoll | 313/542 |
| 4,649,314 | 3/1987 | Eschard | 313/103 CM |
| 4,780,395 | 10/1988 | Saito et al. | 430/315 |
| 4,806,827 | 2/1989 | Eschard | 313/533 |
| 4,937,506 | 6/1990 | Kimura et al. | 313/533 |
| 4,990,827 | 2/1991 | Ehrfeld et al. | 313/533 |
| 4,999,540 | 3/1991 | L'hermite | 313/533 |
| 5,043,628 | 8/1991 | Boutot et al. | 313/532 |
| 5,077,504 | 12/1991 | Helvy | 313/103 R |
| 5,097,173 | 3/1992 | Schmidt et al. | 313/103 CM |
| 5,180,943 | 1/1993 | Kyushima | 313/535 |
| 5,319,189 | 6/1994 | Beauvais et al. | 250/214 VT |
| 5,363,014 | 11/1994 | Nakamura | 313/533 |
| 5,504,386 | 4/1996 | Kyushima et al. | 313/103 R |
| 5,532,551 | 7/1996 | Kyushima et al. | 313/533 |

TO/FROM FIG. 16B 146
151
C-1
C-2
R-1
R-2
143
144
139
140
141
142
145
122'
124
125
122
$121_1$
$121_2$
$121_3$
$121_4$
$121_5$
$121_6$
$121_7$
$121_8$
119
118
108

360 DEGREES SURROUND PHOTON DETECTOR/ELECTRON MULTIPLIER WITH CYLINDRICAL PHOTOCATHODE DEFINING AN INTERNAL DETECTION CHAMBER

BACKGROUND OF THE INVENTION

1. Technical Field

The present invention relates generally to photomultiplier tubes having a photosensitive cathode ("photocathode") for: i) absorbing light energy (i.e., photon energy); ii) using the absorbed photon energy to cause emission of electrons from a photocathode; iii) multiplying the number of electrons; and iv), outputting a signal proportional to, but greatly larger than, the magnitude of the absorbed photon energy from the light event. More particularly, the present invention relates to a generally toroidal or annular photon detector/electron multiplier having a 360° surround, semi-transparent, cylindrical photocathode deposited on, or positioned adjacent, the vacuum side of the inner wall of a generally toroidal vacuum tube having an inner annular or cylindrical wall formed of thin-walled glass or other suitable thin-walled light-transmissive material and defining a centrally located coaxial detection chamber and an annular evacuated envelope for housing: i) the photocathode; ii) the particular electron multiplier structure employed, including focusing electrodes if desirable; and iii), a plurality of anodes and/or other electron multiplier output terminals.

In carrying out the invention, the photomultiplier comprises a multiple-section device having a single continuous cylindrical photocathode deposited on, or positioned adjacent, the vacuum side of the inner annular wall of a generally toroidal evacuated envelope, with the annular space within the torus-shaped envelope surrounding the photocathode being subdivided into a plurality of separate, adjacent, arcuate sections each housing an electron multiplier including an output anode or other output terminal for processing electrons emitted from a specific subtended arc of the cylindrical photocathode. In one form of the invention, the annular or generally toroidal envelope surrounding the cylindrical photocathode is subdivided into a preferably even-numbered plurality of adjacent arcuate sections so as to facilitate use of coincidence circuitry requiring time-coincident detection of light events in different sections of the photomultiplier tube in order to eliminate certain spurious signals from the photomultiplier tube which are substantially devoid of meaning and are unwanted such, for example, as thermal electron emissions from the photocathode.

The invention will herein be initially described in connection with liquid scintillation spectrometers—viz., scientific measuring instruments well known to persons skilled in the art which are used to detect scintillations occurring in samples containing one or more radioactive isotopes and a scintillation material which produces light scintillations when struck by radiation(s) emanating from the isotope(s)—since that is an environment wherein head-on photomultipliers have, for many years, found particularly advantageous use.

However, as the ensuing description proceeds, it will become apparent to persons skilled in the art that the invention is not limited to use with conventional liquid scintillation spectrometers but, rather, it finds equally advantageous use in a wide range of other environments including, merely by way of example and not by way of limitation, the detection and measurement of photons emanating from: i) samples external to the detection chamber which contain a liquid, crystal or plastic scintillator such, for example, as a beta emitter or other suitable radioactive isotope(s); ii) samples external to the detection chamber containing a luminescent material such, for example, as a fluorescent or a phosphorescent material used in luminescent spectroscopy and the like; and/or iii), light sources external to the immediate environment of the photomultiplier such as might be detected during astronomical observations or observation of other external sources including, but not limited to, samples or specimens being viewed through microscopes, telescopes, light collimators, or the like.

Moreover, because of the unique configuration of the photomultiplier of the present invention wherein different discrete adjacent sections of a single continuous cylindrical photocathode are associated with their own individual electron multiplier/anode (or other output terminal) combinations, all of such environments can employ photon energy detection and processing taking advantage of the benefits of coincidence counting where desirable.

2. Background Art

The prior art, including both the patented and non-patented art, is replete with publications relating in one form or another to photomultiplier tubes and uses thereof wherein incident light impinging upon a photocathode is absorbed thereby, causing emission of one or more primary electrons proportional to the number of impinging incident light photons, which primary electron(s) is(are) then multiplied using any of a wide variety of different types of conventional electron multipliers so as to produce an output signal which is proportional to the incident light energy; but, which is greatly amplified with respect thereto. Such conventional photomultiplier tubes have heretofore generally all employed a photocathode in either a head-on or a side-on configuration—i.e., in a head-on photomultiplier tube, incident light impinges on a photocathode located at one end of a generally cylindrical evacuated envelope with the photocathode material being deposited on, or positioned adjacent, the vacuum side of the light-transmissive end face of the envelope which lies in a flat or rounded plane intersecting the longitudinal axis of the envelope at substantially right angles thereto; whereas, in a side-on photomultiplier tube, the photocathode generally extends longitudinally along the internal light-transmissive sidewall of the evacuated envelope and parallel to the envelope's longitudinal axis.

Merely by way of example, in the field of liquid scintillation spectrometers, the head-on type of photomultiplier tube has, for four or more decades, been the photomultiplier tube of choice. Thus, U.S. Pat. Nos. 3,188,468-Packard and 4,002,909-Packard et al, both of which have been assigned to Packard Instrument Company, Inc. of Downers Grove, Ill., are representative of numerous patents relating to liquid scintillation spectrometers; and, both disclose a conventional liquid scintillation spectrometer of the type employing a pair of spaced apart, flat-faced, head-on photomultiplier tubes disposed on diametrically opposite sides of a cylindrical sample chamber into which discrete samples are inserted. Such discrete samples are generally contained in a vial, although continuous flow-through systems are well known and commonly employed. To improve the collection efficiency, the walls defining the sample chamber between the two photomultiplier tubes are generally coated or otherwise polished or mirrored so as to provide highly reflective surfaces, thereby attempting to reflect to the photocathodes some of the light energy from the sample which is directed in directions other than towards the photocathodes.

The exemplary and completely conventional equipment described in the foregoing Packard and Packard et al patents ggenerally includes: i) an elevator assembly for shifting samples into and out of the sample chamber; ii) a lead shield to protect against external radiation; iii) light shields to exclude all light from sources other than the sample; iv) a sample transfer mechanism to deliver samples to, and/or remove samples from, the elevator assembly in seriatim order; and v), suitable and generally conventional circuitry for processing the signals output from the photomultiplier tube anodes. Generally, such circuitry includes: a) coincidence circuitry for excluding signals not detected by both photomultipliers—e.g., for excluding signals resulting from random thermal electron emissions from the photocathodes and/or other spurious random noise pulses; b) discriminators for passing only signals within a desired band of interest; c) gates; d) scalers; and e), similar electronic components.

Those interested in a more detailed description of liquid scintillation spectrometers and/or head-on photomultiplier tubes of the type commonly used therein are referred to the aforesaid Packard and Packard et al patents, as well as to an article entitled "Instrumentation For Internal Sample Liquid Scintillation Counting" authored by Lyle E. Packard and appearing at pages 50 through 66 of LIQUID SCINTILLATION COUNTING, Proceedings of a Conference held at Northwestern University, Aug. 20–22, 1957, edited by Carlos G. Bell, Jr. and F. Newton Hayes, and published by Pergamon Press (1958).

Because a conventional photomultiplier tube is an evacuated tube, severe constraints have been placed on the configuration of the tube so as to preclude implosion. Such constraints have, for example, required either that the light-transmissive face of the tube—i.e., the tube end in the case of a head-on photomultiplier tube-be of rounded or generally semi-spherical shape (as opposed to flat) or, alternatively, that the material of the envelope's light-transmissive face be relatively thick. These constraints have created problems with respect to collection geometry insofar as rounded tube ends are concerned; and, moreover, they have increased light absorption problems and increased unwanted light from Cerenkov radiation in the case of tubes having relatively thick faces. With the advent of envelopes having quartz or low potassium glass end walls, these problems were somewhat alleviated; but, nonetheless, absorption problems and problems with Cerenkov radiation emissions and resultant poor signal-to-noise ratios have continued to be encountered. And, of course, the fact that two photomultipliers directly view the sample only on opposite sides thereof has always created a collection problem in respect of light originally directed in other directions. Thus, the need for a photomultiplier capable of viewing a sample from all side aspects simultaneously has continued.

A) Side-on Photomultiplier Tubes

U.S. Pat. No. 4,347,458-Tomasetti et al assigned to RCA Corporation is of interest for its disclosure of a typical side-on photomultiplier tube of the type employing a photocathode generally parallel to the axis of the evacuated tube, a circular-cage arrangement of dynodes, and an output anode. In this type of conventional photomultiplier tube, the photocathode is generally opaque wherein incident light impinging on the photocathode is absorbed thereby, with the absorbed photons causing emission of primary electrons from the photocathode which are attracted by the first stage dynode. Each primary electron impinging on the first stage dynode produces emission of multiple secondary electrons from the first stage dynode which are then attracted to the next dynode stage where the electron multiplication process is repeated. More specifically, the photocathode, successive dynode stages and anode are each maintained at progressively higher voltage levels so as to attract and accelerate all electrons emitted from each preceding stage during the electron multiplication process.

B) Head-on Photomultiplier Tubes

As previously indicated, a conventional head-on photomultiplier tube—viz., a tube that may be differentiated from a side-on photomultiplier tube by, inter alia, having a photocathode adjacent the end of the evacuated envelope remote from the anode—is, and has for a long time been, the photomultiplier tube of choice in most conventional scintillation spectrometers. Generally the photosensitive cathode material is deposited on, or positioned adjacent, the inner face or vacuum side of the tube's envelope at one light-transmissive end of the envelope; and, therefore, it can be differentiated from the photocathode in a side-on photomultiplier tube by constituting a transmission-type device—e.g., incident light impinges on the non-vacuum side of the photocathode and is absorbed thereby, causing emission of primary electrons from the vacuum side of the photocathode which are then attracted towards the downstream dynode chain and cause the emission of multiple secondary electrons from each dynode stage for each impinging electron—as contrasted with a side-on photomultiplier tube where the incident light impinges on one face of the photocathode, is absorbed thereby, and primary electrons are emitted from that face. Such head-on photomultiplier tubes are commonly available in any of a variety of different conventional configurations.

U.S. Pat. No. 2,234,801 issued in 1941 to Paul Görlich discloses an early version of a head-on photomultiplier tube employing a transparent flat-faced photocathode.

U.S. Pat. No. 5,363,014-Nakamura, assigned to Hamamatsu Photonics K.K., discloses what is generally known as a head-on photomultiplier tube having a linear-focused-type dynode structure characterized by its extremely fast response time. Such head-on photomultiplier tubes are commonly employed in those instances where time resolution and pulse linearity are significant considerations.

Watson U.S. Pat. No. 3,415,990 and Morales U.S. Pat. No. 4,143,291 are of interest for their disclosures of venetian blind-type photomultiplier tubes. In the Watson patent, the venetian blind dynode structure is quite conventional, comprising a plurality of dynode stages disposed in an array of stacked planar dynode elements closely simulating the structure of a venetian blind, with each such dynode stage being maintained at a progressively higher voltage. In the Morales patent, on the other hand, the dynode structure is modified with the dynodes being disposed in circular arrays. Generally, venetian blind-type dynode structures are not employed where fast time response is an important consideration.

Yet another type of conventional head-on photomultiplier tube is one employing a mesh-type dynode structure wherein a series of mesh-type dynodes are stacked in closely spaced proximity. Such a photomultiplier tube is disclosed in Kimura et al U.S. Pat. No. 4,937,506 assigned to Hamamatsu Photonics Kabushiki Kiasha. Such mesh-type dynodes are characterized by their compactness and are, therefore, highly desirable where space is a limitation. Moreover, such mesh-type dynode structures are characterized by high position sensitive capabilities resulting in excellent spatial resolution. However, while the characteristic of good spatial resolution is not considered to be of primary importance to the present invention which is particularly concerned with obtaining useable output voltage pulses of maximum amplitude, spatial resolution can, in some instances, be a desirable characteristic even when using the unique photomultiplier tube configuration of the present invention.

Another type of dynode structure commonly found in conventional head-on photomultiplier tubes is the box-and-grid type structure which, although commonly used because of its uniformity and simple dynode design, is, nevertheless, generally not acceptable where fast time response is a significant consideration.

Kyushima U.S. Pat. No. 5,180,943 assigned to Hamamatsu Photonics K.K. is of interest for its disclosure of a head-on photomultiplier tube employing a combination of a venetian blind-type dynode structure interleaved with a mesh-type dynode structure. A plurality of anodes are provided to insure improved spatial resolution.

C) Microchannel Plates ("MCP")

During the 1940's and/or 1950's, a somewhat different type of electron multiplier design was developed—a design which has come to be known as a microchannel plate ("MCP") and which is most notably, but not exclusively, employed in night vision devices. One fairly early patent relating to such an electron multiplier is Manley et al U.S. Pat. No. 3,260,876 assigned to North American Philips Company, Inc.—a patent which discloses an electron multiplier comprising a body formed of glass through which a plurality of generally parallel, spaced apart passages are formed. The front and rear faces of the glass body are provided with conductive coatings respectively coupled to first and second high voltage sources wherein the second source is at a higher voltage level than the first source, while the passages are coated with a suitable electron-emissive material of the type commonly employed with conventional dynodes. As a consequence, an exciting primary electron is attracted towards the front face of the glass body; and, when it impinges against a coated wall at or near the front end of a given passage, multiple secondary electrons are emitted which, in turn, are attracted to a downstream portion of the coated wall and produce still more secondary electrons for each impinging electron. In short, successive downstream portions of the passage or channel structure function as successive dynode stages in a conventional dynode chain, resulting in electron multiplication.

Other patents of interest pertaining to MCPs are Yin U.S. Pat. No. 4,142,101, Saito et al U.S. Pat. No. 4,780,395 and Beauvais et al U.S. Pat. No. 5,319,189. Yin discloses a low intensity x-ray and gamma-ray imaging device employing a fiber optic plate and photocathode for converting light photons to electrons which are amplified by an MCP. In the Yin imaging device, the amplified output from the MCP is then reconverted to photon energy by an output phosphor. Saito et al is of interest for its disclosure of a microchannel plate having a glass substrate and a plurality of parallel microchannels formed therein which are disposed at an angle to the longitudinal axis passing through the MCP, as well as a method of manufacture thereof. Beauvais et al discloses an x-ray image intensifier having a scintillator screen and photocathode positioned on the front face of an MCP.

It will be understood by persons skilled in the art that MCPs are commonly provided in a cylindrical disk-shaped form having a disk diameter ranging from on the order of about 18 millimeters ("mm") or somewhat less up to about 50 mm or more; and, wherein each disk ranges from approximately 0.5 mm to about 1.0 mm in thickness. However, as those skilled in the art will appreciate, MCPs are also available as off-the-shelf items having other than a circular disk-shaped configuration such, merely by way of example, as rectilinear or other shapes. Each microchannel will generally range from about 12 microns in diameter to about 20 microns in diameter; and, therefore, the length-to-diameter ratio of the microchannels will generally be on the order of about 40. Dependent upon the effective area of the disk, such MCP disks can have upwards of a million or more microchannels formed therein with each microchannel functioning as an electron multiplier.

D) Apertured Plate Electron Multipliers

A variation of the conventional microchannel plate design disclosed in the foregoing Yin, Saito et al and Beauvais et al patents comprises an apertured plate electron multiplier such as disclosed in Eschard U.S. Pat. Nos. 4,649,314 and 4,806,827, and in Boutot et al U.S. Pat. No. 5,043,628. Such designs generally comprise a series of transverse, spaced apart, parallel plates having "multiplier holes" formed therein, with each successive plate being maintained at a progressively higher voltage level as disclosed in the aforesaid Eschard patents. In the Boutot et al patent, two spaced apart apertured plates are employed in a head-on photomultiplier in combination with a conventional electron multiplier structure of the linear-focused variety.

E) Well-Type Radiation Counters

Luitwieler, Jr. et al U.S. Pat. No. 3,859,528, although disclosing a sample counting apparatus for detecting gamma radiation while employing a single head-on photomultiplier tube, is of interest primarily for its disclosure of a well-type counter employing sodium iodide (thallium activated) [NaI (T1)] crystals defining a cylindrical scintillating crystal well for reception of a gamma emitter. In other words, Luitweiler, Jr. et al, rather than providing a cylindrical photocathode to produce a 360° surround device for using absorbed light photons to cause emission of electrons from the photocathode, contemplate a 360° surround crystal formed of scintillating material for generating scintillations which are then detected by a single, flat-faced, head-on photomultiplier tube. A somewhat similar arrangement is disclosed in Kalish U.S. Pat. No. 3,944,832, which also provides a pair of sodium iodide (thallium activated) [NaI(T1)] crystals defining a central well for receiving a sample such as a sample containing a liquid scintillator and a beta emitter along with a gamma emitter. The well-defining crystals are photo-optically coupled to respective ones of a pair of conventional, spaced apart, flat-faced, head-on photomultiplier tubes for conveying scintillations generated in the sample, as well as in the crystals, to the photocathodes of the photomultiplier tubes.

Yet another well-type detector, here comprising a Geiger counter, is disclosed in Rogers et al U.S. Pat. No. 4,420,689. In this device, inner and outer cylindrical cathodes—not photocathodes—are positioned concentrically about a vertical axis; and, a plurality of anodes are positioned between the two concentric cathodes. The anode/cathode assembly is then positioned within a housing containing a conversion gas; and, a radioactive sample comprising a gamma emitter is positioned within the well defined by the innermost cathode with the gamma radiation interacting with the conversion gas to produce free electrons.

F) Hybrid Photodiode Electron Multiplier Tubes

Another conventional approach to electron multiplication in photomultiplier tubes known to persons skilled in the art for the past twenty years or more is the hybrid photomultiplier tube or "HPMT", also known scientifically as a "hybrid photodiode". Such photon detector/electron multipliers are described in a paper entitled "The DEP Hybrid Photomultiplier Tube" presented by L. Boskma, R. Glazenborg and R. Schomaker in the Proceedings of the 5th International Conference on Calorimetry at Brookhaven, N.Y. (September, 1994); and, are commercially available from Delft Electronische Producten (DEP) of Roden, Holland. The hybrid photodiode or HPMT basically comprises a vacuum tube having a photocathode spaced slightly from a silicon PIN diode. Incident light impinging upon the photocathode is absorbed thereby, with the absorbed photons causing emission of primary electrons in a conventional manner. The primary electrons are then accelerated towards the PIN diode, bombard the diode, and generate a plurality of electron-hole-pairs—typically, 3,500 electron-hole-pairs per primary electron at a photocathode voltage of −15 kV. Consequently, upon reverse biasing of the PIN diode, the electron-hole-pairs cause an electric current to flow which is then further amplified. The hybrid photodiode is characterized by its compactness, fast time response and excellent photo-electron resolution.

G) Prior Art of Miscellaneous Interest

Ehrfeld et al U.S. Pat. No. 4,990,827, is of interest for its disclosure of a micro secondary electron multiplier employing discrete dynodes which are microstructured and applied to an insulating substrate plate. In one of the disclosed embodiments, the micro secondary electron arrays are mounted on a flat annular base plate having a pair of sector-shaped arrays of such micro secondary electron multipliers. A semiconductor laser is provided with suitable optical lenses for establishing a laser beam which scatters light from a material disposed at the center of the radiometer array.

Helvy U.S. Pat. No. 5,077,504, discloses a multiple-section photomultiplier tube having a single evacuated envelope of the flat-faced, head-on variety with a plurality of closely adjacent, parallel, tubular sections of square cross-section disposed in a 4×4 array with each section having its own photocathode, its own linear-focused dynode array, and its own anode so that, effectively, sixteen (16) separate conventional photomultiplier tubes of rectangular cross-section are disposed within a single evacuated envelope. The patentee states that while all of the dynodes in most conventional multiple-section photomultiplier tubes are normally interconnected, in this disclosure one dynode in each of the sixteen (16) dynode arrays is electrically isolated from all other dynodes, thus enabling each of the isolated dynodes to be supplied with an independent voltage source enabling each of the sixteen (16) sections to be independently adjusted so that each channel has the same characteristics as all other channels.

The use of a multi-section, multi-anode photomultiplier tube employing an MCP electron multiplier for fluorescence spectroscopy is disclosed in an article entitled "Multiplexing Expands Yield from Fluorescence Analysis" (anonymous) appearing in Biophotonics International, pages 18 and 20 (March/April 1995). The device illustrated diagrammatically in the foregoing article employs an application specific integrated circuit or ASIC-based multiplexing and routing module developed by IBH Consultants in Glasgow, Scotland to couple a single-photon-timing multichannel detector to standard analysis electronics, with data output from each detector anode reflecting the fluorescence intensity detected in that section of the multi-section, multi-anode photon detector/electron multiplier.

Schmidt et al U.S. Pat. No. 5,097,173, is of interest for its disclosure of what is termed a "Channel Electron Multiplier Phototube"—e.g., apparently a variation of an MCP device—generally characterized by having non-linear channel shapes. However, in FIGS. 5 and 6 of the Schmidt et al patent, there is disclosed a structure which appears to be somewhat similar to a single MCP disk in that the device has hollow passageways formed in a unitary or monolithic ceramic body wherein the passageways are said to be straight, curved in two dimensions, or curved in three dimensions. The passageways do not appear to be microchannels—i.e., channels having a diameter of only a few microns and a length of up to approximately 1.0 mm. However, the process of operation appears to be quite similar to that of conventional MCPs.

Other prior art patents of miscellaneous interest include the following: i) Thompson U.S. Pat. No. 2,141,322 [a cascaded secondary electron emitter amplifier]; ii) Teal U.S. Pat. No. 2,160,798 [an electron discharge apparatus having cylindrical or frusto-conical shaped secondary electrodes or dynodes]; iii) Garin et al U.S. Pat. No. 4,330,731 [a particle detector employing thin planar amplifying plates defining an electron multiplier]; and iv), L'hermite U.S. Pat. No. 4,999,540 [a photomultiplier employing a stackable dynode structure comprising multiple sheets or venetian blinds].

The foregoing conventional photomultiplier tube designs—viz., i) side-on photomultiplier tubes employing circular-cage dynode chains; ii) head-on photomultiplier tubes employing box-and-grid, linear-focused, venetian blind and mesh-type dynode chains, together with combinations thereof; iii) microchannel plates; iv) apertured plates; v) multiple-section photomultiplier tubes; and vi), hybrid photodiodes-in addition to well-type detection chambers, have received widespread acceptance in the scientific community and have been used in a wide range of differing applications for periods of up to forty years or more. Notwithstanding the foregoing, such conventional prior art approaches to the absorption of photon energy, use of the absorbed photon energy to cause emission of electrons from photocathodes, and subsequent multiplication of the emitted electrons, have simply not addressed many of the concerns which continue to pose problems for the scientific instrument community.

Typical of such concerns are: i) the need for a photomultiplier tube capable of detecting light photons on a 360° surround basis so as to maximize collection efficiency; ii) a photomultiplier tube of the foregoing character having a continuous cylindrical photocathode which is uniformly and closely spaced at all points from the axis of a detection chamber and, therefore, which is characterized by significantly improved collection geometry and efficiencies; iii) an evacuated envelope for a photomultiplier tube characterized by having its light-transmissive face formed of relatively thin-walled material, thereby reducing spurious random noise pulses and providing improved signal-to-noise ratios, yet which is resistant to implosion; and iv), a single compact photomultiplier tube suitable for detecting light photons emanating from a sample or other light source—regardless of whether that sample and/or light source is disposed internally of the detection chamber, externally of the detection chamber but immediately adjacent thereto, or remote from the detection chamber—and processing the detected signals using conventional coincidence counting techniques where appropriate.

In short, the foregoing needs which have persisted for decades continue to persist today despite the commercial acceptance and extensive use of the aforesaid conventional photomultiplier tube detectors and electron multipliers.

SUMMARY OF THE INVENTION

The present invention overcomes all of the foregoing disadvantages inherent in conventional photomultiplier tube designs, including the various electron multipliers employed therein, while at the same time, taking advantage of many of the beneficial characteristics of such prior art devices by providing an annular or generally toroidal 360° surround photomultiplier tube having a central coaxial vertical bore defining a detection chamber, with the annular evacuated envelope of the photomultiplier tube characterized by its relatively thin-walled, implosion-resistant, light-transmissive face construction, and wherein the annular evacuated envelope surrounding the cylindrical photocathode is subdivided into a plurality of adjacent sections—for example, an even number of adjacent sections subtending adjacent arcs on the cylindrical photocathode (arcs which are preferably, but not necessarily, of substantially equal size) so as to enable effective employment of coincidence counting (e.g., two sections each subtending 180° adjacent arcs on the photocathode; four sections each subtending 90° adjacent arcs on the photocathode; six sections each subtending 60° adjacent arcs on the photocathode; eight sections each subtending 45° adjacent arcs on the photocathode, etc.) wherein each adjacent section in the annular envelope contains its own independent electron multiplier structure. In keeping with the invention, the electron multiplier structures employed, while conventional in and of themselves, are preferably, but not necessarily, characterized by their compactness in terms of the spacing between the input photocathode and the output anode (or other output terminal) so as to maximize the compactness of the overall annular photomultiplier tube structure without degrading electron acceleration and/or multiplication.

More specifically, it is a general aim of the present invention to provide an improved photomultiplier geometry characterized by: i) an annular envelope having a continuous, relatively thin-walled, cylindrical, inner annular wall formed of glass, quartz, or other suitable light-transmissive material defining, and surrounding, a central coaxial detection chamber; ii) a photosensitive, electron-emissive material on or immediately adjacent the vacuum side of the envelope's inner light-transmissive annular wall defining a continuous cylindrical photocathode equidistant at all points from, and in close proximity to, the central vertical axis of the detection chamber; and iii), wherein the annular space within the envelope surrounding the cylindrical photocathode is subdivided into a plurality of adjacent arcuate sections each subtending adjacent arcs on the continuous cylindrical photocathode which are preferably, but not necessarily, of substantially equal size, with each adjacent section housing an electron multiplier of otherwise generally conventional design.

In one of its more detailed aspects, it is an object of the invention to provide an improved photomultiplier tube having a 360° surround cylindrical photocathode wherein the annular space surrounding the photocathode and within the tube's envelope is subdivided into an even-numbered plurality of adjacent sections—e.g., two sections, four sections, six sections, eight sections, etc., respectively subtending adjacent arcs on the cylindrical photocathode of approximately 180°, 90°, 60°, 45°, etc.—and wherein: i) the signals output from the even-numbered electron multipliers (assuming that adjacent electron multipliers are sequentially numbered "1, 2, 3 . . . n" where "n" is any whole integer) are summed and output to a coincidence detector, and where the signals output from the odd-numbered electron multipliers are also summed and output to the coincidence detector; ii) the signals input to the coincidence detector are compared to determine whether time-coincident signals are present (indicating that the signals were almost certainly not spurious signal responses from, e.g., thermal electron emissions at the photocathode); and iii), time-coincident signals are summed and processed through a conventional spectrometer processing circuit.

In another of its important aspects, while the invention permits use of virtually any conventional electron multiplier in each section of the tube, preferably the electron multipliers employed will be characterized by: i) their fast time response; ii) good acceleration and electron multiplication characteristics; iii) linearity; and iv), compactness as measured from input to output so as to insure that the maximum diameter of the tube's annular evacuated envelope is controlled within desired limits. Consistent with this objective, it is preferable, although not essential, that the electron multipliers employed be of the MCP-type, mesh-type or hybrid photodiode-type.

An ancillary object of the invention is to provide a multiple section unitary photon detector/electron multiplier having an annular evacuated envelope and a continuous cylindrical photocathode deposited on, or immediately adjacent, the vacuum side of the envelope's inner annular wall defining a central coaxial detection chamber, which unitary photon detector/electron multiplier is capable of coincidence counting and is characterized by its compactness and small size, thereby substantially reducing the size and weight of lead shielding where external radiation is a concern.

Another important objective of the present invention is the provision of a photon detector/electron multiplier having a generally toroidal, annular, or doughnut-shaped evacuated housing defining an internal vertical bore forming a central coaxial detection chamber surrounded by an inner cylindrical housing wall formed of thin-walled glass or other suitable light-transmissive material which is implosion-resistant due to: i) its cylindrical shape; ii) its relatively small size; and iii), the fact that the upper and lower edges of the inner cylindrical wall are integrally joined to the envelope's radially outwardly extending washer-shaped top and bottom walls; and, wherein absorption and generation of spurious light due to radiations interacting with the material of the light-transmissive wall are minimized as a result of the relatively thin-walled construction, thereby minimizing generation of spurious signals. Moreover, since the photocathode deposited on, or positioned adjacent, the vacuum side of the cylindrical light-transmissive inner housing wall is also cylindrical, equidistant at all points from, and in close proximity to, the vertical axis through the detection chamber disposed centrally within the housing's inner annular wall, photon collection geometry and collection efficiencies are significantly improved.

It is a further important objective of the invention to provide an improved photomultiplier tube of the foregoing character employing an appropriately shaped reflector—for example, a reflector which is generally conical in shape—disposed within, and coaxial with, the central detection chamber defined by the tube's annular envelope and its continuous cylindrical photocathode so as to permit use of the device in detecting light emanating from sources external to the detection chamber—e.g.: i) samples containing a liquid scintillator and one or more radioactive isotopes such, for example, as a beta emitter; ii) luminescent samples such, for example, as fluorescent samples and/or phosphorescent samples; and iii), similar samples containing a light source, wherein such samples are disposed on microtiter plates or other suitable open type multiple sample trays capable of positioning such samples, in seriatim order, immediately below, or in some cases above, the detection chamber and coaxial therewith; iv) astronomical observations using a telescope or measurements of light emitting sources viewed through light collimators, microscopes, or the like; and v), other specimens such, for example, as patients having burn-wounds wherein the patient has been intravenously injected with a luminescent dye and the burn-wound has been stimulated to excite the dye and initiate luminescent emissions, as well as patients having other medical problems wherein the diagnostic approach involves ingestion or intravenous injection of luminescent tracers and subsequent optical detection thereof.

A related objective of the invention is the provision of a single, multiple-section photomultiplier tube of the foregoing character employing a central detection chamber with a coaxial, generally conical, or other suitably shaped reflector for viewing samples containing light sources which are located in depressions or pockets in an open type multiple sample tray disposed below the detection chamber and otherwise external thereto; yet, wherein the detection system is fully capable of coincidence counting, where desired, even though only a single photon detector/electron multiplier is employed incorporating the structure of the present invention.

It is a more specific object of the invention to provide a coaxial, generally conical, or other suitably shaped reflector in an improved photomultiplier tube of the foregoing character which permits use of an internal light source—such, for example, as a laser or other light source—to direct a laser or other light beam coaxially out of the detection chamber to stimulate light events in various external samples requiring external stimulation to generate such light events—for example, samples containing a luminescent material such as a fluorescent or phosphorescent material.

A related objective of the present invention is the provision of a coaxial, generally conical, or other suitably shaped reflector in an improved photomultiplier tube of the foregoing character wherein the reflector contains a source of liquid reagent and suitable metering equipment for dispensing small metered quantities of the reagent out of the apical end of the reflector and axially out of the detection chamber into an underlying sample containing a luminescent material, thereby exciting the luminescent material as a result of interaction with the reagent.

In another of its important aspects, it is an object of the invention to provide a unitary annular, or generally toroidal, multi-section photomultiplier tube having a plurality of adjacent, discrete electron/multipliers disposed in a circumferential array surrounding a single cylindrical photocathode within an annular evacuated housing wherein the cylindrical photocathode and the inner cylindrical wall of the annular evacuated housing surround, define, and are coaxial with, a central detection chamber; and, wherein a composite cylindrical assembly of a corresponding plurality of light-transmissive filters passing different wavelength bands is positioned within the detection chamber in close proximity to the evacuated housing's inner cylindrical wall. The plurality of light-transmissive filters in this embodiment of the invention are each radially aligned and matched with respective different ones of the plurality of electron multipliers, thereby enabling detection and processing of the spectral distribution of light—e.g., typically, but not exclusively, fluorescent light of the type commonly present in luminescent spectroscopic analysis—emanating from a light source either disposed within the detection chamber or which is disposed externally of the detection chamber with the light photons being directed or collimated longitudinally into the detection chamber and reflected laterally through the surrounding cylindrical array of filters and towards the surrounding cylindrical photocathode.

Indeed, this aspect of the present invention employing a composite cylindrical array of light-transmissive filters disposed coaxially within the detection chamber with the filters having different light-transmissive wavelength bands, lends itself to use for: i) fluorescent spectroscopic diagnosis of patients who have been intravenously injected with a fluorescent dye of the type such as indocyanine green ("IG") commonly employed in diagnosis of the severity of burns and similar diagnostic applications; and/or ii), optical detection of photon energy emitted from discrete regions of patients who have ingested, or been intravenously injected with, luminescent tracers and the like.

DESCRIPTION OF THE DRAWINGS

These and other objects and advantages of the present invention will become more readily apparent upon reading the following Detailed Description and upon reference to the attached drawings, in which:

FIG. 34 is a vertical sectional view similar to FIG. 33, but here depicting the use of a composite cylindrical assembly of light-transmissive filters in combination with a generally conical or other suitably shaped reflector of the type shown in FIG. 28 and suitable for reflecting light photons emanating from an external source laterally towards the surrounding coaxial composite cylindrical assembly of light-transmissive filters and the cylindrical photocathode; and, FIG. 35 is a vertical sectional view similar to FIG. 34, but here depicting a photon detector/electron multiplier embodying features of the present invention in combination with a composite cylindrical array of light filters disposed within the detection chamber in coaxial surrounding relation with respect to a generally conical reflector having an internal stimulator similar to that shown in FIG. 29; and, illustrating also, in highly diagrammatic block-and-line form, a typical luminescent spectroscopic processing system that might be employed in, for example, fluorescent spectroscopic diagnosis of the distribution of light emitted from a specimen positioned externally of the photon detector/electron multiplier which can, in this instance, comprise a hand-held diagnostic instrument for fluorescent imaging of, for example, small and large area burn-wounds or the like.

Figure 1:
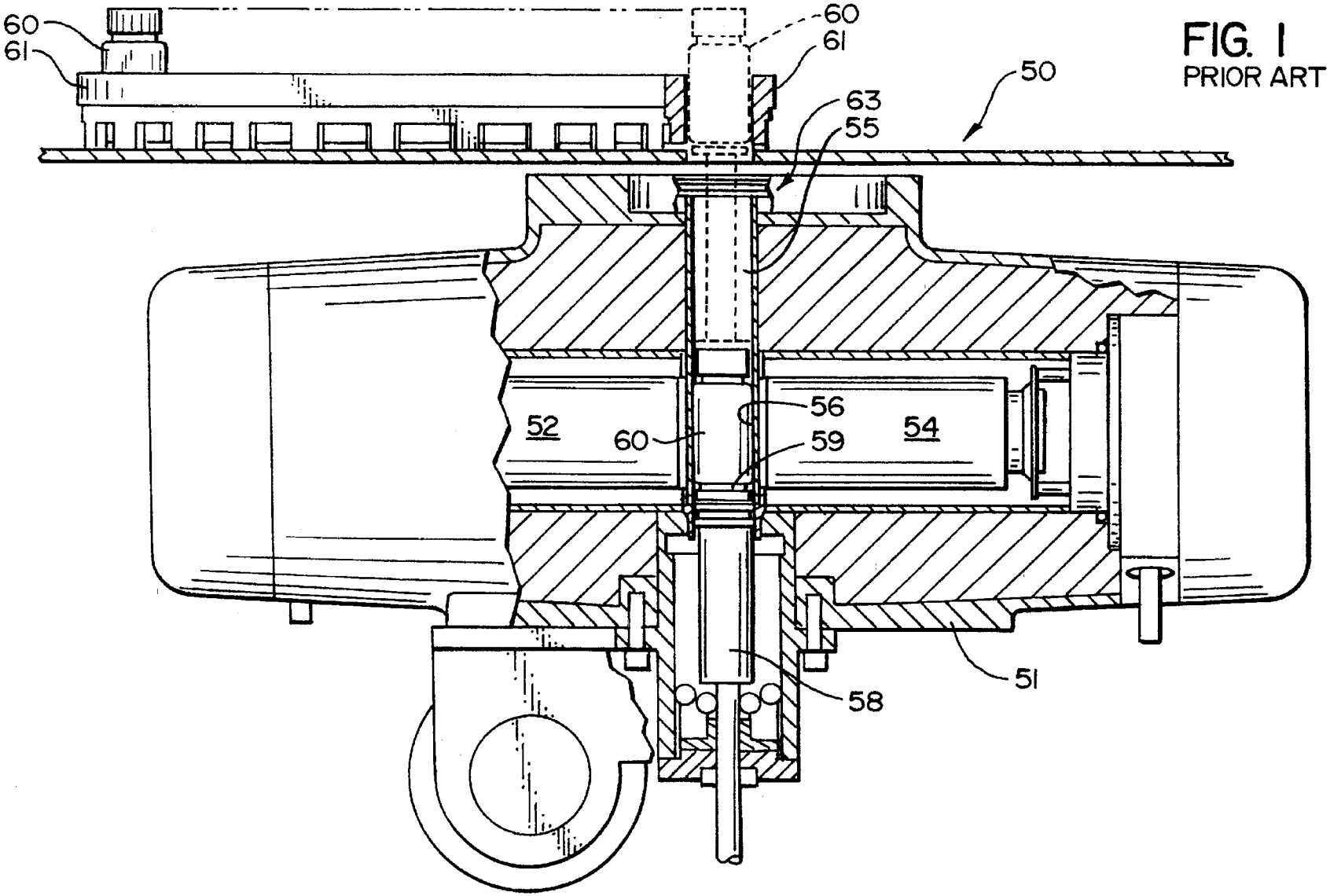
FIG. 1 PRIOR ART
FIG. 1 is a side elevational view, partly in section, here depicting a conventional prior art liquid scintillation spectrometer and, more particularly, a scintillation spectrometer having: i) a sample chamber interposed between a pair of conventional head-on photomultiplier tubes; ii) a lead shield surrounding the sample chamber and photomultiplier tubes; iii) an elevator assembly for transporting a sample between the sample chamber and a support table; and iv), a sample tray for transferring sample vials, one at a time, to and from the elevator to permit lowering thereof into the sample chamber and return thereof to the sample tray following processing.

While the invention is susceptible of various modifications and alternative forms, specific embodiments thereof have been shown by way of example in the drawings and will herein be described in detail. It should be understood, however, that it is not intended to limit the invention to the particular forms disclosed; but, on the contrary, the intention is to cover all modifications, structural equivalents, equivalent structures, and/or alternatives falling within the spirit and scope of the invention as expressed in the appended claims. Thus, in the appended claims, means-plus function clauses and similar clauses are intended to cover: i) the structures described herein as performing a specific recited function; ii) structural equivalents thereof; and iii), equivalent structures thereto. For example, although a nail and a screw may not be deemed to be structural equivalents since a nail employs a cylindrical surface to secure wooden parts together while a screw employs a helical surface, in the art broadly pertaining to fastening of wooden parts, a nail and a screw should be deemed to be equivalent structures since each perform the recited fastening function.

DETAILED DESCRIPTION

A. THE ENVIRONMENT OF THE INVENTION

1. Conventional Liquid Scintillation Spectrometers—FIGS. 1–4

Figure 2:
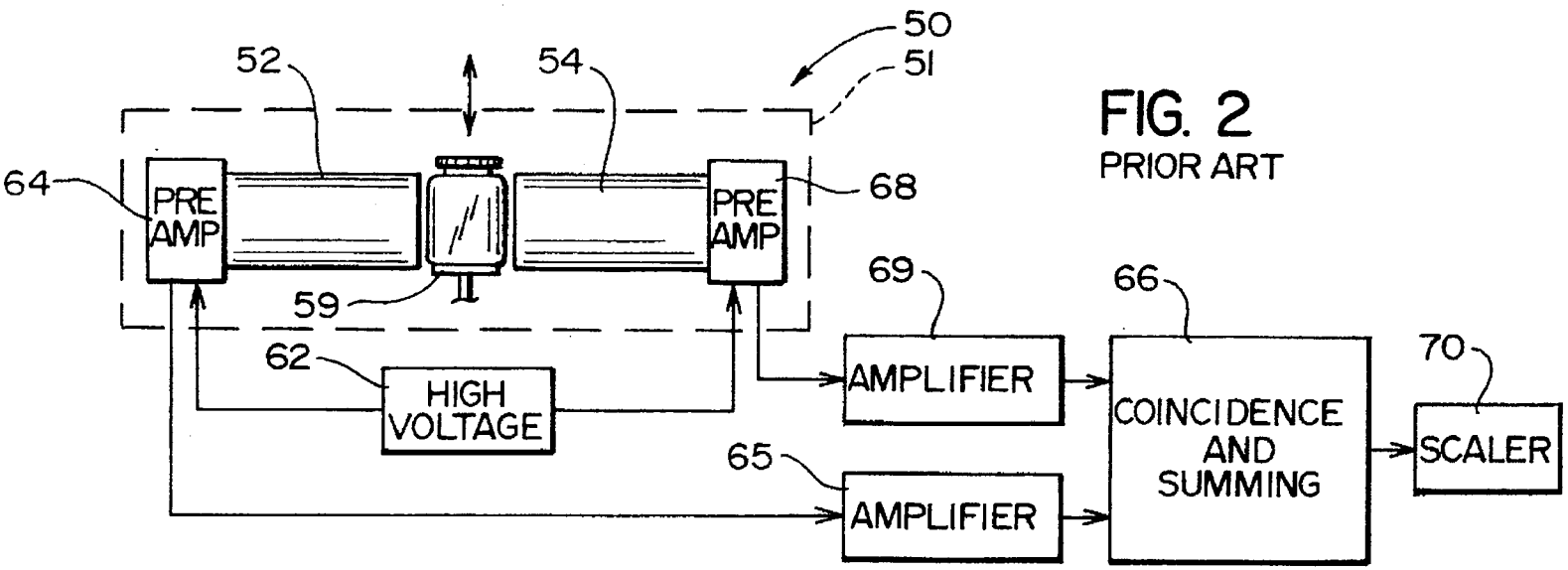
FIG. 2 PRIOR ART
FIG. 2 is a highly diagrammatic block-and-line drawing here depicting certain of the basic elements of a conventional prior art liquid scintillation spectrometer of the type used to detect scintillations in a sample contained within a vial adapted to be removeably positioned in a sample chamber located between a pair of conventional head-on photomultiplier tubes.

Turning now to the drawings, and directing attention first to FIGS. 1 and 2 conjointly, a conventional liquid scintillation spectrometer, generally indicated at 50, has been illustrated. Those interested in a more detailed description of such conventional liquid scintillation spectrometers are referred to the aforesaid Packard U.S. Pat. No. 3,188,468 and/or Packard et al U.S. Pat. No. 4,002,909. Briefly however, and as here shown, such a spectrometer 50 will commonly include a base assembly 51 which serves to house a pair of light transducers which here take the form of a pair of conventional, spaced apart, flat-faced, head-on photomultiplier tubes 52, 54 disposed on opposite sides of a vertical elevator shaft 55 defining a centrally disposed sample chamber 56. Mounted within the elevator shaft 55 is an elevator 58 having a platform 59 at its upper end for reception, support and vertical transport of one of a plurality of sample vials 60 delivered to the elevator platform 59 by a rotary sample tray 61 or other suitable sample vial transport mechanism when the elevator 58 is in its uppermost position indicated in broken lines in FIG. 1. The arrangement is such that elevator 58 serves to transport each sample vial 60, one at a time in seriatim order, downwardly through the elevator shaft 55 to the sample chamber 56 where the sample vial 60 is centered between the two head-on, flat-faced, photomultiplier tubes 52, 54.

As will be understood by persons skilled in the art, each sample vial 60 contains a liquid scintillator and one or more radioactive isotopes to be measured. Thus, as the isotope(s) undergo(es) decay events, radioactive radiations emanating from the isotope(s) interact with molecules of scintillator within the liquid scintillator solution so as to produce light scintillations which are proportional in the number of photons produced to the energy of the impinging radiation that caused the light scintillation; and, such light scintillations are then detected by the photomultipliers 52, 54. The photomultipliers 52, 54 are completely conventional; and, each contain a photocathode, a plurality of dynodes and an anode (not shown in FIGS. 1 or 2, but described in detail in conjunction with FIGS. 5 through 8) which are maintained at progressively higher voltage levels by any suitable high voltage source indicated diagrammatically at 62 in FIG. 2.

Consequently, upon impingement of incident light photons generated in the sample vial 60 upon the photosensitive cathodes of the photomultipliers 52, 54 and absorption thereof, the absorbed photons will cause the emission of one or more primary electrons from the photocathodes, which primary electron(s) is(are) attracted to the first stage dynodes which are maintained at a higher voltage level than the photocathodes. Upon impingement of the primary electron (s) on the first stage dynodes, multiple secondary electrons are emitted which are then attracted to the second stage dynodes, producing emission of still more secondary electrons for each impinging electron. This multiplication process is repeated from dynode stage to dynode stage, with the electrons emitted from the final dynode stages being attracted to the photomultipliers' anodes which produce electrical output signals in the form of voltage pulses proportional in amplitude to the number of photons generated in each light scintillation detected.

Upon completion of a counting cycle for each sample vial 60, the elevator 58 is returned upwardly to again position the vial in the rotary tray 61 or other conventional vial transport mechanism from which it was removed. A shutter mechanism, generally indicated at 63, is mounted on the upper end of the base assembly 51 for the purpose of preventing erroneous output signals from the photomultipliers 52, 54 resulting from environmental light. At the same time, the base assembly 51 is formed of suitable shielding material such, for example, as lead, which serves to minimize the amount of environmental ionizing radiation causing light flashes in the scintillation medium and/or unintentional emission of electrons in the photomultipliers 52, 54.

It will, of course, be understood by persons skilled in the art pertaining to liquid scintillation spectrometers that a conventional spectrometer of the type indicated generally at 50 in FIG. 1 will normally be used with an associated programming control circuit, including a signal processing circuit. Those interested in ascertaining specific details of such a conventional programming control circuit that serves to rotate the sample tray 61, shift the elevator 58 upwardly and downwardly in timed sequence with opening and closing of the shutter mechanism 63, and opening gates (not shown in FIGS. 1 and 2) for timed intervals to allow voltage pulses produced by the photomultipliers 52, 54 to be analyzed, are referred to the aforesaid Packard and Packard et al U.S. Pat. Nos. 3,188,468 and 4,002,909.

Suffice it to say at this point, that when a conventional programming control circuit of the type more fully described in the aforesaid Packard and Packard et al patents initiates a COUNT timing interval, and as best illustrated in FIG. 2, voltage pulses produced in the photomultiplier 52 are passed through a pre-amplifier 64 and amplifier 65 to form a first input to a coincidence detector and summing circuit 66. At the same time, voltage pulses produced in the photomultiplier 54 are passed through a pre-amplifier 68 and amplifier 69 to form a second input to the coincidence detector and summing circuit 66.

The coincidence detector and summing circuit 66, which again is completely conventional, first serves to compare the first and second amplified input signals derived from the photomultiplier tubes 52, 54 for the purpose of ascertaining whether, in fact, time-coincident signals have been detected by both photomultipliers indicating the presence of a detected scintillation in the sample vial 60. It will be understood that spurious signals resulting from, for example, thermal electron emissions from either or both of the photomultipliers' photocathodes, are completely random and will rarely, if ever, produce output pulses from both photomultipliers 52, 54 which are coincident in time. Therefore, in those instances where the coincidence detector and summing circuit 66 detects the presence of time-coincident signals output from both photomultipliers 52, 54, such time-coincident signals are generally summed and passed to a suitable scaler 70 capable of routing the summed signals to any suitable visual display device such, for example, as an oscilloscope, printer, or like utilization device (not shown).

As thus far described, conventional liquid scintillation spectrometers such as the exemplary spectrometer indicated at 50 in FIGS. 1 and 2 are designed to process discrete sample vials 60 which are: i) inserted, one at a time in seriatim order, into a sample chamber 56 disposed centrally between a pair of diametrically opposed, spaced apart, head-on photomultipliers 52, 54; ii) processed by detection of light scintillations occurring therein which impinge against the photocathodes, are absorbed thereby, and cause the emission of electrons therefrom; iii) analysis of the resulting electrons emitted from the photocathodes following multiplication thereof; and iv), thereafter removed from the sample chamber 56 and returned to any suitable vial transport mechanism 61 which serves to deliver such discrete sample vials 60 to the liquid scintillation spectrometer 50 one at a time. However, those skilled in the art will appreciate that liquid scintillation spectrometers of the foregoing general character are also suitable for use in detecting and processing light scintillations in liquid or gas samples on a continuous flow-through basis.

Figure 3:
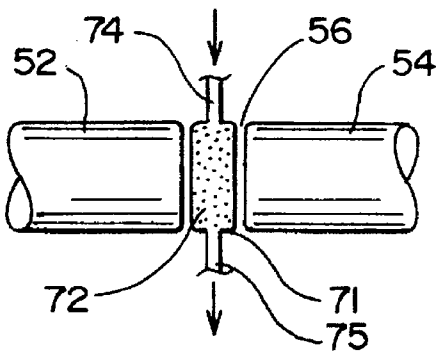
FIG. 3 PRIOR ART
FIG. 3 is a fragmentary side elevational view of a somewhat modified sample processing system in a conventional liquid scintillation spectrometer, here illustrating a pair of head-on photomultiplier tubes disposed on opposite sides of a flow-through cell packed with scintillation crystals.

For example, referring to FIG. 3 it will be noted that the elevator 58 depicted in FIGS. 1 and 2 has been replaced by a stationary cell 71 packed with suitable scintillation material 72 formed of yttrium silicate, calcium fluoride, scintillating glass, or the like; and, the packed cell 71 is disposed in the sample chamber 56 between the spaced apart, head-on photomultipliers 52, 54. Cell 71 is provided with an inlet port 74 and an outlet port 75. Thus, the arrangement is such that a continuous sample stream containing one or more radioactive isotopes to be measured is introduced into the packed cell 71 through inlet port 74, transits the packed cell disposed in the sample chamber 56, and is removed from the packed cell 71 through outlet port 75. As the sample stream passes through the packed cell 71, radiations emitted by the isotope(s) contained in the flowing sample interact with the scintillation material 72, producing light scintillations which are detected by the photomultipliers 52, 54 in the manner previously described.

Figure 4:
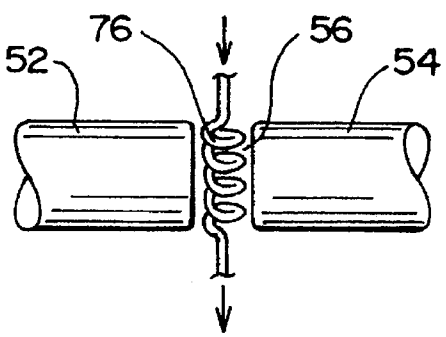
FIG. 4 PRIOR ART
FIG. 4 is a fragmentary elevational view similar to FIG. 3, but here illustrating a conventional prior art liquid scintillation spectrometer of the type using a helical tube formed of either a scintillating plastic material or Teflon tubing (Teflon is a registered trademark of Dupont Corp.) packed with a solid scintillator and disposed in the sample chamber between a pair of head-on photomultiplier tubes and through which a liquid sample to be processed flows.

Yet another exemplary and completely conventional flow-through scintillation sample counting system has been diagrammatically illustrated in FIG. 4. In this instance, the sample containing the radioactive isotope(s) of interest is passed through a tubular helical coil 76 formed of either: i) scintillating plastic material; or ii), Teflon (Teflon is a registered trademark of Dupont Corp.) either packed with a solid scintillator or, more often, through which a mixture of column eluant plus liquid scintillator is pumped. In any case, the helical coil 76 is disposed centrally within the sample chamber 56 intermediate the pair of head-on photomultiplier tubes 52, 54. Thus, as the sample flows through the helical coil 76, decay events occurring in the isotope(s) present in the flowing sample result in interactions between the emitted radiations and the scintillator material contained within the helical coil 76, or from which the helical coil is made, once again producing light scintillations which are detected and processed by the photomultipliers 52, 54 in the manner previously described.

2. Conventional Electron Multipliers—FIGS. 5–12

Conventional photomultipliers, such as those shown in FIGS. 1 through 4 at 52, 54, are highly versatile photosensitive devices which are available in a wide variety of types to fit specific applications. As previously indicated, the photomultiplier of choice in the liquid scintillation industry has, for a number of years been, and is today, a head-on photomultiplier tube 52, 54 which is highly sensitive to photon energy and capable of: i) emitting electrons from the photocathode which are related to the number of photons impinging upon, and which are absorbed by, the photocathode; and ii), rapidly multiplying the electrons produced to provide a meaningful output signal. Typical, and completely conventional, head-on photomultipliers include, for example: i) a box-and-grid photomultiplier indicated at 52*a*(54*a*) in FIG. 5; ii) a linear-focused photomultiplier indicated at 52*b*(54*b*) in FIG. 6; iii) a venetian blind photomultiplier indicated at 52*c*(54*c*) in FIG. 7; and iv), a mesh-type photomultiplier indicated at 52*d*(54*d*) in FIG. 8. Each of these different types of photomultipliers include: a) a photoemissive cathode commonly referred to as a photocathode 78; b) one or more focusing electrodes 79; c) an electron multiplier generally indicated 80*a*, 80*b*, 80*c*, 80*d* in respective ones of FIGS. 5 through 8; and d), an anode 81, with all of the foregoing structural components housed in an evacuated envelope 82 and defining a conventional head-on photomultiplier vacuum tube. The structure which tends to distinguish one type of conventional head-on photomultiplier tube from another are the electron multipliers 80*a*–80*d* which will be described in somewhat greater detail below in connection with FIGS. 5 through 8.

Figure 5:
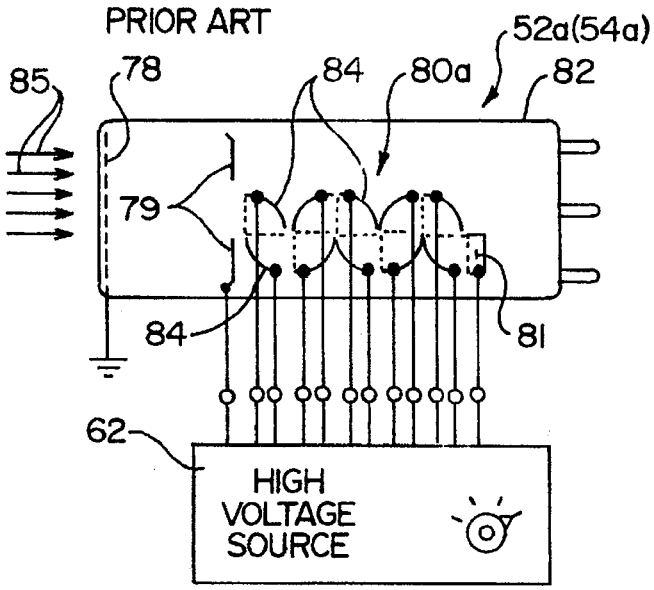
FIG. 5 PRIOR ART
FIG. 5 is a diagrammatic block-and-line drawing depicting a conventional prior art head-on photomultiplier tube of the box-and-grid type.
Figure 7:
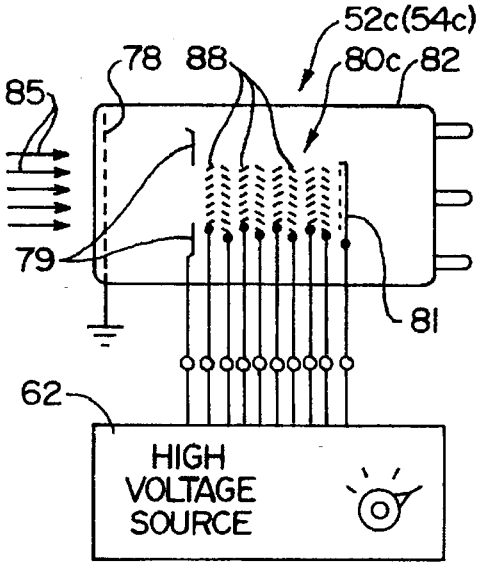
FIG. 7 PRIOR ART
FIG. 7 is a diagrammatic block-and-line drawing similar to FIGS. 5 and 6, but here illustrating a conventional prior art head-on photomultiplier tube of the venetian blind type.

Referring first to FIG. 5, a conventional box-and-grid head-on photomultiplier 52*a*(54*a*) has been illustrated wherein the structure of the electron multiplier 80*a* comprises a series, or chain, of dynodes 84 which are each one quarter (¼) of a cylinder in cross-sectional configuration with the second and third dynodes 84 in the chain being disposed in side-by-side relation and together defining a somewhat semi-cylindrical cross-sectional configuration. The fourth and fifth dynodes 84 in the chain together define a facing somewhat semi-cylindrical cross-sectional configuration wherein the fourth dynode is directly opposite and facing the third dynode and the fifth dynode is directly opposite and facing the sixth dynode. Similarly, the sixth and seventh dynodes also define a somewhat semi-cylindrical cross-sectional configuration facing in the same direction as the second and third dynodes and being in side-by-side relationship therewith. In other words, the foregoing symmetrical dynode structure is continued down the length of the evacuated envelope 82 as shown in FIG. 5.

In the exemplary box-and-grid electron multiplier 80*a* depicted in FIG. 5, ten (10) dynodes 84 are employed; but, those skilled in the art will appreciate that conventional head-on photomultiplier tubes will typically employ anywhere from on the order of up to about ten (10) dynodes to as many as sixteen (16) or more dynodes in the chain.

However, irrespective of the number of dynodes 84 employed, and irrespective of whether the particular photomultiplier 52(54)employed includes a box-and-grid, a linear-focused, a venetian blind or a mesh-type electron multiplier 80*a*–80*d*, each of the successive downstream electronic components—starting with the photocathode 78 and proceeding through the focusing electrode(s) 79, each of the subsequent dynode stages in the electron multipliers 80*a*–80*d*, and terminating with the anode 81—is connected to a progressively higher voltage level derived from any suitable high voltage source 62 so as to insure that electrons emitted from one stage are attracted to, and accelerated towards, the next succeeding higher voltage downstream stage. Those skilled in the art will appreciate that the particular voltage values selected are not critical to the invention and may vary widely dependent solely upon the application to which a given photomultiplier tube is to be applied and/or the intensity of the light sources being detected. For example, while the photocathodes 78 in the photomultiplier tubes 52*a*(54*a*) through 52*d*(54*d*) depicted in respective different ones of FIGS. 5 through 8 are shown as coupled to ground, they can be coupled to any desired voltage level ranging from a negative voltage, to zero volts or ground, to any appropriate positive voltage provided only that the first stage dynodes 84, 86, 88 and 89 are coupled to a higher voltage level.

In operation of the box-and-grid photomultiplier tube 52*a*(54*a*) depicted in FIG. 5, incident light, represented by the arrows 85, enters the flat-faced, light-transmissive end of the envelope 82, impinges upon the photoemissive material deposited on the vacuum side of the flat-faced end of the tube which defines the photocathode 78, and is absorbed thereby. The photocathode 78, which is known in the art as a transmission-type device, emits photoelectrons into the vacuum tube related to the number of incident photons 85 absorbed, which photoelectrons-herein termed primary electrons—are attracted and accelerated by the focusing electrode(s) 79 which are maintained at a voltage level higher than that of the photocathode 78 and are, therefore, directed towards the electron multiplier 80*a*, impinging against the first dynode stage 84 where each impinging primary electron causes the emission of multiple secondary electrons. The secondary electrons are, in turn, attracted and accelerated towards the second dynode stage 84 where each impinging electron again causes the emission of multiple secondary electrons. This process is repeated from dynode stage to dynode stage, with the multiple electrons generated being collected at the anode 81 as an output signal in the form of a voltage pulse whose amplitude is proportional to the number of incident photons detected from the original light source and which impinge against the photocathode 78 as indicated at 85.

As pointed out in the aforesaid article entitled "Instrumentation for Internal Sample Liquid Scintillation Counting" written by Lyle E. Packard and published by Pergamon Press in 1958, in a typical photomultiplier tube 52(54) having ten (10) dynodes where, on average, three (3) secondary electrons are emitted for each impinging electron, the multiplication factor would be $3^{10}$—viz., a multiplication factor of approximately 60,000. And, if the high voltage levels applied to the photomultiplier tube are increased sufficiently to increase the multiplication factor to $4^{10}$, the overall gain will be over 1 million. The amount of gain required will, of course, vary from application to application dependent upon the average number of photons in the initial light flashes detected by the photomultiplier tube.

Photomultiplier tubes employing box-and-grid electron multipliers 80*a* such as shown in FIG. 5 are widely used because of the simplicity of the dynode design and the improved uniformity provided thereby. However, such tubes 52*a*(54*a*) do not provide as fast a time response as may be desirable in some applications.

Figure 6:
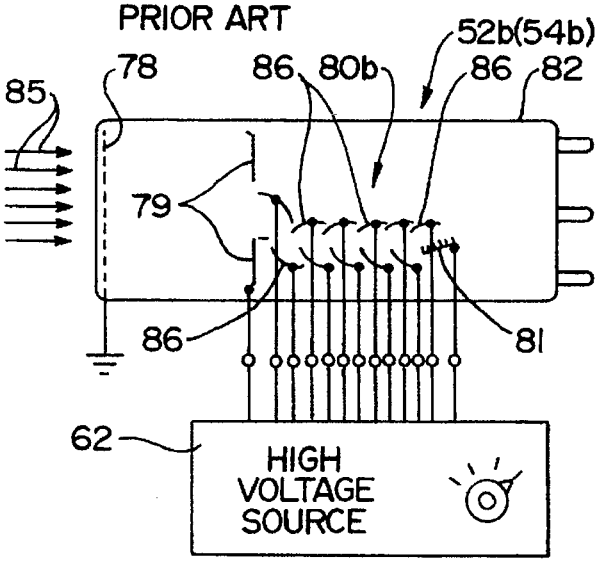
FIG. 6 PRIOR ART
FIG. 6 is a diagrammatic block-and-line drawing similar to FIG. 5, but here illustrating a conventional prior art head-on photomultiplier tube of the linear-focused type.

Turning to FIG. 6, it will be noted that the head-on photomultiplier tube 52*b*(54*b*) there depicted includes an electron multiplier 80*b* having a dynode structure of the linear-focused variety. In this instance, eleven (11) dynode stages 86 are depicted which each comprise a curvilinear structure somewhat similar to a "new moon" shape with such dynode structure being oriented so as to insure each dynode stage 86 receives impinging electrons from the previous upstream stage 86 and directs multiple secondary emitted electrons towards the next succeeding downstream stage 86. Other than the shape and number of the dynode stages 86 in the electron multiplier 80*b* depicted in FIG. 6, the operation of the photomultiplier tube 52*b*(54*b*) is essentially the same as that of the box-and-grid tube 52*a*(54*a*) shown in FIG. 5. However, linear-focused photomultiplier tubes such as shown at 52*b*(54*b*) in FIG. 6, and as described in the aforesaid U.S. Pat. No. 5,363,014-Nakamura, have relatively fast time response characteristics and excellent pulse linearity; and, therefore, such tubes are widely used in applications where fast time response and pulse linearity are important considerations.

Another conventional head-on photomultiplier tube 52*c* (54*c*) which, in this case, employs a venetian blind electron multiplier 80*c* somewhat similar to that disclosed in U.S. Pat. No. 3,415,990-Watson, has been illustrated in FIG. 7. Once again, the most significant structural difference between the photomultiplier tube 52*c*(54*c*) shown in FIG. 7 and those shown in FIGS. 5 and 6 resides in the structure of the electron multiplier 80*c*. Thus, as here shown, each dynode stage 88 comprises a series of planar elements which are spaced apart in a chevron-like array with such dynode stages 88 simulating a venetian blind structure wherein the chevron dynode elements in alternate dynode stages are angled in opposite directions. This type of electron multiplier 80*c* is characterized by having a relatively large dynode area and is preferably used with photomultiplier tubes having relatively large area photocathodes 78. The structure produces relatively large output pulses and exhibits excellent uniformity; but, it does not provide as fast a time response as can be obtained with, for example, a linear-focused electron multiplier such as that shown at 80*b* in FIG. 6.

Figure 8:
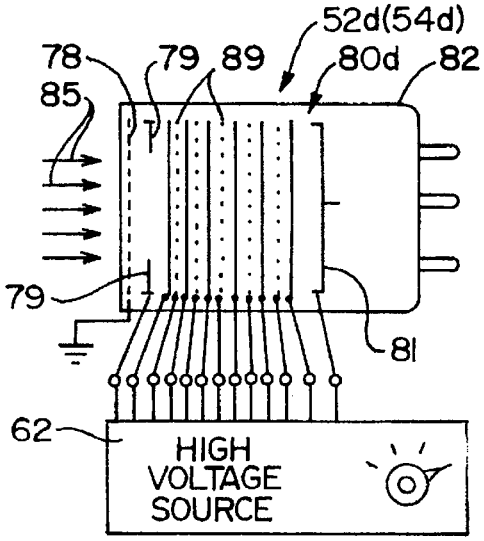
FIG. 8 PRIOR ART
FIG. 8 is a diagrammatic block-and-line drawing similar to FIGS. 5 through 7, here depicting a conventional prior art head-on photomultiplier tube of the mesh type.

Referring next to FIG. 8, another conventional head-on photomultiplier tube 52*d*(54*d*) has been illustrated employing an electron multiplier 80*d* of the mesh-type. In this type of electron multiplier 80*d*, each successive dynode stage 89 comprises a mesh-type electrode structure consisting of the series of parallel electrodes lying in a common plane and, in some instances, a plurality of intersecting right-angularly related electrodes lying in a common plane. The design permits a highly compact array of multiple dynode stages 89 which are stacked together in closely spaced apart proximity. Photomultiplier tubes employing mesh-type electron multipliers 80*d* are highly immune to magnetic fields, possess high pulse linearity and good uniformity. Moreover, such photomultiplier tubes 52*d*(54*d*) can provide excellent spatial resolution where spatial resolution is a desirable characteristic.

Although head-on photomultipliers of the types depicted at 52*a*(54*a*) through 52*d*(54*d*) in respective ones of FIGS. 5 through 8 have been known and widely used for decades, they are not the only types of conventional electron multipliers that have been employed with photosensitive cathode materials. To the contrary, microchannel plates ("MCPs") such as shown at 90 in FIG. 9 were developed at least as early as the 1950's and have seen widespread use, particularly in the field of night vision devices. Variations of such MCPs have also seen use in such exemplary apparatus as: i) cathode ray tubes (Manley et al U.S. Pat. No. 3,260,876); ii) x-ray imaging intensifier tubes (Beauvias et al U.S. Pat. No. 5,319,189), and iii), channel type electron multiplier tubes (Schmidt et al U.S. Pat. No. 5,097,173).

Figure 9:
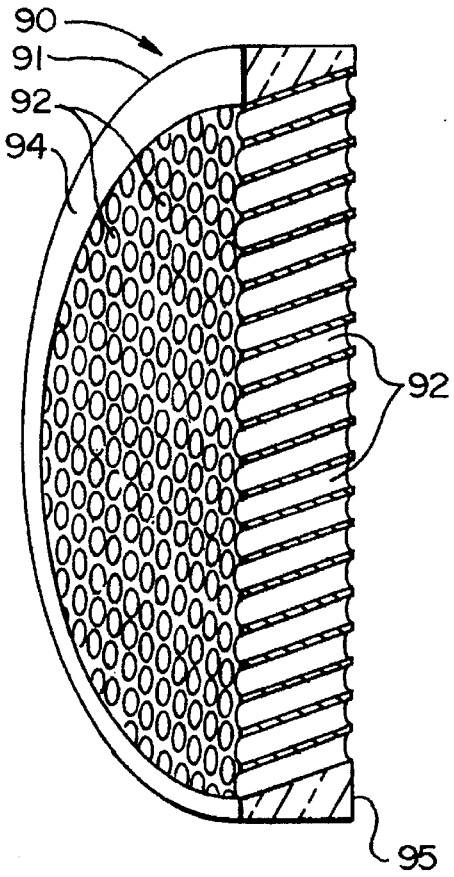
FIG. 9 PRIOR ART
FIG. 9 is a fragmentary, highly diagrammatic isometric drawing of a conventional prior art microchannel plate ("MCP") comprising a thin disk containing millions of micro glass tubes or channels (here shown in highly enlarged and exaggerated form) fused in parallel with one another, with each channel comprising an independent electron multiplier equivalent in function to the box-and-grid, linear-focused, venetian blind and mesh-type dynode chains depicted in FIGS. 5 through 8.

Generally stated, a conventional MCP, such as that shown at 90 in FIG. 9, comprises a relatively thin disk 91—e.g., a disk ranging in thickness from about 0.5 mm up to on the order of about 1.0 mm and having a diameter on the order of from about 18 mm up to about 50 mm—formed of glass and having formed therein millions of micro glass tubes known as "channels" or "microchannels" which extend from the upstream face 94 of the disk 91 to the opposite or downstream face 95 thereof. As previously indicated, MCPs are also available commercially having rectilinear and other shapes rather than the circular disk-shaped MCP depicted in FIG. 9.

The methods of manufacturing MCP devices vary widely; are not critical to the present invention; and, virtually any commercially available type of MCP can be adapted for use with the invention. For example, such MCPs are commercially available from companies such as Galileo Electro-Optics Corporation, Galileo Park, Sturbridge, Mass. and Hamamatsu Photonics K.K., Shizuokaken, Japan. However, Saito et al U.S. Pat. No. 4,780,395 discloses one method for making such MCPs; and, additionally, the patentees briefly describe at column 1, lines 32 through 49, a somewhat more conventional method of manufacturing such MCPs. While not critical to the invention, a general understanding of a more conventional method for manufacturing an MCP will facilitate an understanding of the nature and operation of MCPs and, therefore, of their applicability for usage with the present invention.

Accordingly, in one conventional method for manufacturing MCPs, a multiplicity of tubular glass bodies having glass cores formed therein and adapted to be formed into capillary-like tubes are heated and elongated. Millions of the foregoing elongated glass bodies are then bundled, fused together, reheated, again elongated, and fused into an integral elongated bundle which is sliced transversely to form relatively thin discrete disks each having a thickness ranging from about 0.5 mm to about 1.0 mm. The sliced disks are then ground; and, the cores are removed by etching to form a disk 91 such as shown in FIG. 9 having millions of discrete, parallel and generally equidiameter microchannels 92 extending between the upstream and downstream faces 94, 95 of the disk 91. Generally stated, the diameters of the microchannels 52 will range from about 12 microns to about 20 microns dependent upon the initial diameter of the cores and the degree of total elongation of the bundle. A secondary electron emissive surface formed of, for example, lead oxide (PbO) is formed on the inner surface of each microchannel 92 by heat treatment, while the upstream and downstream faces 94, 95 of the disk 91 are coated with a conductive material to form accelerating electrodes.

As indicated above, when forming the individual disks 91, the fused, elongated, integral bundle of glass bodies is sliced transversely to form discrete disks 91 having a desired thickness. Obviously, when the bundle of glass bodies is sliced transversely at right angles to the longitudinal axis thereof, the resulting microchannels 92 will not only be closely spaced and parallel to one another but, additionally, they will be parallel to the longitudinal axis extending through the disk 91. In order to minimize the chance that a primary electron moving in an axial direction will pass either entirely through a microchannel 92, or through a substantial length of the microchannel 92, without impinging against the wall thereof and producing secondary electrons, the bundle of glass bodies is preferably sliced at an oblique angle to the longitudinal axis extending therethrough, thus producing an arrangement such as shown in FIG. 9 wherein each microchannel 92 is oriented at a slight angle to the longitudinal axis passing through the disk 91.

Such an arrangement is particularly advantageous where two or more disks 91, 91' are mounted in tandem so that each microchannel 92 in the upstream tandem disk 91 (FIGS. 10 and 12) will be approximately aligned with a corresponding microchannel 92' in the downstream tandem disk 91'. Preferably, however, the downstream disk 91' is rotated slightly about its longitudinal axis relative to the upstream disk 91 so that the axis of the downstream microchannel 92' is disposed at an angle with respect to the axis of the upstream microchannel 92, thereby further insuring that emitted electrons will impinge against the walls of the approximately aligned, but angularly related, microchannels 92, 92' at multiple points along the lengths thereof since there is not a straight-through line-of-sight path extending through the tandem disks 91, 91'.

Figure 10:
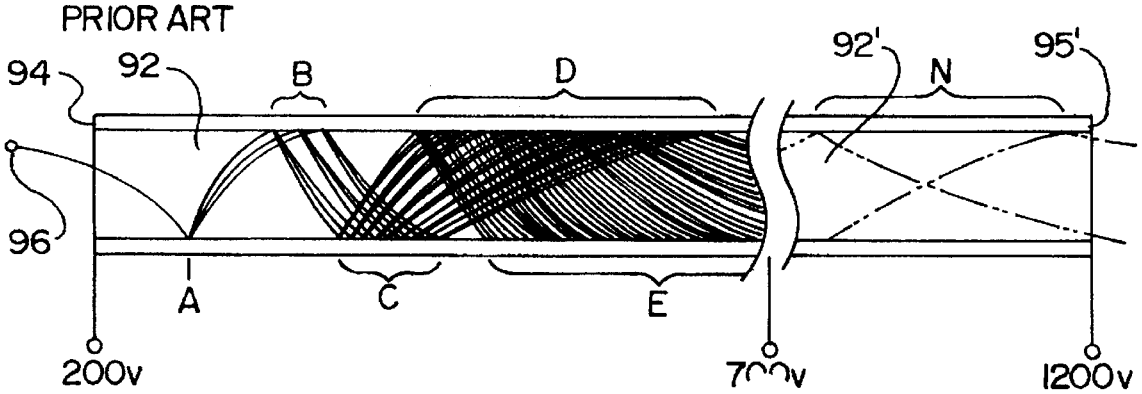
FIG. 10 PRIOR ART
FIG. 10 is a highly diagrammatic, fragmentary, block-and-line drawing depicting an exemplary, but typical, electron multiplication process as carried out in micro glass channels formed in a pair of conventional tandem microchannel plates wherein the micro glass channels formed in each of the two tandem MCPs are, solely for the purpose of clarity, depicted as being coaxial, whereas in an actual tandem MCP configuration, the longitudinal axes of the two channels are angularly related.

Referring to FIG. 10, the principle of operation of a typical set of tandem MCPs will be described with respect to electron multiplication in upstream and downstream microchannels 92, 92' formed in respective ones of upstream and downstream tandem disks 91, 91'. It will, of course, be appreciated by those skilled in the art that where a pair of disks 91, 91' are oriented in a tandem configuration with the upstream disk 91 having millions of microchannel 92 outlets and the downstream disk 91' having millions of microchannel 92' inlets, all located within very small areas, it is virtually impossible to insure accurate registration and alignment of the microchannel outlets in disk 91 with corresponding ones of the microchannel inlets in disk 91'. This, however, does not pose a problem since electrons exiting from one of the microchannels 92 in the upstream disk 91 will be attracted to, enter, and be multiplied in one of the microchannels 92' in the downstream disk 91' provided only that the given downstream microchannel 92' is approximately aligned with one of the upstream microchannels 92 in disk 91.

Figure 12:
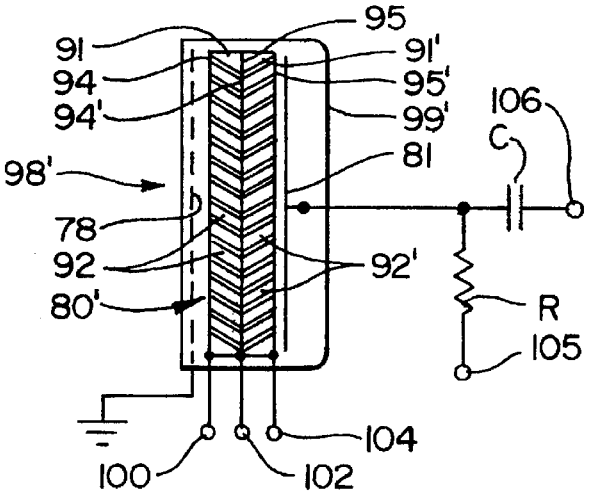
FIG. 12 PRIOR ART
FIG. 12 is a diagrammatic vertical sectional view similar to FIG. 11, but here depicting a conventional prior art head-on photomultiplier tube employing a photocathode, a pair of tandem microchannel plate disks defining the electron multiplier, and an anode, all housed within an evacuated envelope.

With the foregoing in mind, and as best shown by reference to FIGS. 10 and 12 conjointly, but with particular attention being directed to FIG. 10, it will be noted that a microchannel 92 in the upstream disk 91 which is approximately aligned with a corresponding microchannel 92' in the downstream disk 91' together define a single path for passage and multiplication of electrons. In FIG. 10, the microchannels 92, 92' have been shown as being coaxially aligned solely for purposes of clarity. It will, however, be understood that, in fact, the downstream face 95 of the upstream disk 91 and the facing upstream face 94' of the downstream disk 91' are only approximately aligned in approximate end-to-end relation; and, their respective axes are preferably angularly related as diagrammatically shown in FIG. 12 so as to insure that there is not a straight-through line-of-sight path extending through the tandem disks 91, 91' even though electrons exiting from any given one of the microchannels 92 in disk 91 may freely enter and pass through one of the angularly related microchannels 92' in disk 91'.

In order to form accelerating electrodes on the upstream faces 94, 94' and downstream faces 95, 95' of the tandem disks 91, 91' (FIG. 12) which serve to create electric fields along the axes of the microchannels 92, 92' (FIG. 10) for accelerating electrons during their passage therethrough, and as best shown in the exemplary arrangement depicted in FIG. 10, the front conductive face 94 of the upstream disk 91 containing microchannel 92 is coupled to any suitable high voltage source of, for example, +200 volts ("V"); the downstream conductive face 95 of the upstream disk 91 and the conductive upstream face 94' of the downstream disk 91' (not shown in FIG. 10, but visible in FIG. 12) are each coupled directly or indirectly through inherent resistances of the disks to a voltage source maintained at a higher level such, for example, as +700 V; while the downstream conductive face 95' of the disk 91' containing the angularly related downstream microchannel 92' is coupled to a still higher source of voltage such, for example, as +1200 V.

However, those skilled in the art will appreciate that the particular voltage levels selected are merely matters of design choice and the particular application to which the tandem MCPs are to be put; and, it is merely necessary to insure that the voltage levels progressively increase from the upstream face 94 of the most upstream disk 91 to the downstream face 95' of the most downstream tandem disk 91'.

As the ensuing operational description proceeds, it will be assumed that the microchannel geometry, voltage levels, and the particular emissive coatings employed on the wall of each microchannel 92, 92' have been selected and/or adjusted so as to produce a multiplication factor of approximately three (3)—i.e., each impinging electron will cause emission of approximately three (3) secondary electrons. Thus, when voltage levels of +200 V and +700 V are applied to respective ones of the upstream and downstream faces 94, 95 of disk 91, and voltage levels of +700 V and +1200 V are applied to respective ones of the upstream and downstream faces 94', 95' of the downstream tandem disk 91', electric fields are generated in the directions of the axes of respective ones of the angularly related microchannels 92, 92'.

Under these conditions, when a primary electron such as that diagrammatically illustrated at 96 in FIG. 10—e.g., an electron emitted by the photocathode 78 of the head-on photomultiplier tube 98' depicted in FIG. 12—is emitted, the electron 96 will be attracted by, and accelerated towards, the microchannel 92 in upstream disk 91 by virtue of the +200 V level at the upstream face 94 of the disk 91. When the primary electron 96 impinges against the wall of the microchannel 92 in the region A at or near the upstream face 94 of the upstream disk 91, approximately three (3) secondary electrons are emitted. These three secondary electrons are accelerated by the electric field; move along parabolic trajectories determined by their initial velocities; and, impinge against the opposite wall of the microchannel 92 in the region B, with each impinging electron causing emission of approximately three (3) more secondary electrons for a total of approximately nine (9) secondary electrons. Similarly, the nine secondary electrons emitted from the region B are accelerated by the electric field; move along parabolic trajectories determined by their initial velocities; and, impinge against the opposite wall of the microchannel 92 in the region C, again causing emission of approximately three-fold the number of impinging electrons which are accelerated towards the region D.

This multiplication process is continued throughout the length of microchannel 92 in the upstream disk 91; and, when the accelerating stream of electrons reaches the interface between the two tandem disks 91, 91', the electric field produced by the voltage levels of +700 V at the upstream face 94' and +1200 V at the downstream face 95' of the downstream tandem disk 91' causes continued multiplication of the electrons in microchannel 92' (which, although not shown in FIG. 10, is angularly related to microchannel 92 as diagrammatically indicated in FIG. 12) in the same manner as described above for microchannel 92 in the upstream disk 91. As a result, the multiplication of secondary electrons increases exponentially towards the downstream face 95 of a single MCP disk 91 (FIG. 11) or towards the downstream face 95' of tandem MCP disks 91, 91' (FIGS. 10 and 12).

In short, it will be appreciated that the electron multiplication process as carried out by one or more MCP disks is functionally the same and, essentially structurally equivalent, to the electron multiplication process as carried out in conventional photomultipliers of the type employing box-and-grid, linear-focused, venetian blind and/or mesh-type electron multipliers of the types indicated at 80*a* through 80*d* in respective ones of FIGS. 5 through 8; except, that comparable multiplication occurs in a highly compact space of from about 0.5 mm to about 2.0 mm in length, as compared with conventional photomultipliers having electron multipliers 80*a*–80*d* disposed within tube housings whose lengths generally range from about 100 mm to about 200 mm for each photomultiplier.

Moreover, those skilled in the art will appreciate that the region of the microchannel 92 closest to the upstream face 94 of disk 91 (region A in FIG. 10) comprises an input stage into the MCP which is functionally equivalent, and for all practical purposes, an essentially equivalent structure, to a first stage dynode in a conventional head-on photomultiplier such as those shown at 52*a*, 54*a* through 52*d*, 54*d* in FIGS. 5 through 8. Similarly, the region of the microchannel 92' closest to the downstream face 95' in disk 91' (i.e., the region N depicted in FIG. 10, or the corresponding region of the microchannel 92 closest to the downstream face 95 in disk 91 in a single MCP configuration) comprises an output MCP stage functionally and structurally equivalent to the last dynode stage in a conventional head-on photomultiplier; while the intermediate regions of the microchannel(s) 92(92')—i.e., regions B, C, D, E, etc. shown in FIG. 10—comprise intermediate dynode stages structurally and functionally equivalent to those found in conventional head-on photomultipliers.

Figure 11:
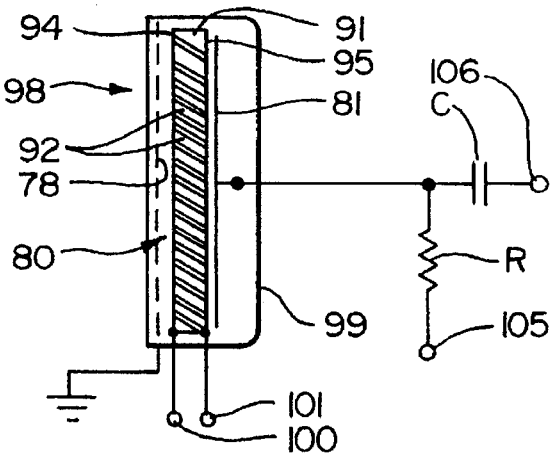
FIG. 11 PRIOR ART
FIG. 11 is diagrammatic vertical sectional view depicting a head-on photomultiplier employing: i) a photocathode; ii) a single microchannel plate disk defining the electron multiplier, or dynode stages; and iii), an anode, all housed in an evacuated envelope comprising a conventional head-on photomultiplier tube.

Referring next to FIGS. 11 and 12 conjointly, it will be observed that two head-on photomultiplier tubes 98 (FIG. 11) and 98' (FIG. 12) have been illustrated which employ either one MCP disk 91 (FIG. 11) or two tandem disks 91, 91' (FIG. 12). In each case, the exemplary head-on photomultiplier tubes 98, 98' include: i) a conventional photocathode 78; ii) an electron multiplier generally indicated at 80 and 80' in respective ones of FIGS. 11 and 12; and iii), an anode 81, which structure is all contained within evacuated envelopes 99, 99' respectively depicted in FIGS. 11 and 12. Although no focusing electrodes have been shown in FIGS. 11 and 12, those skilled in the art will appreciate that, where desirable and advantageous, focusing electrodes can be deployed between the photocathode 78 and the MCP disk 91.

In the exemplary devices, the photocathodes 78 are shown coupled to ground; and, the upstream face 94 of the disk 91 is coupled to a terminal 100 associated with any suitable high voltage source (not shown in FIGS. 11 and 12, but similar to high voltage source 62 shown in FIGS. 5 through 8). Similarly, the downstream face 95 of disk 91 in FIG. 11 is coupled to terminal 101 associated with the high voltage source; the downstream face 95 of the disk 91 in FIG. 12 and the upstream face 94' of the disk 91' may be coupled to a terminal 102 of the high voltage source or may simply get its voltage from the inherent resistances of the disks dividing the voltage differences between terminals 100 and 104; the downstream face 95' of disk 92' is coupled to terminal 104 of the high voltage source; and, the anodes 81 of both head-on photomultipliers 98, 98' are coupled via resistor R to terminal 105 of the high voltage source. In addition, the anodes 81 of both head-on photomultipliers 98, 98' are each coupled through capacitor C to an output terminal 106 from which the voltage pulses produced by the multiplied electrons and collected at the anodes 81 can be delivered to any suitable pulse analyzing circuitry (not shown).

B. GENERAL ORGANIZATION OF EXEMPLARY 360° SURROUND PHOTON DETECTORS/ELECTRON MULTIPLIERS EMBODYING THE INVENTION

1. 360° Surround Photon Detector/Electron Multiplier Employing Multiple MCP Electron Multiplexers—FIGS. 13–16B Thus far, the environment of the invention has been described in connection with a liquid scintillation spectrometer system such as that indicated at 50 in FIGS. 1 and 2, and continuous flow-through systems such as those depicted diagrammatically in FIGS. 3 and 4, all of which employ a pair of completely conventional, spaced apart, flat-faced, head-on photomultiplier tubes 52, 54 disposed on opposite sides of a sample chamber 56. The environment of the invention has further been described in connection with completely conventional electron multipliers including, for example: i) head-on photomultiplier tubes employing box-and-grid electron multipliers 80*a* (FIG. 5); ii) head-on photomultiplier tubes employing linear-focused electron multipliers 80*b* (FIG. 6); iii) head-on photomultiplier tubes employing venetian blind electron multipliers 80*c* (FIG. 7); and iv), head-on photomultiplier tubes employing mesh-type electron multipliers 80*d* (FIG. 8); as well as electron multipliers comprising one or more MCPs (FIGS. 9 and 10) in either a single disk 91 arrangement (FIG. 11) or a tandem disk 91, 91' arrangement (FIG. 12). As previously indicated, all of such systems and components have suffered from a number of disadvantages principally attributable to the use of photomultiplier tubes and electron multipliers of conventional design employing either flat-faced or convex light-transmissive tube ends.

For example, conventional head-on photomultiplier tubes, whether using conventional dynode chains, single or tandem MCPs, or other types of electron multipliers, typically employ either a flat photocathode 78 or a photocathode deposited on the internal or vacuum-side concave face of a tube having a convex rounded or semi-spherical envelope. Thus, in neither case is the photocathode 78 equidistant at all points from, and in close proximity to, the axis of the sample chamber 56; and, additionally, when flat-faced tube envelopes are employed, the flat face of the evacuated envelope must be unduly thick for strength, leading to absorption problems and problems with radiation from either internal or external sources. Moreover, the geometry of the face of the photocathode 78 precludes 360° surround collection capability and requires resort to polished or mirrored detection chamber surfaces in an attempt to recover some of the photon energy that would otherwise never reach the photocathodes 78. In short, such conventional head-on photomultiplier tubes have poor collection geometry, less than desirable collection efficiencies, and undesirably low signal-to-noise ratios. Additionally, where such systems are used with a single photomultiplier tube, coincidence counting is not possible.

The present invention, on the other hand, is concerned with providing photon detectors/electron multipliers having: i) the ability to detect and collect photon energy on a 360° surround basis so as to maximize collection efficiencies; ii) a unitary, continuous, cylindrical, transmission-type, photocathode uniformly spaced from, and in close proximity to, the axis of a detection chamber disposed coaxially within the cylindrical photocathode, thereby enhancing uniformity of signal collection and collection efficiencies; iii) an evacuated envelope for a photon detector/electron multiplier which is annular or generally toroidal in construction, thereby enabling use of envelope material(s) including a relatively thin-walled light-transmissive face which is resistant to implosion because of its relatively small size, its cylindrical shape, and its integral attachment at its upper and lower circular edges to respective ones of the top and bottom walls of the annular evacuated housing, and which also minimizes problems with absorption and spurious signals caused by either external or internal radiations; iv) a single, compact, annular photon detector/electron multiplier capable of detecting light photon energy from sources irrespective of whether they are disposed centrally within the detection chamber defined by the evacuated envelope's inner light-transmissive wall, or whether they are external to the detection chamber; v) a single compact photon detector/electron multiplier capable of coincidence counting procedures even when the light source of interest is external to the detection chamber; and vi), a compact photon detector/electron multiplier of the foregoing type occupying a volume of space which is only a fraction of the space utilized by conventional photomultiplier detection systems, thereby reducing the size and weight of lead shielding where external radiation is a concern.

Figure 13:
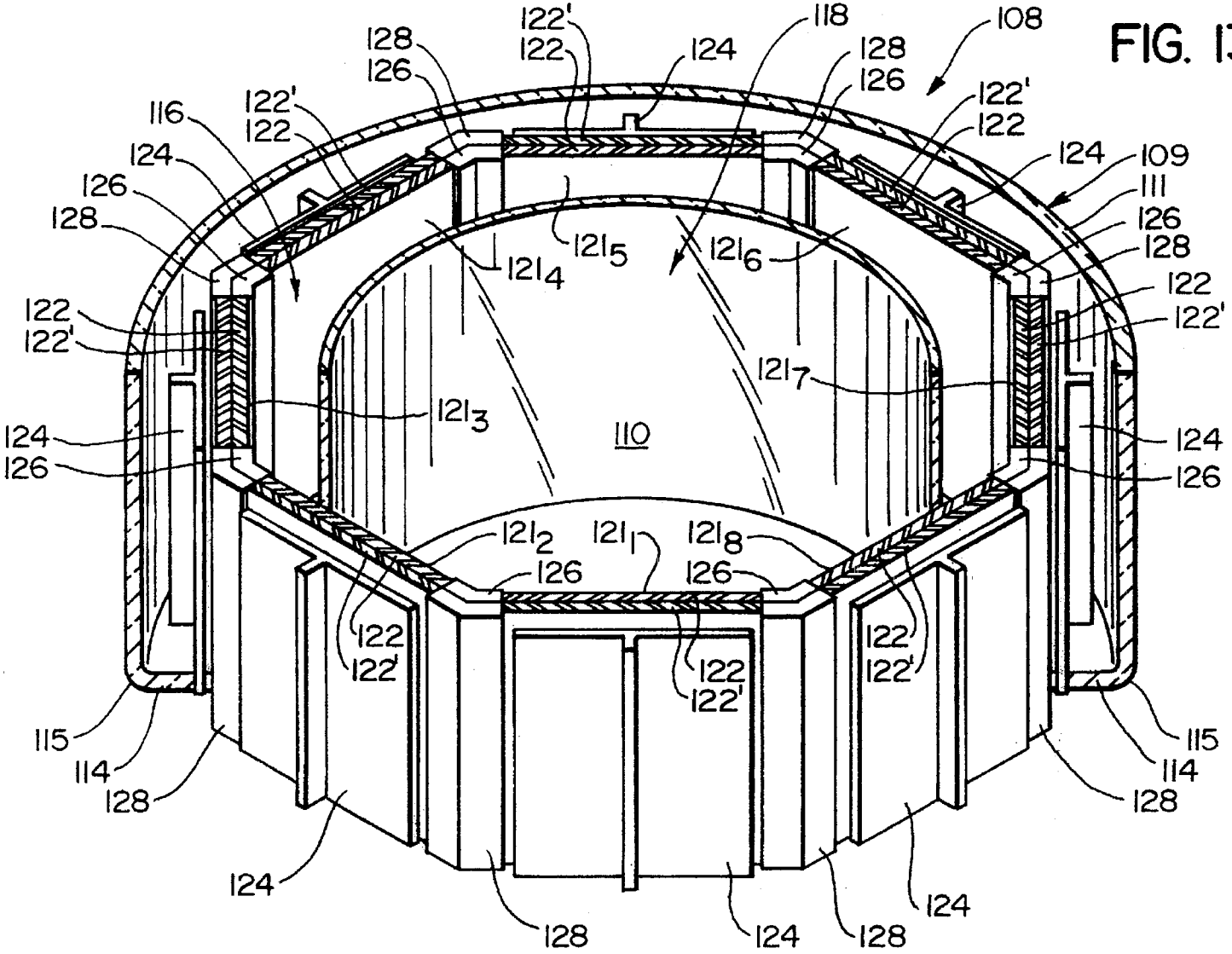
FIG. 13 is a fragmentary isometric drawing, partially in section, of a 360° surround photon detector/electron multiplier embodying features of the present invention, here depicting a portion of the annular evacuated glass envelope having: i) a photocathode material (not visible) deposited on the vacuum side of the inner wall thereof; ii) a plurality of microchannel plates disposed in an octagonal array with adjacent microchannel plates being supported by insulating spacers having conductive paths for permitting coupling of the front, intermediate, and rear faces of the microchannel plates to increasingly higher voltage sources; and iii), a plurality of anodes.
Figure 14:
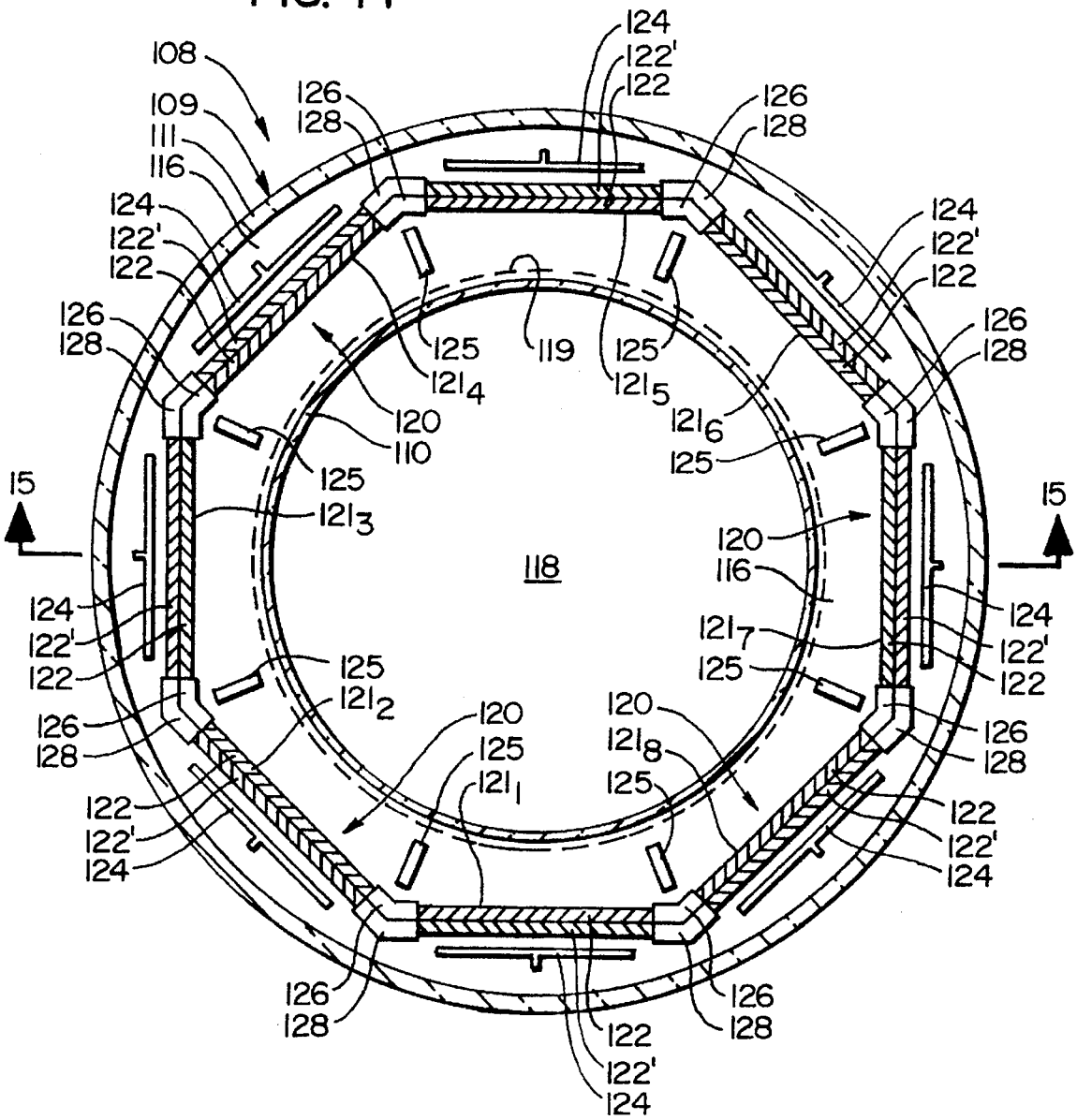
FIG. 14 is a diagrammatic plan view on a greatly enlarged scale—viz., three times (3×) actual size—of the exemplary 360° surround photon detector/electron multiplier shown in FIG. 13, here depicting the device employing a cylindrical photocathode deposited on the vacuum side of the inner annular wall of an annular photomultiplier tube envelope, with the annular evacuated chamber being subdivided into an even-numbered plurality of sections—here eight (8) sections—each subtending a substantially 45° arc on the cylindrical photocathode and each housing: i) an electron multiplier in the form of a pair of microchannel plate disks; ii) an anode; and iii), optionally, one or more focusing electrodes.
Figure 15:
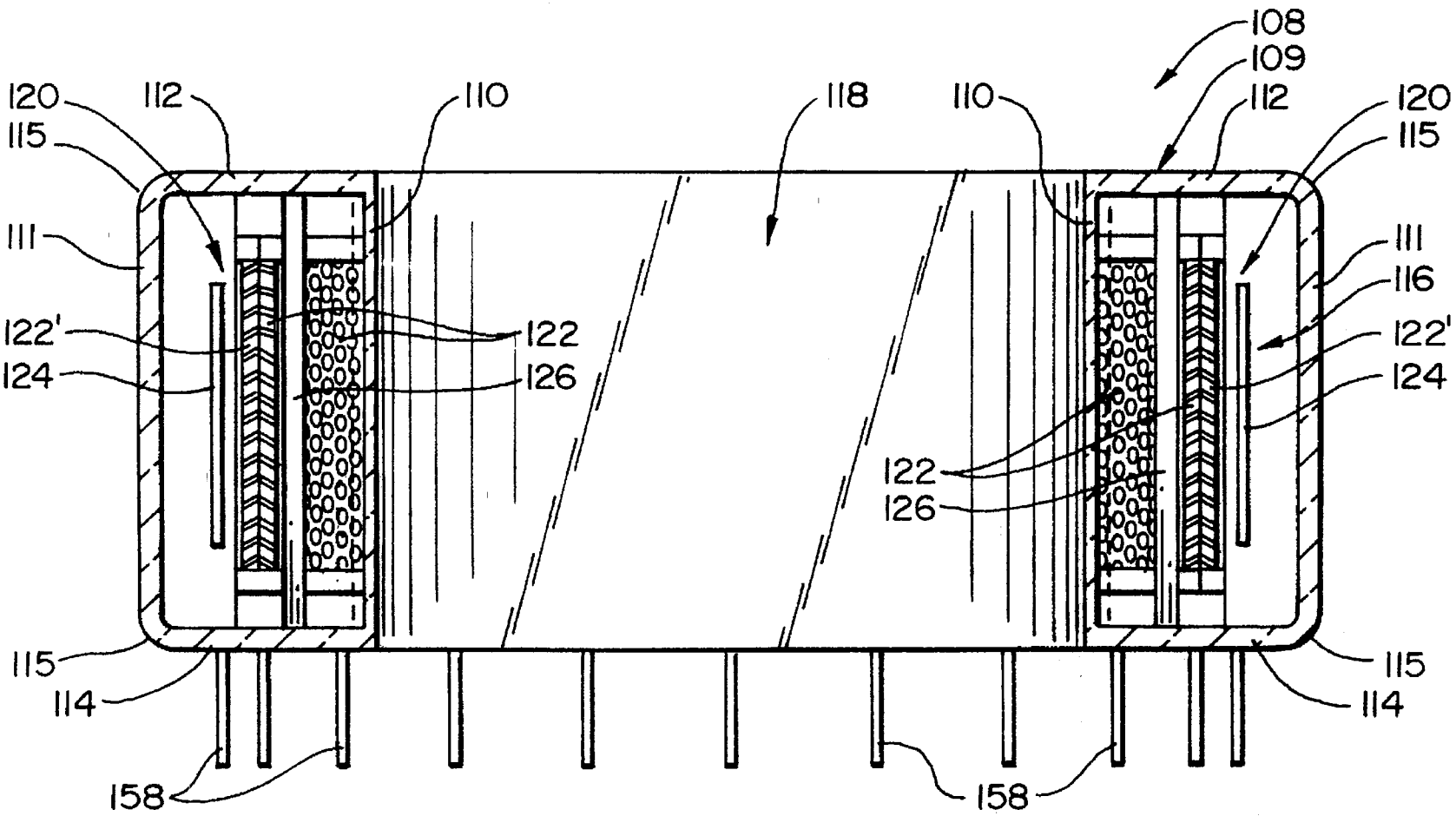
FIG. 15 is a highly diagrammatic sectional view—again three times (3×) the actual size of the device—taken substantially along the line 15—15 in FIG. 14, but with the optional focusing electrodes removed for purposes of clarity.

To this end, and as best illustrated in FIGS. 13 through 15 conjointly, and in accordance with the present invention, a photon detector/electron multiplier, generally indicated at 108, has been illustrated employing an annular evacuated envelope or housing, generally indicated at 109. As the ensuing description proceeds, those skilled in the art will appreciate that the particular cross-sectional configuration of the housing 109 is not critical to the present invention; but, excellent results are obtainable where the housing 109 has a rectilinear cross-section (best illustrated in FIG. 15) including an inner cylindrical wall 110 formed of relatively thin-walled glass, quartz, or other suitable light-transmissive material, an outer cylindrical wall 111, and flat washer-shaped top and bottom walls 112, 114, respectively, integrally coupled and sealed to the inner and outer cylindrical walls 110, 111 at their inner and outer peripheral edges defining slightly rounded corners 115 and, defining also, a totally enclosed, sealed, generally toroidal, annular or doughnut-shaped envelope space 116 of rectilinear cross-section within which the electron emitter—i.e., the photocathode—electron multipliers, collection anodes, focusing electrodes (if employed), and similar electronic components are housed and maintained in a vacuum. Of course, those skilled in the art will appreciate that the outer annular wall 111 and the top and bottom walls 112, 114 of the housing 109 need not be either light-transmissive or thin-walled; and, can be made of relatively thick glass or quartz, ceramic material, or any other suitable implosion-resistant non-conductive material.

Such an arrangement provides an internal detection chamber, generally indicated at 118 in FIGS. 13 through 16, which is coaxial with, and disposed internally of, the annular envelope's inner annular wall 110—i.e., the detection chamber 118 is external of the annular evacuated space 116 or annulus defined by the envelope 109 but disposed coaxially within the central vertical through bore defined by the envelope's annular inner wall 110.

In keeping with this aspect of the present invention, the various structural electronic components of the photon detector/electron multiplier 108—i.e., the photocathode; electron multipliers; anodes; and, optionally, one or more focusing electrodes—are housed within the annular evacuated space 116 enclosed within the photon detector/electron multiplier's annular evacuated envelope or housing 109. More specifically, the envelope or housing 109 contains: i) a unitary, single, continuous, cylindrical photocathode 119 deposited on, or positioned adjacent, the vacuum side of the housing's inner annular wall 110 (not visible in FIG. 13, but illustrated diagrammatically by the broken line 119 shown in FIGS. 14, 15 and 16); ii) electron multiplier structure, generally indicated at 120 in FIGS. 13 through 16B, comprising an exemplary octagonal array of electron multipliers $\mathbf{121}_1$ through $\mathbf{121}_8$ each comprising a pair of tandem MCP elements 122, 122' in the exemplary arrangement; iii) a plurality-here eight (8)—of anodes 124; and iv), optionally, a corresponding plurality of eight (8) focusing electrodes 125.

As most clearly shown in FIG. 13, it will be observed that the MCP elements 122, 122' comprising the exemplary electron multiplier structure 120 are of square or rectilinear shape as contrasted with the conventional disk-shaped structure 91 depicted in FIG. 9; but, as the ensuing description proceeds, those skilled in the art will appreciate that MCPs having disk-shaped configurations, square or rectilinear configurations, or virtually any other rectilinear or curvilinear shape, are all suitable for use with the present invention.

In order to support the tandem MCPs 122, 122', while at the same time providing: i) isolation between adjacent ones of the electron multipliers $\mathbf{121}_1$ through $\mathbf{121}_8$; and ii), conductive paths for the supply of high voltage thereto, the discrete electron multipliers $\mathbf{121}_1$ through $\mathbf{121}_8$, each comprising tandem MCPs 122, 122', are mounted on, and spaced apart by, insulating supports formed of glass, ceramic or other suitable insulating material—there being an inner insulating support 126 and an outer insulating support 128 between each adjacent pair of tandem MCP elements 122, 122'. Although not shown in detail in FIGS. 13 through 15 (but shown diagrammatically in FIGS. 16A and 16B), it will be appreciated by those skilled in the art that the inwardly presented face on each inner insulating support 126 is provided with one or more conductive paths formed or deposited thereon for conducting a first relatively low voltage level—e.g., +200 V—to the upstream face of the associated upstream microchannel plate 122 in each tandem pair. Similarly, one or more conductive paths is(are) formed or deposited on the outer surface of each outer insulating support 128 for conducting a relatively high voltage level—e.g., +1200 V—to the downstream face of the associated downstream MCP 122' in each tandem pair. Finally, and only if the particular tandem pair so requires, the interface between each pair of inner and outer insulating supports 126, 128 is provided with a conductive path for delivering an intermediate high voltage level—e.g., +700 V—to the downstream face of the upstream MCP 122 and the upstream face of the downstream MCP 122'

Figure 16A:
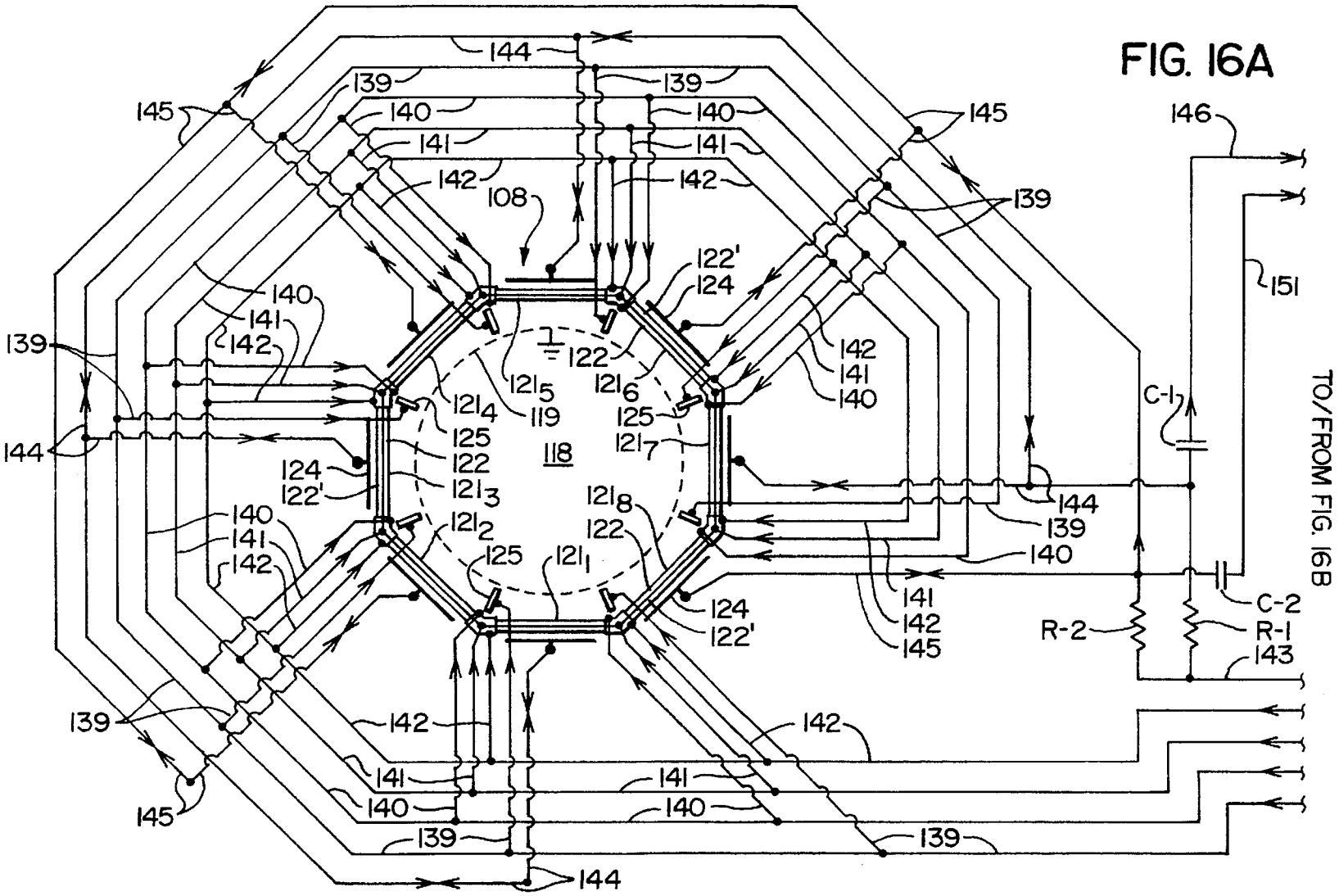
FIGS. 16A and 16B, when placed in side-by-side relation and viewed conjointly, comprise is a highly diagrammatic block-and-line drawing here depicting the electronic components of the exemplary photon detector/electron multiplier of the present invention as shown in FIGS. 13, 14 and 15, but with the annular envelope defining the outer casing of the vacuum tube removed for purposes of clarity, and depicting also the electrical inputs and outputs to and from the device, together with an exemplary system or utilization device shown in block-and-line form for processing signals output therefrom.
Figure 16B:
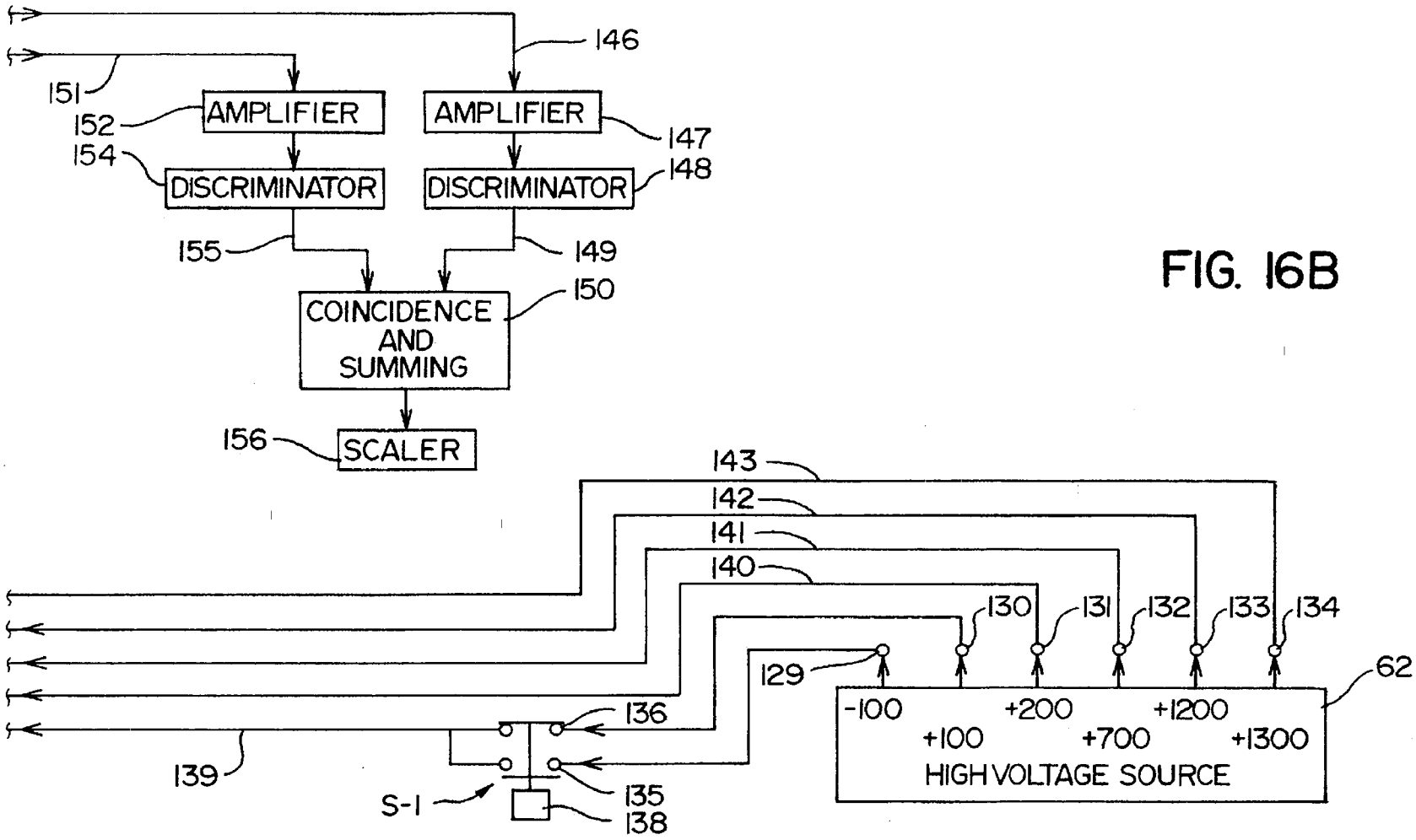

Referring next to FIGS. 16A and 16B, the inputs to, and outputs from, an exemplary photon detector/electron multiplier 108 embodying features of the present invention have been depicted in block-and-line diagrammatic circuit form. Thus, as here shown, an exemplary high voltage source 62 is provided having a plurality of output terminals 129 through 134 respectively providing output voltages of −100 V, +100 V, +200 V, +700 V (if required), +1200 V, and +1300 V. However, and as previously indicated, those skilled in the art will appreciate that the particular voltage levels depicted and hereinbelow described have been set forth merely for purposes of facilitating an explanation and understanding of the operation of the present invention; and, such voltage levels are not to be deemed limiting in any way.

With the foregoing in mind, terminals 129 and 130 of the high voltage source 62, which are respectively maintained at −100 V and +100 V, are coupled to respective ones of terminals 135, 136 of a suitable switch, generally indicated at S-1, actuated by any suitable and completely conventional switch controller 138 which may be manually actuated, pneumatically actuated, electrically actuated, or electromechanically actuated using a suitable solenoid (not shown) or the like. Dependent upon the position of the switch S-1, which is here shown with the terminals 136 in the closed position and terminals 135 in the open position, an exemplary and selected voltage level of either −100 V or +100 V will be delivered to each of the focusing electrodes 125 via line 139 (the different operating characteristics of the focusing electrodes 125 dependent upon whether maintained at −100 V or at +100 V will be described in greater detail below).

Terminal 131 of the high voltage source 62 (which is maintained at +200 V) is, in the exemplary and diagrammatic circuitry shown in FIGS. 16A and 16B, coupled via line 140 to one or more conductive surface(s) or path(s) (not shown in detail) formed on the innermost or upstream surface of each of the inner insulating support elements 126 so as to couple the innermost or upstream face of each MCP element 122 to +200 V; terminal 132 of the high voltage source 62 (which is maintained at +700 V) is coupled via line 141, if required, to one or more conductive surface(s) or path(s) formed at the interface of the inner and outer insulating support elements 126, 128 so as to couple the downstream face of each upstream MCP 122 and the upstream face of each downstream MCP 122' to +700 V; and, terminal 133 of the high voltage source 62 (which is maintained at +1200 V) is coupled via line 142 to one or more conductive surface(s) or path(s) formed on the downstream face of each of the downstream MCP elements 122' so as to couple the downstream face of each MCP element 122' to +1200 V. Finally, terminal 134 of the high voltage source 62 (which is maintained at +1300 V) is coupled via line 143, resistor R-1, and line 144 to each of the anodes 124 associated with the odd-numbered electron multipliers $\mathbf{121}_1$, $\mathbf{121}_3$, $\mathbf{121}_5$ and $\mathbf{121}_7$ so as to maintain the anodes associated with the odd-numbered electron multipliers at an exemplary voltage level of +1300 V. Similarly, terminal 134 of the high voltage source 62 is also coupled via line 143, resistor R-2, and line 145 to each of the anodes 124 associated with the even-numbered electron multipliers $\mathbf{121}_2$, $\mathbf{121}_4$, $\mathbf{121}_6$ and $\mathbf{121}_8$ so as to maintain the anodes associated with the even-numbered electron multipliers at an exemplary voltage level of +1300 V.

Thus, it will be seen that with: i) the cylindrical photocathode 119 coupled to ground; ii) the focusing electrodes 125 coupled to either −100 V or +100 V; iii) the tandem MCP elements 122, 122' having their upstream face 94, their intermediate faces 95, 94', and their downstream face 95' respectively coupled to +200 V, +700 V (if required) and +1200 V; and iv), all of the anodes coupled to +1300 V, each successive downstream electron emitting structural element is maintained at a progressively higher voltage level, thereby creating one or more electric fields which serve to attract and accelerate electrons emitted by the photocathode 119 towards and through the electron multipliers 120, with the multiplicity of secondary electrons produced at the final output stage disposed adjacent the downstream face of each MCP element 122' being collected at the anodes 124 which are maintained at a still higher voltage level.

In the exemplary circuit depicted in FIGS. 16A and 16B, the output voltage pulses appearing at the anodes 124 associated with the alternate odd-numbered electron multipliers $\mathbf{121}_1$, $\mathbf{121}_3$, $\mathbf{121}_5$ and $\mathbf{121}_7$ are connected in series by line 144; and, therefore, the output pulses therefrom are summed and conveyed via line 146 and capacitor C-1 to an amplifier 147, and thence to a discriminator 148 which provides a first input 149 to a conventional coincidence and summing circuit 150. Similarly, the output voltage pulses appearing at the anodes 124 associated with the alternate even-numbered electron multipliers $\mathbf{121}_2$, $\mathbf{121}_4$, $\mathbf{121}_6$ and $\mathbf{121}_8$ are connected in series by line 145; and, therefore, the output pulses therefrom are summed and conveyed via line 151 and capacitor C-2 to an amplifier 152, and thence to a discriminator 154 which provides a second input 155 to the coincidence and summing circuit 150. The first and second inputs 149, 155 to the coincidence and summing circuit 150 are then compared to determine whether time-coincident signals are present; and, when time-coincident signals are detected, they are summed and passed to any suitable display device 156 such, for example, as an oscilloscope, printer or other utilization device (not shown).

Of course, those skilled in the art will appreciate that while the use of an even number of electron multipliers—e.g., two (2), four (4), six (6), eight (8), etc. electron multipliers $\mathbf{121}_1$, $\mathbf{121}_2$, . . . $\mathbf{121}_n$ (where "n" is any even whole integer)—is highly advantageous in those instances where coincidence counting is desirable, it is not a prerequisite for coincidence counting. Rather, it is also possible to employ conventional coincidence counting with an odd number of electron multipliers. Thus, and merely by way of example, where seven (7) electron multipliers $\mathbf{121}_1$ . . . $\mathbf{121}_7$ are employed, one might sum the outputs from the four (4) odd-numbered electron multipliers $\mathbf{121}_1$, $\mathbf{121}_3$, $\mathbf{121}_5$, $\mathbf{121}_7$ and provide that summed output as a first input signal to the coincidence and summing circuit 150, while also summing the outputs from the three (3) even-numbered electron multipliers $\mathbf{121}_2$, $\mathbf{121}_4$, $\mathbf{121}_6$ and providing that summed output as a second input signal to the coincidence and summing circuit 150. In short, it is the fact that the first and second summed signals input to the coincidence and summing circuit 150 are time-coincident that is significant and results in an output from the coincidence and summing circuit 150; and, the mere fact that the magnitude of the two time-coincident signals may vary is irrelevant.

Indeed, those skilled in the art will appreciate that the technique of coincidence counting has invariably involved the comparison of output signals from one electron multiplier with those output from a second electron multiplier viewing the same sample to determine the presence or absence of time-coincident signals from both. Consequently, with the present invention which employs: i) a common cylindrical photocathode 119 surrounding a central detection chamber 118; and ii), multiple circumferentially arrayed electron multipliers 120, each subtending discrete adjacent arcs on the photocathode, the technique of coincidence counting, in its broader aspects, does not require that the summed output signals from one set of alternate electron multipliers be compared with the summed output signals from a second set of intervening electron multipliers, but, rather, merely that a comparison be made of the output(s) from any one or more of the electron multipliers with respect to the output(s) from any one or more other electron multipliers.

For example, rather than comparing the summed output from odd-numbered electron multipliers $121_1$, $121_3$ . . . etc. with the summed output from the even-numbered electron multipliers $121_2$, $121_4$ . . . etc., it would be possible to compare the output(s) from any one electron multiplier or any group of electron multipliers with the output from the remaining electron multiplier(s)—for example: i) the summed output from electron multipliers $121_1$–$121_4$ can be compared with the summed output from electron multipliers $121_5$–$121_8$; ii) the summed output from electron multipliers $121_1$ and $121_2$ can be compared with the summed output from electron multipliers $121_3$–$121_8$; iii) the output from any one electron multiplier can be compared with the summed output from all remaining electron multipliers; etc. In each case, the presence of time-coincident signals from two different sources-regardless of the number of electron multipliers in each source-is, most probably, indicative of the presence of a signal of interest rather than merely a spurious signal; whereas, the absence of time-coincident signals from two sources—again, regardless of the number of electron multipliers in each source—may be indicative of the presence of a spurious unwanted signal.

Referring to FIG. 15, it will be noted that the exemplary photon detector/electron multiplier 108 of the present invention is provided with a plurality of axially extending plug-in type connector pins 158 which are completely conventional in construction and function. Thus, such pins 158 serve as connectors enabling coupling of the output terminals 129 through 134 of the high voltage source 62 (FIGS. 16A and 16B) to respective ones of the: i) photocathode 119 (where it is to be maintained at other than ground); ii) focusing electrodes 125 (if and where employed); iii) MCPs 122, 122'; and iv), anodes 124. Similarly, such plug-in connector pins 158 enable coupling of the anodes 124, or similar signal output terminals, to respective ones of lines 146, 151 for enabling delivery of the summed voltage pulses from respective ones of: i) the odd-numbered electron multipliers $121_1$, $121_3$, $121_5$ and $121_7$; and ii), the even-numbered electron multipliers $121_2$, $121_4$, $121_6$ and $121_8$, to respective ones of their associated amplifiers 147, 152, discriminators 148, 154, and the coincidence and summing circuit 150.

Of course, it will be understood by persons skilled in the art of photomultiplier design that where coincidence counting is to be employed, it will generally be desirable to connect only certain of the electron multipliers (for example, but not by way of limitation, the odd-numbered electron multipliers $121_1$, $121_3$, $121_5$ and $121_7$) together in series, while the remaining electron multipliers (for example, and again not by way of limitation, the even-numbered electron multipliers $121_2$, $121_4$, $121_6$ and $121_8$) are similarly connected together in series. Such series connections may be made either internally or externally of the evacuated envelope or housing 109 (not shown in FIGS. 16A and 16B, but visible in FIGS. 13 through 15). In the former case where the series connections are made internally of the envelope 109, only two (2) connector pins 158 (FIG. 15) will be required to output the voltage pulses accumulated on the anodes 124 irrespective of whether eight (8) or any other number of anodes 124 are present and irrespective of which, and how many, of the electron multipliers are coupled together in each discrete group. However, in the latter case where the series connections—if coincidence counting is to be employed—are made externally of the envelope 109, as well as for any other applications requiring multiple anode outputs, one (1) connector pin 158 will be required for each anode output. In either case, however, the system is capable of coincidence counting. Moreover, it is also within the scope of the present invention to mount the coincidence and summing circuit 150 and related electronic components shown in FIGS. 16A and 16B within a portion of the evacuated envelope or housing 109 (not shown in FIGS. 16A and 16B) so that coincidence counting is conducted internally of the envelope, in which event only one (1) connector pin 158 will be required to output the voltage pulses from the coincidence summing circuit 150.

The purpose of selectively connecting either a −100 V or a +100 V voltage level to the focusing electrodes 125 in the exemplary circuit hereinabove described in connection with FIGS. 16A and 16B will now be explained with particular reference to FIGS. 14 and 16A–16B conjointly. Thus, considering, for example, the focusing electrodes 125 disposed in front and on either side of the electron multiplier $121_1$ (the electron multiplier at the 6:00 position as viewed in FIGS. 14 and 16A–16B), it will be appreciated that such focusing electrodes 125, together with the electron multiplier $121_1$, subtend an arc of approximately 45° on the cylindrical photocathode 119, with the immediately adjacent even-numbered electron multipliers $121_2$ and $121_8$ subtending immediately adjacent arcs of approximately 45° on either side of the approximately 45° degree arc subtended by electron multiplier $121_1$.

Consequently, when photons impinge upon the photocathode 119 in the arcuate region subtended by electron multiplier $121_1$ and are absorbed thereby, primary electrons are emitted which, for the most part, will be attracted to, and accelerated towards, the higher voltage input face of the upstream MCP 122 in electron multiplier $121_1$ which is maintained at +200 V in the diagrammatic example here being considered. Assuming that the focusing electrodes 125 are maintained at −100 V, the primary electrons emitted from that arcuate region of the photocathode 119 subtended by the electron multiplier $121_1$ and which are directed towards either of the adjacent even-numbered electron multipliers $121_2$ or $121_8$ will be repelled by the focusing electrodes 125 and, therefore, they will be funneled or channeled in the desired direction towards the MCP 122 in the associated electron multiplier $121_1$.

If, on the other hand, the focusing electrodes 125 are maintained at +100 V—a voltage level higher than the photocathode 119 which is coupled to ground in this exemplary circuit—the primary electrons emitted from the arcuate region of the photocathode 119 facing electron multiplier $121_1$ which happen to be directed towards one or both of the adjacent even-numbered electron multipliers $121_2$ and/or $121_8$ will first be attracted to, and accelerated towards, the focusing electrodes 125 which are at a higher voltage level than the photocathode 119 and which are closer to the subtended 45° arc on the photocathode 119 from which the primary electrons were emitted than are either of the adjacent even-numbered electron multipliers $121_2$ and/or $121_8$. Assuming that the focusing electrodes 125 are coated with a suitable electron-emissive material of the type commonly used for conventional dynodes, impingement of such primary electrons against the focusing electrodes 125 will cause emission of multiple secondary electrons which will be directed back towards the electron multiplier $121_1$ where they will be attracted and accelerated by the voltage level of +200 V on the upstream face of the MCP 122 which is greater than the +100 V level at the focusing electrodes 125. In short, the focusing electrodes 125 will, under these conditions, function as first stage dynodes and actively contribute to the electron multiplication process.

It will be evident from the foregoing description that each of the eight (8) illustrative electron multipliers $121_1$ through $121_8$, their associated anodes 124, the focusing electrodes 125 disposed at either side thereof (where used), and the facing subtended 45° arcs on the photocathode 119, effectively serve to electrically subdivide the photon detector/electron multiplier 108 into eight (8) adjacent arcuate sections which are preferably, but not necessarily, of substantially equal size and which are each coupled to, and derive primary electrons from, respective ones of a plurality of eight (8) adjacent subtended substantially 45° arcs on, and which together define, a single, continuous, unitary, cylindrical photocathode 119 which totally surrounds, is in close proximity to, and is uniformly spaced from, the vertical axis passing through the central coaxial detection chamber 118. As a result, the exemplary photon detector/electron multiplier 108 depicted in FIGS. 13 through 16B comprises a unitary structure employing a single annular evacuated envelope or housing 109 and a single, continuous, unitary, cylindrical photocathode 119 with eight (8) electron multiplier/anode combinations 120/124 each subtending a separate, discrete, but adjacent, 45° arcuate region on a common continuous cylindrical photocathode 119.

In short, the photon detector/electron multiplier 108 of the present invention as depicted in FIGS. 13 through 16B effectively comprises a multi-section electron multiplication device having adjacent arcuate sections within a common evacuated housing 109 utilizing adjacent arcuate portions of a common cylindrical photocathode 119. Since a single common cylindrical photocathode 119 is employed, photons emitted from the detection chamber 118 having a lateral component of motion will, necessarily, move towards the photocathode 119 and may be absorbed by the photocathode to the extent of the inherent photocathode efficiency, with the absorbed photon energy causing emission of primary electrons from the photocathode 119 irrespective of the direction in which the photons move laterally.

Having in mind the foregoing description, and considering that MCPs such as indicated at 122 and 122' in FIGS. 13 through 16B are each only about 0.5 mm to about 1.0 mm in thickness, it will be appreciated that: i) the adjacent arcuate segments of the cylindrical photocathode 119; ii) the focusing electrodes 125 (if used); iii) the electron multipliers 120—whether employing a single MCP element 122, two (2) tandem MCP elements 122, 122', or three (3) or more tandem MCP elements (not shown); and, having an aggregate thickness of only from about 0.5 mm to about 1.0 mm (for one MCP element 122), about 1.0 mm to about 2.0 mm (for two tandem MCP elements 122, 122'), or even three (3) or more tandem MCP elements (not shown) ranging in thickness from about 1.5 mm to about 3.0 mm or somewhat more—and iv), the anodes 124, can all be housed in an extremely compact annular space 116 within a single, unitary, small, compact, evacuated housing 109.

For example, it has been determined that a typical photon detector/electron multiplier 108 of the exemplary type shown in FIGS. 13 through 16B can be manufactured having: i) an external diameter—i.e., the O.D. of the outside annular wall 111—of only about 50 mm (5 cm) or, slightly less than 2 in.; ii) an internal diameter—i.e., the I.D. of the light-transmissive inner annular wall 110—of only about 30 mm (3 cm); and iii), a height of only about 20 mm (2 cm), thus defining a central coaxial detection chamber 118 which is about 30 mm (3 cm) in diameter and about 20 mm (2 cm) in height. As a consequence, the radial dimension of the annular space 116 between the inner and outer annular walls 110, 111 of the exemplary photon detector/electron multiplier 108—i.e., the space within which the photocathode 119, focusing electrodes 125 (where employed), electron multipliers 120, and anodes 124 are housed—is only 10 mm or, stated differently, only ten percent (10%) of the length of one of the shorter conventional head-on photomultipliers 52(54) depicted in FIGS. 1 through 8 which each range from about 100 mm to about 200 mm in length.

Yet, notwithstanding the foregoing, the overall exemplary unitary photon detector/electron multiplier 108 depicted in FIGS. 13 through 16B effectively comprises a multi-section photomultiplier tube providing 360° surround photon collection capability with attendant improved uniformity and efficiency of photon collection due to the fact that all points on the cylindrical photocathode 119 are equidistant from, and in closely spaced proximity to, the axis of the central coaxial detection chamber 118.

Of course, while those persons skilled in the art will appreciate from the foregoing description that the compact relatively small size of the exemplary photon detector/electron multiplier 108 depicted in FIGS. 13 through 16B can be highly advantageous in many applications, nevertheless, it is not a limiting factor in determining the scope of the present invention as expressed in the appended claims. To the contrary, in some applications it may be desirable to significantly upsize the photon detector/electron multiplier 108 of the present invention so as to accommodate relatively large samples or light-emitting specimens and/or other relatively large light sources. For example, the dimensions of the photon detector/electron multiplier 108 may be increased so as to define a central coaxial detection chamber 118 whose diameter is measured in inches, yet which still employs a single cylindrical photocathode 119 and a common annular or generally toroidal evacuated housing 109 with all of the attendant benefits and advantages appertaining thereto which have previously been described.

Those skilled in the art will further appreciate that numerous modifications can be made to the exemplary photon detector/electron multiplier 108 depicted in FIGS. 13 through 16 without departing from the spirit and scope of the invention as expressed in the appended claims. Thus, merely by way of example and not by way of limitation, it will be understood that the focusing electrodes 125 are not essential to the present invention and can be eliminated where desirable. If such focusing electrodes 125 are not employed, there exists the possibility that primary electrons emitted from a given subtended arcuate segment on the cylindrical photocathode 119 may be directed at angles towards adjacent ones of the electron multipliers $121_1$ through $121_8$ rather than towards the particular electron multiplier with which that particular subtended arc of the photocathode 119 is associated; but, such a possibility will be compensated for by the fact that primary electrons which are emitted from any given arcuate segment of the cylindrical photocathode at angles directed towards adjacent electron multipliers will, on average, be replaced by primary electrons emitted from the adjacent arcuate segment of the cylindrical photocathode which are directed back towards the particular electron multiplier facing the cylindrical photocathode's arcuate segment of interest.

Moreover, it will be understood by those skilled in the art that there is nothing critical in the use of an octagonal array of eight (8) radially oriented electron multipliers $121_1$ through $121_8$; and, where desirable, fewer or more than eight (8) electron multiplier structures 120 can be employed. For example, in its broader aspects, the present invention contemplates the use of two, three, four, five, six, seven, eight . . . sixteen, or more, electron multiplier structures 120 provided only that they are disposed within a unitary annular evacuated envelope or housing 109; that they subtend adjacent arcs (which are preferably, but not necessarily, of substantially equal size) on a single, unitary, continuous, cylindrical photocathode 119; and, that they are cost effective. The exemplary embodiment of the invention depicted in FIGS. 13 through 16B has been described in connection with use of eight (8) electrically discrete arcuate sections in a housing 109 employing eight (8) electron multiplier/anode combinations 120/124 simply because the geometry of a central detection chamber 118 approximately 30 mm in diameter readily lends itself to use of MCP elements 122 which are approximately 13 mm square—i.e., MCP elements 122 having an effective area of approximately 169 $mm^2$—thus enabling use of eight (8) such planar MCP elements 122 in an octagonal array which is spaced radially outward of, but remains closely spaced from, the cylindrical photocathode 119.

Moreover, persons skilled in the art will appreciate that it is not necessary to employ two (2) tandem MCP elements 122, 122'; but, rather, if the incident light being detected is sufficiently strong, a single MCP element 122 may suffice or, alternatively, where the incident light is relatively weak, one might employ more MCP elements in a tandem array; and, given the fact that each MCP element 122 is relatively thin—e.g., from only about 0.5 mm to about 1.0 mm in thickness—the use of more MCP elements 122 will not significantly increase the amount of space required between the inner and outer annular walls 110, 111 of the evacuated envelope or housing 109.

It is to be further kept in mind that a single MCP element 122 requires only two (2) voltage inputs; two (2) tandem MCP elements 122, 122' require not more than three (3) voltage inputs; three (3) tandem MCP elements (not shown) require not more than four (4) voltage inputs; etc.; whereas, conventional electron multiplier dynode chains of the types depicted in FIGS. 5 through 8 will commonly require anywhere from up to ten (10) to as many as sixteen (16) or more voltage inputs. Consequently, the electrical input requirements for a photon detector/electron multiplier 108 employing MCP-type electron multipliers such as those depicted at 122, 122' in FIGS. 13 through 16B are considerably simpler and less complex than would be required for a comparable number of separate, discrete, conventional electron multipliers such as those shown at **80*a* through 80*d* in respective ones of FIGS. 5 through 8 and of the type commonly employed in conventional head-on photomultiplier tubes 52(54)**.

It will also be understood by those skilled in the art that while rectilinear MCPs 122, 122' of the type shown in FIGS. 13 through 16B are particularly advantageous since the subtended arc of a cylindrical photocathode 119, when viewed side-on in elevation, provides a correspondingly sized rectilinear aspect, nevertheless, the MCPs 122, 122' can be circular or, for that matter, virtually any other shape including planar and curvilinear. Thus, when using, for example, one or more conventional circular disk-shaped MCPs such as indicated at 91, 91' in FIGS. 9, 11 and 12 in combination with a cylindrical photocathode 119 whose subtended arc provides a side-on elevational aspect which is rectilinear, it would be desirable, although not essential, to use any suitable focusing electrode structure which serves to ensure that primary electrons emitted from the arcuate segment of the cylindrical photocathode 119 and which would otherwise be directed away from the circular MCP disk(s) 91, 91', are redirected, either: i) through repulsion from the focusing electrodes; or ii), through attraction to, and emission of secondary electrons from, the focusing electrodes, with the repelled primary electrons or the emitted secondary electrons proceeding in the desired direction towards the circular disk(s) 91, 91' with which that particular arcuate segment of the cylindrical photocathode 119 is associated.

Indeed, it would even be possible to use an apertured plate—i.e., a plate formed of glass, quartz, ceramic material, or the like and having accelerating electrodes formed on its front and rear faces (not shown)—as a channel multiplier wherein the apertured plate includes a rectilinear opening on its upstream or front face which is adjacent the cylindrical photocathode 119 and wherein the wall of the apertured plate defining the hole extending therethrough is coated with an electron-emissive material and transitions to a circular outlet on the downstream face of the plate closest to the circular or disk-shaped MCP 91. A somewhat similar structure comprising a funnel-type channel multiplier is disclosed in FIG. 2 of the aforesaid Schmidt et al U.S. Pat. No. 5,097,173.

And, of course, since MCPs such as those indicated at 91, 91' in FIGS. 9 through 12 and at 122, 122' in FIGS. 13 through 16B are not the only conventional electron multipliers characterized by their compactness—see, e.g.: i) the apertured plate configurations disclosed in the aforesaid Eschard U.S. Pat. Nos. 4,649,314 and 4,806,827, and in the Boutot et al U.S. Pat. No. 5,043,628; ii) mesh-type dynode configurations of the type depicted in FIG. 8; iii) hybrid photodiode structures of the type previously mentioned and hereinafter described in greater detail; iv) circular cage-type dynode structures of the type more conventionally used with side-on photomultiplier tubes and hereinafter described in greater detail; and v), even venetian blind dynode structures of the type depicted in FIG. 7—it will be understood that the invention in its broader aspects is not limited to an annular photon detector/electron multiplier 108 containing one or more MCPs such as depicted in FIGS. 13 through 16B.

Indeed, it will be understood by those skilled in the art that even the more conventional electron multipliers using relatively long dynode chains such as depicted in FIG. 5 (a box-and-grid structure) and FIG. 6 (a linear-focused structure) can be employed, although some increase in the external diameter of the evacuated envelope or housing 109 may be required to accommodate such longer electron multipliers, particularly where they employ ten (10) or more dynode stages. However, such conventional electron multipliers can be shortened by using fewer than ten (10) dynode stages—particularly where, as here, the signal-to-noise ratio has been significantly enhanced because of: i) improved photon collection geometry and efficiencies; and ii), reduced noise as a result of use of relatively thin-walled light-transmissive material for formation of the cylindrical inner wall 110 of the evacuated envelope 109. In any event, such longer conventional dynode stages are useable with the present invention even though some sacrifice is made in terms of compactness, while still obtaining the benefit of the other advantages of the invention hereinabove described such, for example, as: i) a 360° surround photocathode 119 equidistant at all points from, and in close proximity to, the axis of the detection chamber 118; ii) an annular evacuated envelope or housing 109 having its inner annular wall 110 made of thin-walled light-transmissive material; and iii), the ability to use coincidence counting even in instances where only a single photon detector/electron multiplier 108 embodying the present invention is employed.

Figure 17:
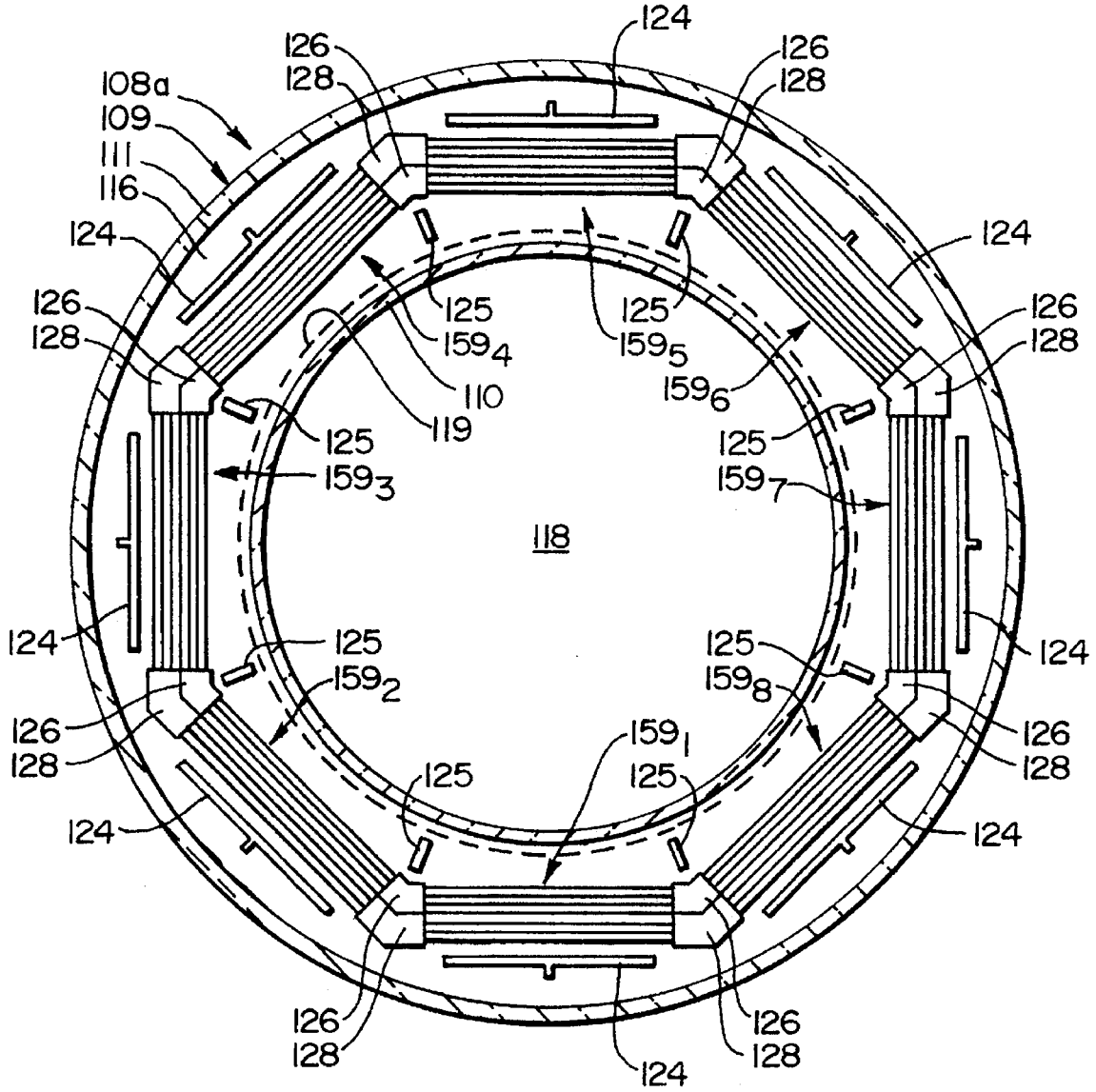
FIG. 17 is a diagrammatic plan view similar to FIG. 14, but here depicting a modified form of the invention employing mesh-type dynodes in lieu of microchannel plates.
Figure 18:
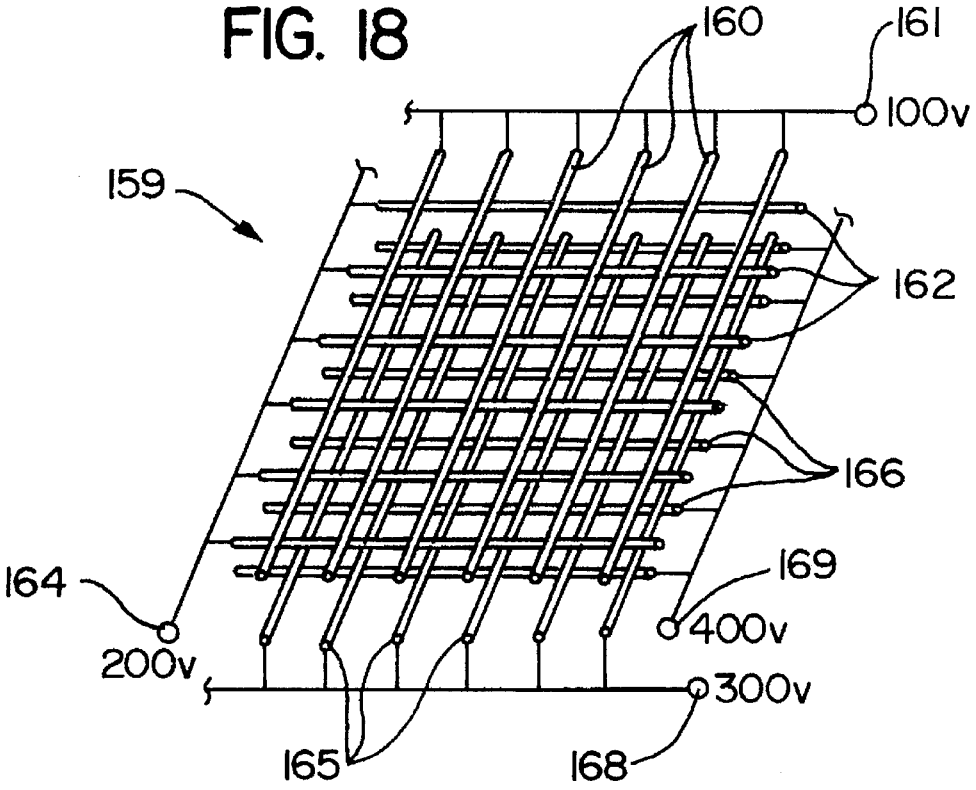
FIG. 18 is a fragmentary diagrammatic isometric view, on a greatly enlarged scale, here depicting a portion of a conventional coarse mesh-type dynode structure which might be used in the device depicted in FIG. 17.
Figure 19:
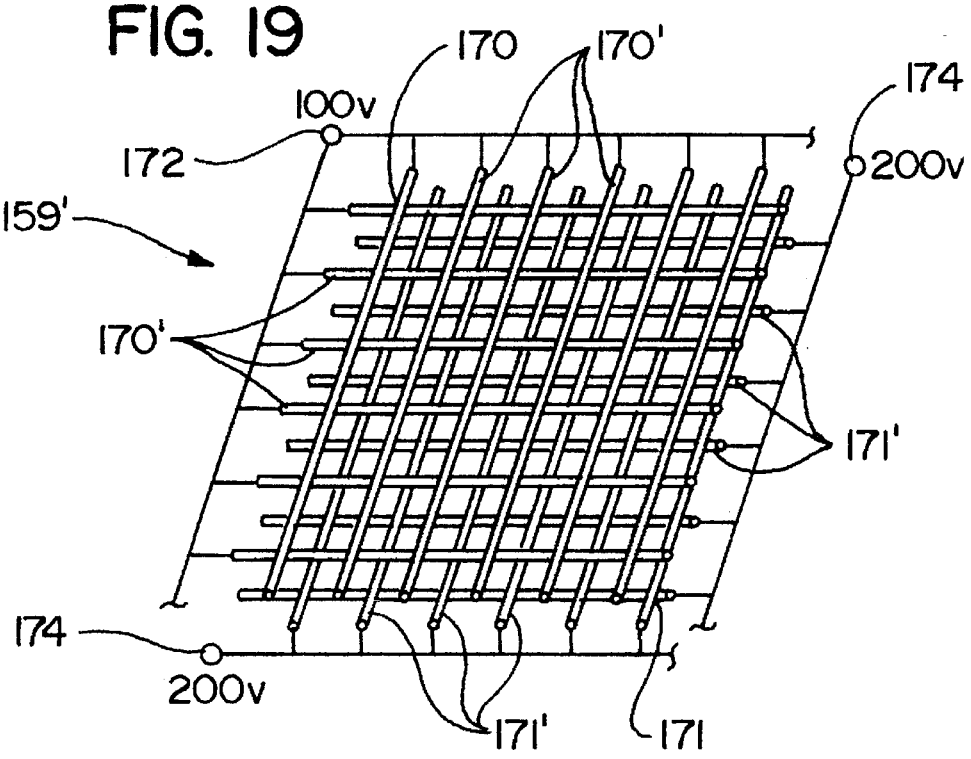
FIG. 19 is a fragmentary diagrammatic isometric view similar to FIG. 18, but here illustrating a portion of a slightly modified, but conventional, fine mesh-type dynode structure that might be employed in connection with the device depicted in FIG. 17.

2. 360° Surround Photon Detector/Electron Multiplier Employing Mesh-Type DArnode Stages—FIGS. 17–19

Referring next to FIG. 17, a slightly modified photon detector/electron multiplier 108*a* has been illustrated which here is substantially identical both structurally and functionally to the photon detector/electron multiplier 108 depicted in FIG. 14; except, that in this embodiment of the invention, the electron multipliers, indicated generally at $159_1$ through $159_8$, comprise mesh-type dynode structures such as shown in FIG. 8—i.e., dynode structures consisting of closely spaced, stacked, planar arrays of parallel electrodes or, alternatively, closely spaced, stacked arrays of a plurality of intersecting angularly related electrodes lying in a common plane. As previously indicated, such mesh-type dynode structures are characterized by their compactness, their high immunity to magnetic fields, and excellent linearity and uniformity. However, because the tandem MCP arrangement depicted at 122, 122' in FIGS. 13 through 16 is replaced in FIG. 17 with a plurality of such planar mesh-type dynode stages, each of which must be maintained at a progressively higher voltage level in order to attract and accelerate electrons emitted from each upstream stage towards the next succeeding downstream stage, the electrical circuit requirements in terms of voltage inputs for the mesh-type electron multipliers $159_1$ through $159_8$ depicted by way of example in FIG. 17 are somewhat more complex than in the embodiment of the invention depicted in FIGS. 13 through 16B.

Thus, referring, for example, to FIG. 18, a fragmentary portion of a typical coarse mesh-type electrode structure that might be used with the embodiment of the invention depicted in FIG. 17 has been illustrated. As here shown, the mesh-type electron multiplier, generally indicated at 159, comprises: i) a first planar array of parallel, spaced apart electrodes 160 coupled to an exemplary +100 V source 161 and comprising a first mesh-type dynode stage. Stacked immediately behind the first dynode stage is a second mesh-type dynode stage comprising a second planar array of parallel, spaced apart electrodes 162, spaced from and disposed at generally right angles to the first stage electrodes 160, with the electrodes 162 coupled to an exemplary +200 V source 164. Similarly, the fragmentary portion of the mesh-type dynode structure 159 depicted in FIG. 18 includes at least third and fourth dynode stages comprising planar arrays of parallel, spaced apart electrodes 165, 166, respectively, which are each disposed at generally right angles with respect to, and slightly spaced from, the preceding and succeeding dynode stages; and, which arrays 165, 166 are respectively coupled to exemplary +300 V and +400 V voltage sources 168, 169.

Those skilled in the art will, therefore, appreciate that a four-stage mesh-type dynode structure 159 such as shown in FIG. 18 will require four (4) separate voltage inputs; and, each additional stage—not shown in FIG. 18, but twelve (12) such stages are diagrammatically depicted in FIG. 17—will require an additional voltage input up to a total of twelve (12) voltage inputs for the electron multipliers $159_1$ through $159_8$ depicted in the exemplary embodiment of FIG. 17, as contrasted with not more than three (3) voltage inputs for the tandem MCP elements 122, 122' shown by way of example in FIGS. 13 through 16B.

Turning to FIG. 19, a fragmentary portion of a somewhat similar, but slightly modified, fine mesh-type dimode structure has been depicted generally at 159'. In this structure, each dynode stage 170, 171 illustrated—and only two (2) of multiple stages have been shown—comprises a plurality of electrodes (electrodes 170' in the first stage 170 and electrodes 171' in the second stage 171) with the electrodes in each stage being disposed in a planar arrangement of intersecting angularly related—right angularly related in the exemplary arrangement depicted in FIG. 19—electrodes, and with the electrodes in each successive stage being offset with respect to the electrodes in each previous and succeeding stage. Again, all of the electrodes 170' in the first stage 170 are coupled to an exemplary +100 V source 172; while all of the electrodes 171' in the second stage 171 are coupled to an exemplary +200 V source 174. Of course, once again if the mesh-type electron multiplier 159' depicted fragmentarily in FIG. 19 is to employ more than two (2) stages 170, 171—for example, twelve (12) stages as diagrammatically shown in FIG. 17— a comparable number of separate voltage inputs will be required.

Therefore, considering FIG. 17, it will be appreciated that the laminar insulating supports 126, 128 depicted in the drawing must include separate and independent paths equal in number to the number of mesh-type dynode stages employed in each of the electron multipliers $159_1$ through $159_8$. This, however, is a structural detail well within the skill of photomultiplier designers and need not be illustrated or described further herein. Suffice it to say, that the modified electron multipliers $159_1$ through $159_8$ depicted in FIG. 17 will function in the same way as the mesh-type electron multiplier 80*d* used in the photomultiplier 52*d*(54*d*) depicted in FIG. 8, while the overall operation of the photon detector/electron multiplier 108*a* of FIG. 17 will be essentially the same as that previously described for the photon detector/electron multiplier 108 of FIG. 14.

Thus, the overall photon detector/electron multipliers 108, 108*a* each comprise a multi-section device employing: i) a single annular evacuated housing 109 having inner and outer spaced annular walls 110, 111 wherein the inner wall 110 is formed of thin-walled glass, quartz, or other suitable thin-walled light-transmissive material; ii) a unitary cylindrical photocathode 119 deposited on, or positioned immediately adjacent, the vacuum side of the light-transmissive inner annular wall 110; iii) a plurality of radially oriented, electrically isolated, electron multipliers $159_1$ through $159_8$ disposed in adjacent arcuate sections of a compact annular space 116; and iv), a plurality of anodes 124, all of which collectively subtend adjacent arcs on the photocathode 119, with the electron multipliers $159_1$ through $159_8$ and their associated anodes 124 subdividing the single evacuated space 116 into multiple adjacent arcuate sections (which are preferably, but not necessarily, of substantially equal size) associated with the common cylindrical photocathode 119 which is equidistant at all points from, and in close proximity to, the axis of a central detection chamber 118. Moreover, the modified device depicted at 108*a* in FIG. 17 is equally suitable for use in coincidence counting in the manner previously described in connection with the embodiment of the invention depicted in FIGS. 13 through 16B.

However, in the case of the overall photon detector/electron multiplier 108*a* depicted in FIG. 17, those skilled in the art will appreciate that because mesh-type electron multipliers possess excellent spatial resolution characteristics, it is not necessary to provide a plurality of discrete, circumferentially spaced, mesh-type electron multipliers $159_1$ through $159_8$ as shown in the drawing and as described hereinabove. Rather, when using a mesh-type electron multiplier, each dynode stage can comprise a cylindrical mesh dynode stage (not shown in the drawings) with the first such dynode stage having a diameter somewhat greater than that of the cylindrical photocathode 119, and each subsequent dynode stage—e.g., the second stage, third stage, fourth stage, etc.—having progressively larger diameters so that the array of cylindrical mesh-type dynode stages are in closely spaced, concentric, coaxial relation. Disposition of a plurality of circumferentially spaced anodes 124, such as shown in FIG. 17, outboard of the outermost cylindrical mesh-type dynode stage, coupled with the excellent spatial resolution characteristics of mesh-type dynodes, enable the cylindrical mesh-type dynodes to cooperate with respective different ones of the plurality of anodes so as to function as a corresponding plurality of discrete electron multipliers disposed in a side-by-side circumferential array.

Moreover, it will be evident from the foregoing that each such mesh-type dynode stage need not be cylindrical; but, rather, the essentially cylindrical nature of the arrangement can be achieved using a pair of semi-cylindrical mesh-type dynodes for each of the multiple stages or, alternatively, by using mesh-type dynode stages formed of multiple arcuate sections disposed in a circular array.

The foregoing arrangements are particularly desirable because mesh-type dynode stages can be conveniently manufactured in cylindrical, semi-cylindrical or arcuate form as opposed to simply planar configurations, are easy to install, and cost effective.

3. 360° Surround Photon Detector/Electron Multiplier Employing Hybrid Photodiode Electron Multipliers—FIGS. 20–23

Figure 20:
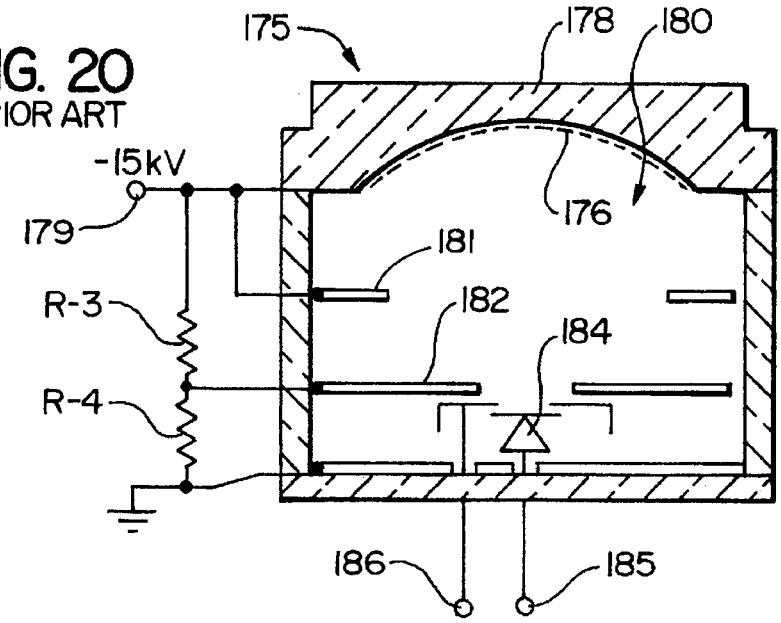
FIG. 20 PRIOR ART
FIG. 20 is a diagrammatic block-and-line sectional view illustrating a conventional electrostatically focused hybrid photomultiplier tube or "HPMT", also known scientifically as a "hybrid photodiode"—a device whose basic electron multiplication structure can be used with the cylindrical photocathode of the present invention in lieu of microchannel plates, mesh-type dynodes, venetian blind dynodes and similar conventional dynode structures.

Turning now to FIG. 20, a completely conventional hybrid photomultiplier tube or "HPMT", also known as a "hybrid photodiode", has been generally indicated at 175. Such hybrid photodiodes 175 are commercially available from Delft Electronische Producten (DEP) of Roden, Holland under the product designator "E18" for an electrostatically focused hybrid photomultiplier tube ("HPMT"); and, are representative of a class of electron multipliers that have been commercially available for more than two decades.

In the exemplary electrostatically focused HPMT 175, a photocathode material, diagrammatically indicated by the broken lines 176, is deposited on a spherical shaped surface formed in a light-transmissive window 178 and is coupled to a −15 kV voltage source 179. An electron multiplier, generally indicated at 180, is provided including a first focusing electrode 181 coupled to the negative high voltage source 179, and a second downstream focusing electrode 182 coupled to the high voltage source 79 via a voltage divider network comprising resistors R-3, R-4. The focusing electrodes 181, 182 serve to attract and accelerate primary electrons emitted from the photocathode 176 upon impingement and absorption of incident photons, focusing the accelerated primary electrons on a relatively small PIN diode 184.

The accelerated primary electrons bombard the backside of the PIN diode 184, thus creating a plurality of electron-hole-pairs—according to the manufacturer, DEP, on the order of 3,500 electron-hole-pairs per impinging electron are created at a −15 kV voltage level at the photocathode 176. Consequently, when the PIN diode 184 is reversely biased, the electron-hole-pairs cause a current to flow across the PIN diode's output terminals 185, 186. The E18 electrostatically focused HPMT 175 is said to possess excellent time response characteristics and photo-electron resolution; and, is typically used in astronomy, spectroscopy, scintillation counting and like applications.

Figure 21:
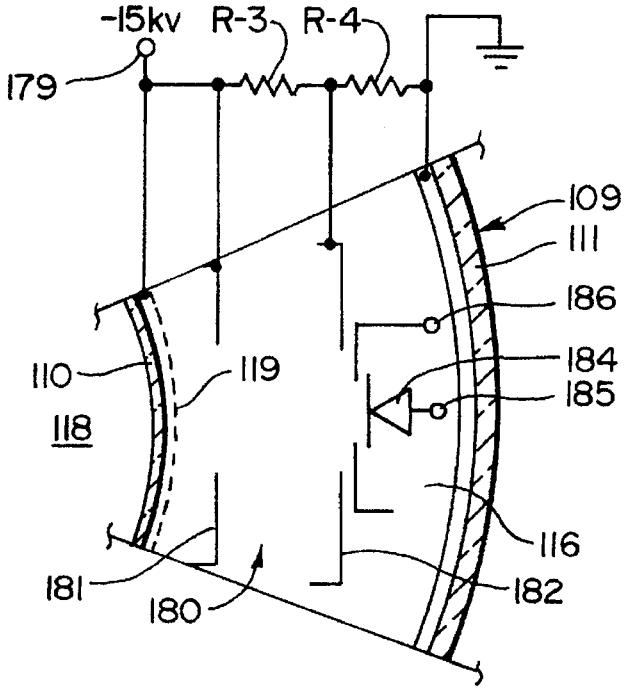
FIG. 21 is a highly diagrammatic, fragmentary, plan view, partially in section, here illustrating a portion of an annular photon detector/electron multiplier arrangement such as that depicted in FIG. 14 comprising a subtended arc of approximately 45° of the cylindrical photocathode with an electron multiplier of the electrostatically focused hybrid photomultiplier or HPMT type depicted in FIG. 20.

In carrying out this aspect of the present invention, and as best shown in FIG. 21, the electron multiplier structure 180 of the conventional electrostatically focused HPMT 175 depicted in FIG. 20 has been employed as an electron multiplier 180 in each of the multiple adjacent arcuate sections within the annular space 116 formed in an annular, evacuated envelope or housing, generally indicated at 109 (only one such arcuate section within the annular space 116 has been depicted in FIG. 21). As in the previous embodiments of the invention hereinabove described, the annular housing 109 includes a cylindrical, thin-walled, light-transmissive, annular inner wall 110, an outer cylindrical wall 111, and a cylindrical photocathode 119 of which only a subtended arcuate region of approximately 45° is depicted in FIG. 21.

More specifically, the exemplary electron multiplier 180 depicted in FIG. 21 includes first and second focusing electrodes 181, 182 respectively coupled to a −15 kV voltage source 179 and a voltage divider network comprising resistors R-3, R-4. Consequently, primary electrons emitted from the facing arcuate segment of the cylindrical photocathode 119 are attracted and accelerated by the focusing electrodes 181, 182 and bombard the backside of a PIN diode 184, thus causing a current flow across the PIN diode's output terminals 185, 186 that is proportional to, but greatly amplified with respect to, the number of incident photons impinging on, and absorbed by, the specific facing 45° arc of the cylindrical photocathode 119.

In short, it will be appreciated by persons skilled in the art that the electron multiplier structure 180 employed in the embodiment of the invention depicted in FIG. 21 comprises an essentially equivalent structure in terms of function to those previously described in connection with the embodiments of the invention depicted in connection with FIGS. 13 through 16B, and 17 through 19, except that the MCP electron multipliers 120 of FIGS. 13 through 16B and the mesh-type electron multiplier structure 159 depicted in FIGS. 17 through 19 have been replaced with electrostatically focused hybrid photodiode electron multipliers 180 of the type depicted in the conventional electrostatically focused HPMT 175 shown in FIG. 20.

Again, the overall structure is characterized by its compactness and excellent time response, employing a common cylindrical photocathode 119 and a common annular housing 109 having inner and outer annular walls 110, 111 wherein the inner annular wall 110 is formed of thin-walled glass, quartz, or other suitable thin-walled light-transmissive material. The plurality of electron multipliers (only one of which is shown at 180 in FIG. 21) subdivide the annular space 116 within the annular evacuated envelope 109 into multiple, radially oriented, adjacent, arcuate sections each containing one of the plurality of electrostatically focused electron multipliers 180, and each of which subtends one of a plurality of adjacent arcs on the cylindrical photocathode 119 which is: i) equidistant at all points from the vertical axis passing through the centrally disposed detection chamber 118 and in close proximity thereto; and ii), coaxial with, and disposed internally of, the light-transmissive annular inner wall 110 of the evacuated envelope 109.

Figure 22:
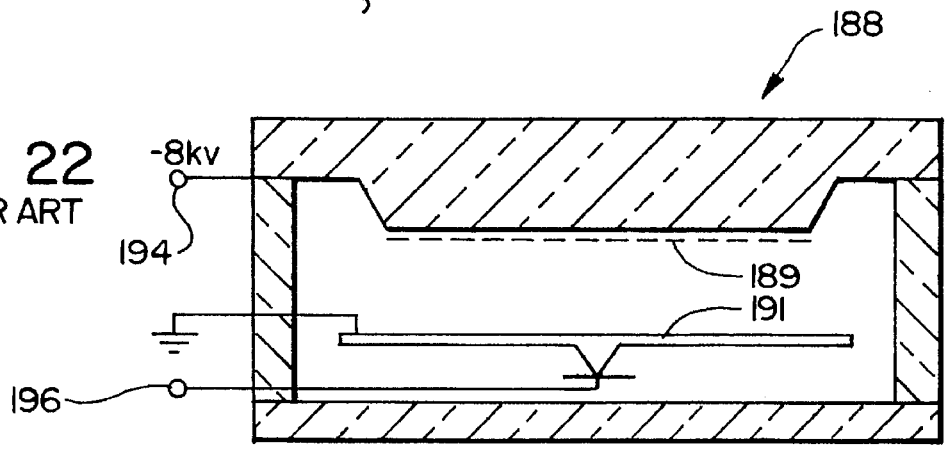
FIG. 22 PRIOR ART
FIGS. 22 and 23 are diagrammatic block-and-line sectional views similar to FIG. 20, but here respectively illustrating two different versions of conventional proximity focused hybrid photomultiplier tubes ("HPMTs") whose basic electron multiplication structures are also suitable for use with the present invention in lieu of microchannel plates, mesh-type dynodes and similar conventional electron multiplier devices.
Figure 23:
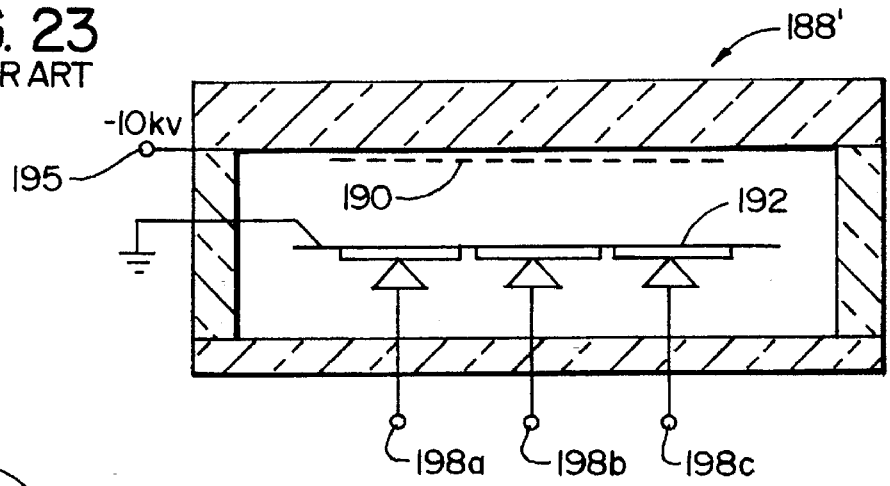
FIG. 23 PRIOR ART

Referring next to FIGS. 22 and 23, two slightly different embodiments of conventional, commercially available, proximity focused HPMTs, generally indicated at 188 and 188' in respective ones of FIGS. 22 and 23, have been illustrated. Once again, such devices are commercially available from Delft Electronische Producten (DEP) of Roden, Holland and are marketed under the product designators for a "P18" proximity focused HPMT (FIG. 22) and a "P25" proximity focused HPMT (FIG. 23). In each case, the devices 188, 188' include a photocathode 189 (FIG. 22) and 190 (FIG. 23) separated by a small gap from PIN diodes 191 (FIG. 22) and 192 (FIG. 23) each having active areas substantially identical in size to respective ones of the photocathodes 189 (FIG. 22) and 190 (FIG. 23). The arrangement is such that primary electrons emitted by the photocathodes 189, 190 are accelerated by a high voltage difference maintained between: i) the voltage levels applied to the photocathodes 189, 190—e.g., −8 kV is applied to the photocathode 189 from voltage source 194 in FIG. 22; and, −10 kV is applied to the photocathode 190 from voltage source 195 in FIG. 23; and ii), the PIN diodes 191, 192 which are each maintained at ground, with the current developed at the PIN diode 191 of FIG. 22 being output on terminal 196 and that developed at the PIN diode(s) 192 of FIG. 23 being output on terminals 198*a*, 198*b* and 198*c*.

The proximity focused HPMTs 188, 188', or hybrid photodiodes, depicted in FIGS. 22 and 23 are said to be highly insensitive to high magnetic fields, with the device 188' depicted in FIG. 23 having excellent spatial resolution characteristics. Once again, the hybrid photodiodes 188, 188' of FIGS. 22 and 23 are characterized by their compactness and are, therefore, ideally suited for use as electron multipliers in an annular photomultiplier, such as that fragmentarily depicted in FIG. 21, having a cylindrical photocathode 119 deposited on, or positioned adjacent, the vacuum side of the inner light-transmissive, thin-walled annular wall 110 of a photon detector/electron multiplier embodying features of the present invention wherein the photocathode 119 is coaxial with, equidistant from, and in close proximity to, the axis of a centrally disposed detection chamber 118.

Figure 24:
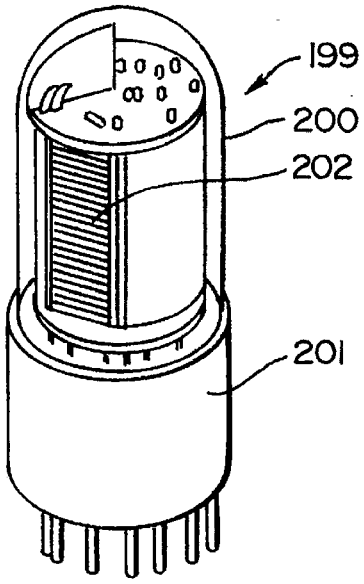
FIG. 24 PRIOR ART
FIG. 24 is an isometric side elevational view of a conventional prior art photomultiplier tube of the side-on type.
Figure 25:
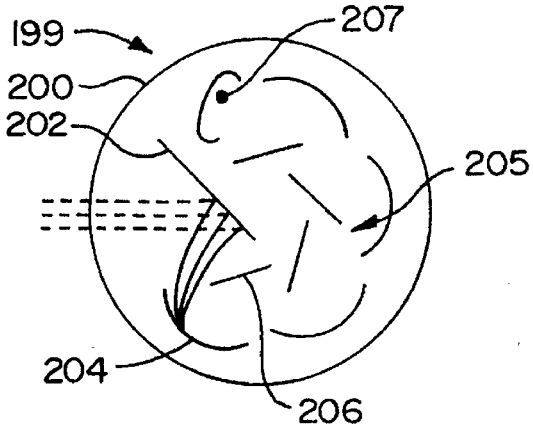
FIG. 25 PRIOR ART
FIG. 25 is a diagrammatic block-and-line plan view of the conventional prior art side-on type of photomultiplier tube depicted in FIG. 24, here illustrating the relationship of the opaque or non-light-transmissive-type photocathode and associated circular-cage-type dynode structure employed in such conventional side-on photomultiplier tubes.
Figure 26:
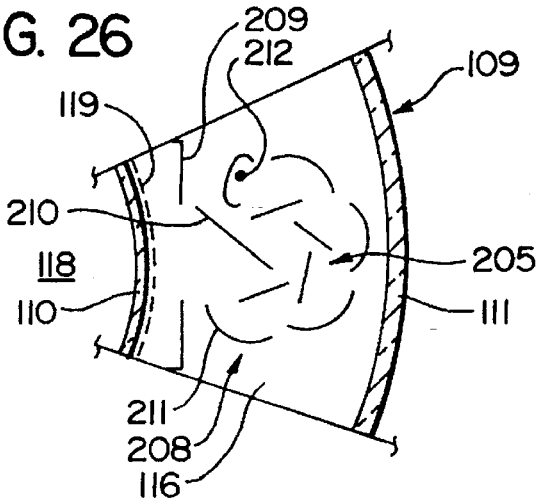
FIG. 26 is highly diagrammatic, fragmentary, plan view, partially in section, similar to FIG. 21, but here depicting a section of the annular photomultiplier envelope housing a modified form of circular-cage dynode structure of the type commonly employed in side-on photomultiplier tubes and which is characterized by its compactness and fast time response.

4. 360° Surround Photon Detector/Electron Multiplier Employing Circular-Cage Electron Multipliers—FIGS. 24–26

Attention is next directed to FIGS. 24 and 25 which illustrate a conventional side-on photomultiplier tube, generally indicated at 199. In this type of conventional device, the tube 199 generally includes a cylindrical evacuated envelope 200 mounted on a base 201 and having a photocathode 202 disposed internally of, and lying along, the longitudinal length of the cylindrical envelope 200. The arrangement is such that incident light passes through the light-transmissive sidewall of the evacuated envelope 200, impinges against, and is absorbed by, the outwardly facing surface of the photocathode 202—a photocathode which is generally opaque and non-light-transmissive as contrasted with the previously described light-transmissive photocathodes 78 (FIGS. 5–8, 11 and 12), 119 (FIG. 14), 176 (FIG. 20), 189 (FIG. 22) and 190 (FIG. 23) wherein light impinges against the non-vacuum side of the photocathode and is absorbed by the photocathode, with the absorbed photon energy causing emission of primary electrons from the vacuum side of the photocathode. However, in a side-on photomultiplier tube such as that depicted at 199 in FIGS. 24 and 25, since the photocathode 202 is opaque or non-light-transmissive, primary electrons are emitted from the same surface of the photocathode 202 upon which the photon energy impinges and is absorbed.

The resulting primary electrons emitted from the photocathode 202 are then accelerated towards, and attracted to, a first stage dynode 204 in a circular-cage-type dynode array, generally indicated at 205 in FIG. 25, resulting in emission of multiple secondary electrons which are accelerated towards, and attracted to, a second stage dynode 206 in the circular-cage dynode chain 205; and, the foregoing multiplication process is repeated through successive dynode stages with the multiplied stream of secondary electrons being collected at an anode 207 for subsequent processing. Such side-on photomultiplier tubes 199 and their circular-cage-type dynode electron multipliers 205 are completely conventional, well known to persons skilled in the art, and characterized by their compactness and excellent time response characteristics.

Consequently, and as best shown in FIG. 26, an electron multiplier, generally indicated at 208, of the circular-cage variety 205' is well suited for use with the present invention since it is characterized by its compactness and fast time response characteristics. Thus, a plurality of circular-cage-type electron multipliers (only one such electron multiplier 208 is depicted in FIG. 26) are mounted in radially oriented, side-by-side relation within the annular space 116 defined by the inner and outer annular walls 110, 111 of the annular evacuated envelope 109 of the present invention. As here shown, one or more focusing electrodes 209 may be employed to insure that primary electrons emitted from the facing subtended arc of the cylindrical photocathode 119 are accelerated towards, and attracted to, a first stage dynode 210 which here replaces the opaque photocathode 202 of the conventional circular-cage arrangement 205 depicted in FIG. 25. Primary electrons impinging against the first stage dynode 210 produce multiple secondary electrons which are, in turn, accelerated towards, and attracted to, a second stage dynode 211, etc.; with the multiple secondary electrons generated in the circular-cage arrangement 205' depicted in FIG. 26 being collected at an anode 212.

Once again, the resulting structure depicted fragmentarily in FIG. 26 possesses many of the same advantages as the embodiments of the invention depicted in FIGS. 13 through 16B, 17 through 19, and 21—viz., they each employ: i) a common annular evacuated envelope 109 having inner and outer annular walls 110, 111 wherein the inner annular wall 110 is formed of an implosion-resistant, thin-walled glass, quartz, or other suitable light-transmissive material; ii) a cylindrical photocathode 119 deposited on, or positioned adjacent, the vacuum side of the inner annular wall 110; iii) a detection chamber 118 coaxial with, and disposed centrally of, the cylindrical photocathode 119 which is, therefore, equidistant from, and in close proximity to, the axis of the detection chamber 118 at all points on the photocathode 119; and iv), a plurality of compact, radially oriented, adjacent electron multipliers disposed within the annular evacuated space 116 defined by the annular evacuated envelope 109.

5. 360° Surround Photon Detector/Electron Multiplier Employing an Internal Generally Conical Reflector—FIGS. 27–30

Figure 27:
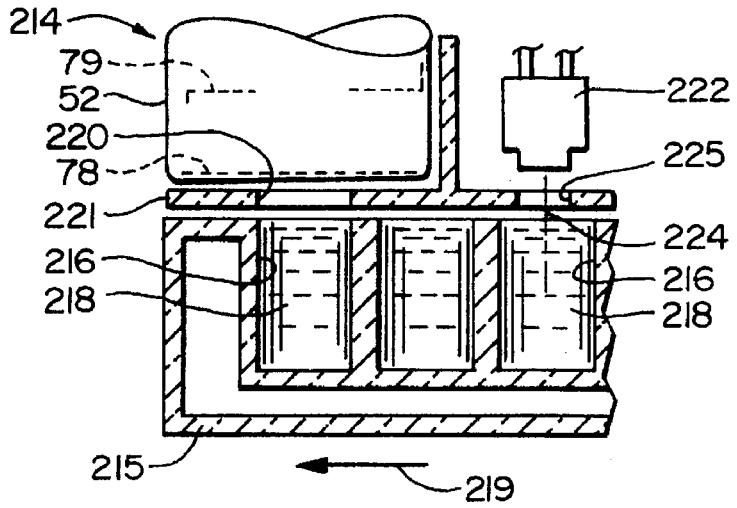
FIG. 27 PRIOR ART
FIG. 27 is a side elevational view, partly in section, here depicting a conventional prior art head-on photomultiplier used to view samples located in pockets formed in an open type multiple sample tray through a suitable aperture in a completely conventional manner well known to persons skilled in the art—samples which will typically contain a liquid scintillator and one or more radioactive isotopes such, for example, as a beta emitter or, alternatively, samples containing a luminescent material such, for example, as a fluorescent or phosphorescent material.

Referring to FIG. 27, there has been diagrammatically illustrated a fragmentary portion of a conventional scintillation counting system, generally indicated at 214, of the type commonly employed in laboratories or like facilities to detect scintillations or similar light events occurring in a multitude of small discrete samples; and, in some instances, to determine which, if any, of such samples warrant further analysis. As those skilled in the art will appreciate, often such small discrete samples will comprise only a small portion of a larger sample volume that is available for testing; although, in some instances the small sample volumes may be all that are available. In any case, and as here shown, a conventional open type multiple sample tray 215 has been diagrammatically depicted having a plurality of pockets or depressions 216 suitable for containing small quantities—typically only a few milliliters—of discrete liquid samples 218.

Such conventional open type multiple sample trays 215 typically include a plurality of equally spaced pockets or depressions 216 capable of holding, for example, on the order of twenty-four (24), ninety-six (96), or like plurality of discrete samples which are closely spaced and which each might contain, merely by way of example: i) a liquid scintillator and one or more radioactive isotopes; ii) a liquid sample containing a liquid scintillator with a radioactive emitter positioned at the bottom of a depression 216; and/or iii), liquid samples containing a luminescent material such, for example, as a fluorescent or phosphorescent material. Commonly, when analysis of such small discrete samples reveals one or more of continuing interest, the technician will conduct further analysis on larger sample portions from which the small discrete samples of interest were taken. Of course, those skilled in the art will appreciate as the ensuing description proceeds that the open type multiple sample tray diagrammatically illustrated at 215 can be replaced with any other suitable sample carrier including a flat tray, conveyer belts, etc.

In use, the tray 215 is generally moved laterally relative to a photosensitive detector—for example, relatively from right to left as viewed in FIG. 27 and as indicated by the arrow 219—until a particular sample 218 of interest is centered below an aperture 220 formed in a plate 221. Those skilled in the art will, of course, appreciate that to accomplish such relative movement, either the tray 215 or the photosensitive detector(s) 52/214 can be indexed along rectilinear or other suitable coordinates to successively position discrete samples 218, one at a time, below the aperture 220. A conventional, flat-faced, head-on photomultiplier tube 52 having a flat photocathode 78, one or more focusing electrodes 79, and a suitable electron multiplier (not shown, in FIG. 27 but, an electron multiplier such as one of those depicted at 80*a* through 80*d* in respective ones of FIGS. 5 through 8) comprises the photosensitive detector and is here disposed coaxially over the aperture 220 in a position where light scintillations or other photon emitting events occurring in the sample 218 positioned below the aperture 220 can be detected. Such an arrangement enables photons emanating from light scintillations or similar photon emitting events occurring within the sample 218 to pass through the aperture 220 and impinge upon the photomultiplier's photocathode 78 where the photons are absorbed, thus causing emission of one or more primary electrons in the manner previously described.

Should one or more of the particular samples 218 being processed in the conventional system depicted in FIG. 27 require external stimulation in order to excite, for example, molecules of a luminescent material in the sample(s), an external light source 222, which may take the form of a laser source or the like, can be provided for directing a laser or other light beam 224 axially through a second aperture 225 formed in plate 221 and into the sample 218 disposed immediately thereunder, which sample is to be subsequently viewed by the photomultiplier tube 52, thereby stimulating luminescent light activity in the sample 218 which will be detected by the photomultiplier tube 52 when that sample is shifted relative to the photomultiplier 52 to a position located immediately below aperture 220.

Of course, although not shown in FIG. 27, those skilled in the art will appreciate that the conventional scintillation counting system 214 there illustrated diagrammatically will include suitable shielding to insure that light detected by the photomultiplier 52 occurs in a sealed light-tight environment wherein light from external sources, or cross-contamination by a light beam 224 being used to stimulate a subsequent sample to be processed, is not detected by the photomultiplier 52. And, of course, the conventional detection system 214 may also be enclosed within a suitable lead shield or the like (not shown) so as to protect against external radiation. Moreover, it will be apparent to persons skilled in the art that since each sample is being, and can be, viewed only by a single photomultiplier tube 52 which is completely conventional in construction, the conventional detection system 214 cannot take advantage of conventional coincidence counting techniques to exclude random spurious signals emitted from the photomultiplier's photocathode 78 or other structural components of the tube 52.

Figure 28:
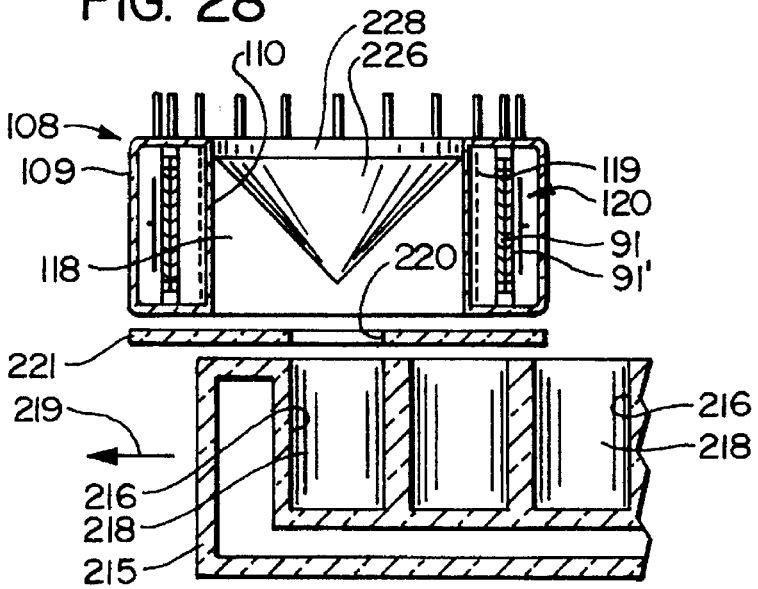
FIG. 28 is a vertical sectional view, partly in elevation, of yet another modified form of photon detector/electron multiplier embodying features of the present invention which is similar to that shown in FIG. 15, but here illustrating the device, which is capable of coincidence counting, in an inverted position and with an internal, generally conical, or other suitably shaped reflector disposed coaxially within the central detection chamber for redirecting photon energy emanating from samples disposed on a sample carrier located below the detection chamber to the photocathode where such photon energy is absorbed and causes emission of electrons from the photocathode which are thereafter multiplied and output to a suitable signal processor, and wherein the samples on the sample carrier may comprise: i) a sample containing a liquid scintillator and one or more radioactive isotopes such, for example, as a beta emitter; or ii), a sample containing a luminescent material such as a fluorescent or phosphorescent material.

In accordance with another important aspect of the present invention, and as best shown in FIG. 28, the exemplary photon detector/electron multiplier 108 depicted in FIGS. 13 through 16B and here incorporating MCP-type electron multipliers 91, 91' has been modified to permit use in detection of light sources disposed externally of both the annular photon detector/electron multiplier 108 and its central coaxial detection chamber 118—for example, to permit detection of light sources in small discrete samples 218 contained in pockets 216 formed in a conventional open type multiple sample tray 215, or samples which are supported on, or contained in, other suitable and completely conventional sample carriers capable of being moved relative to the photon detector/electron multiplier 108 so as to align successive samples coaxially with the detection chamber 118. As in the conventional detection system 214 described in connection with FIG. 27, the photon detector/electron multiplier—here the exemplary annular device 108 embodying features of the present invention rather than a conventional head-on photomultiplier tube 52 such as shown in FIG. 27—is located coaxially above, and in close proximity to, a plate 221 defining an aperture 220 through which discrete small samples 218 carried on the tray 215 or other conventional sample carrier can be viewed.

However, in carrying out this aspect of the invention, the photon detector/electron multiplier 108 is provided with an internal reflector 226 which is disposed coaxially within the detection chamber 118 at the upper end thereof as viewed in FIG. 28, and which is provided with one or more external mirrored or highly polished surface(s). In the exemplary embodiment of the invention depicted in FIG. 28, the reflector 226 is conical which makes it particularly well suited for use with photons entering the detection chamber along substantially parallel longitudinal lines; but, as will be appreciated by persons skilled in the art, in those instances where entering photons are moving along other than parallel longitudinal lines—for example, where the sample is close to the reflector and relatively large—the reflector 226 may be slightly parabolic. Alternatively, the reflector, while being generally conical, may be made up of multiple flat or substantially flat surfaces disposed in a somewhat conical array. In any event, the reflector 226 is provided with a cylindrical base 228 adapted to be mounted in face-to-face contact with the annular inner wall 110 of the annular housing 109 forming the evacuated envelope within which a cylindrical photocathode 119 and the MCP electron multipliers 120 are disposed. Consequently, the arrangement is such that light scintillations or other light generating events—e.g., luminescent emissions-occurring in the sample 218 will generate photons that pass upwardly (as viewed in FIG. 28) through the aperture 220 in plate 221 and impinge upon the mirrored or highly polished surface(s) of the reflector 226 which serves to reflect the light photons laterally towards the surrounding cylindrical photocathode 119 and its outboard array of radially oriented, adjacent, equally spaced electron multipliers 120 which are contained within housing 109.

Because the detection system depicted in FIG. 28 employs an annular photon detector/electron multiplier 108 (or any of the other annular devices depicted in, for example, FIGS. 17, 21 and/or 26) embodying features of the present invention, the system is fully capable of coincidence counting in the manner previously described in connection with FIGS. 13 through 16B. Of course, although not shown in FIG. 28 for purposes of clarity, those skilled in the art will appreciate that suitable light shields and/or radiation shields will and/or may be employed to preclude any spurious signals resulting from external light sources and/or other external radiation sources.

Figure 29:
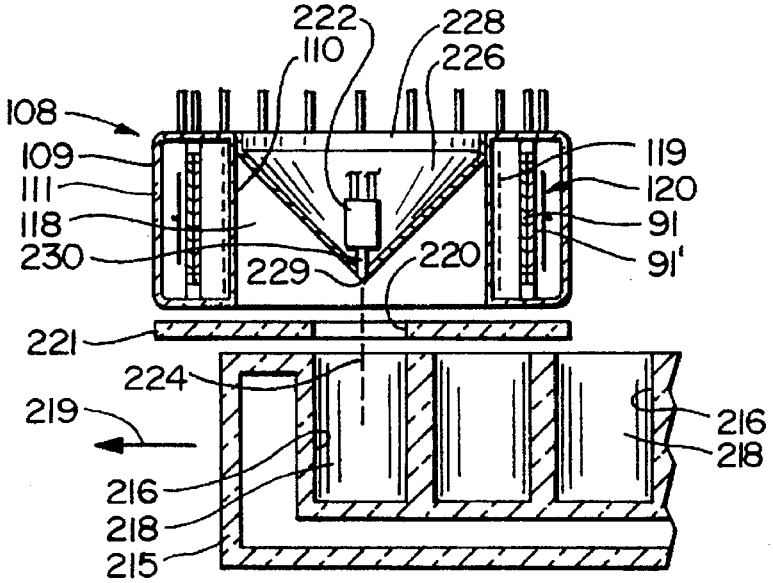
FIG. 29 is a vertical sectional view, partly in elevation and similar to FIG. 28, but here illustrating the photon detector/electron multiplier of the present invention with a light source or other stimulator source mounted internally of the generally conical reflector for directing a light beam or other stimulant axially through a small opening in the apical end of the reflector and through the aperture into a sample containing, for example, a luminescent material to stimulate such material and produce detectable luminescent light emissions therefrom.

Turning next to FIG. 29, a further embodiment of the invention has been depicted which is essentially identical to that described above in connection with FIG. 28; except, in this instance the reflector 126 has been slightly modified so as to enable usage of the device with external samples—i.e., samples 218 spaced externally from the detection chamber 118 located coaxially within the cylindrical photocathode 119—comprising, for example, luminescent samples which may require external stimulation in order to induce detectable light events. To accomplish this, a suitable stimulator 222, which may take the form of a light source such, for example, as a laser source or the like, is mounted coaxially within the reflector 226 which is provided with a small opening 229 adjacent its apical end 230.

Thus, in those instances where a particular sample 218 requires external stimulation to generate detectable light—e.g., a luminescent sample—the stimulator 222 is momentarily actuated to direct a laser or other light beam 224 axially through the small opening 229 at the apical end 230 of the reflector 226, axially out of the detection chamber 118, through the aperture 220 in plate 221, and into the sample 218 disposed immediately therebelow on the tray 215 or other suitable sample transport mechanism. Of course, since the sample 218 is positioned coaxially below the detection chamber 118 at the time of stimulation, there is no possibility that the stimulated light activity will degrade during relative lateral movement of the tray 218 in the direction of arrow 219 as was inherently the case with the conventional prior art detection system 214 depicted in FIG. 27.

Alternatively, the stimulator 222 may comprise a source of liquid reagent and suitable metering equipment (not shown) for dispensing small metered quantities of the reagent out of the small opening 229 at the apical end 230 of the reflector 226, axially out of the detection chamber 118, through the aperture 220 in plate 221, and into an underlying sample 218 containing a luminescent material, thereby exciting the luminescent material as a result of interaction with the reagent.

Figure 30:
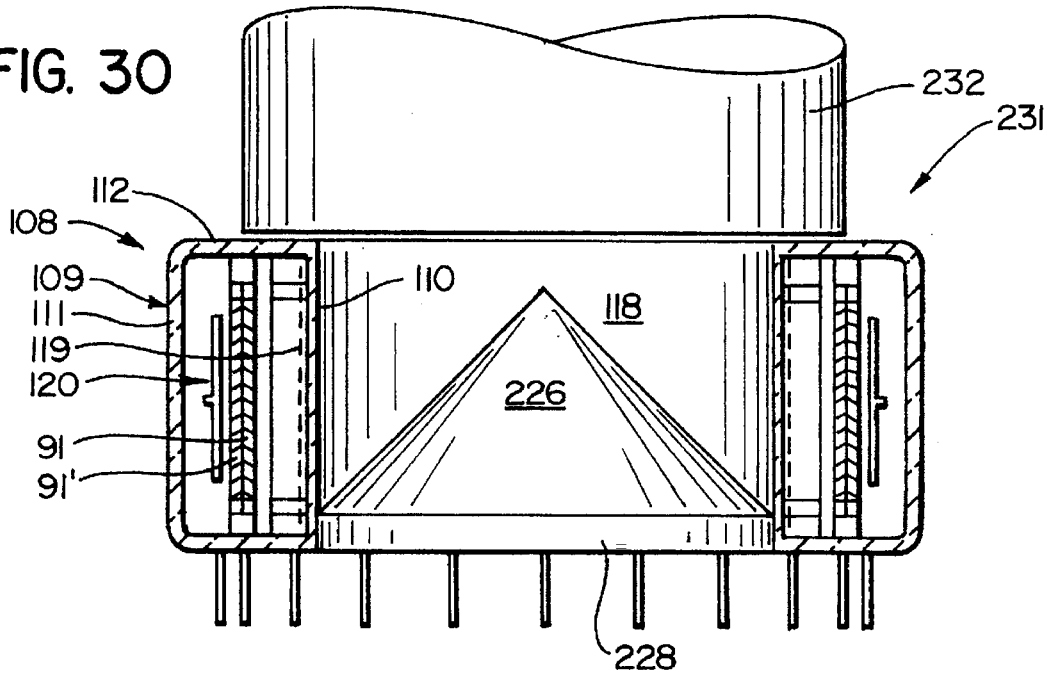
FIG. 30 is a vertical sectional view similar to FIGS. 28 and 29, but here illustrating the device in the same position as shown in FIG. 15 with the internal, coaxial, generally conical reflector facing upwardly or outwardly as viewed in the drawing, thereby enabling the device to be used with any suitable and conventional light collimator such, for example, as a light-directing tubular collimator used with a telescope, microscope or the like for directing photons downwardly or inwardly (as viewed in the drawing) into the device from an external light source such as astronomical observations using a telescope, or measurements of light scintillations occurring in a radioactive sample viewed through a microscope, or measurements of similar external light sources.

Referring next to FIG. 30, yet another exemplary application to which the present invention can be put has been illustrated. Thus, as here shown, an external light collection system, generally indicated at 231, has been provided wherein the photon detector/electron multiplier and generally conical reflector combination 108/226 of FIG. 28 has been inverted—i.e., the apical end 230 of the reflector 226 is facing upwardly as viewed in the drawing, although those skilled in the art will appreciate that this embodiment of the invention requires merely that the generally conical reflector 226 face axially out of the detection chamber 118 in any of an upward, lateral or even downward direction dependent upon the orientation of the housing 109. A tubular light collimator 232 is provided which is in substantially face-to-face, light-sealed relation with the top wall 112 of the annular housing 109 for the photon detector/electron multiplier 108; and, is here employed for directing light photons derived from virtually any external light source of interest longitudinally through the tubular collimator 232 into the detection chamber 118 where the collimated light either impinges directly on the cylindrical photocathode 119 or, more likely, impinges upon the mirrored or highly polished surface(s) of the generally conical reflector 226, from which the reflected light photons impinge upon, and are absorbed by, the surrounding cylindrical photocathode 119.

Thus, the arrangement depicted in FIG. 30 permits such light collimators 232 to be used in combination with an annular photon detector/electron multiplier 108 embodying features of the present invention to detect photon energy emanating from external light sources resulting from, for example, astronomical observations employing telescopes or the like (not shown), scientific measurements employing microscopes or the like (not shown), or from virtually any other light source remote from the photon detector/electron multiplier 108.

As in the previous embodiments of the invention, the light collimator system 231 depicted in FIG. 30 takes advantage of all of the benefits of the invention previously described, including: i) a 360° surround, light-transmissive, implosion-resistant, thin-walled, annular inner wall 110 forming part of an annular evacuated envelope 109 with a continuous cylindrical photocathode 119 deposited on, or positioned adjacent, the vacuum side of the annular wall 110 which is equidistant at all points from, and in close proximity to, the axis of the detection chamber 118; ii) consequent improved collection geometry and counting efficiencies; iii) improved signal-to-noise ratios; iv) compactness and overall minimal size leading to reduced size and weight for required shielding materials; and v), the ability to provide coincidence counting in virtually any light detection application being conducted where coincidence counting is desired.

6. 360° Surround Photon Detector/Electron Multiplier Employing a Cylindrical Array of Light-Filters Within and Surrounding the Central Detection Chamber for Enabling Detection and Display of the Spectral Distribution of Light Emitted From a Sample—FIGS. 31–34

The present invention—which here employs an annular photon detector/electron multiplier 108 defining a central coaxial detection chamber 118 capable of detecting light emitted from samples with excellent counting geometry and efficiencies and resulting in output pulses of maximum amplitude with superior signal-to-noise ratios—is also particularly well suited for detection and display of the spectral distribution of light emitted from the sample or other specimen during imaging analysis techniques.

Figure 31:
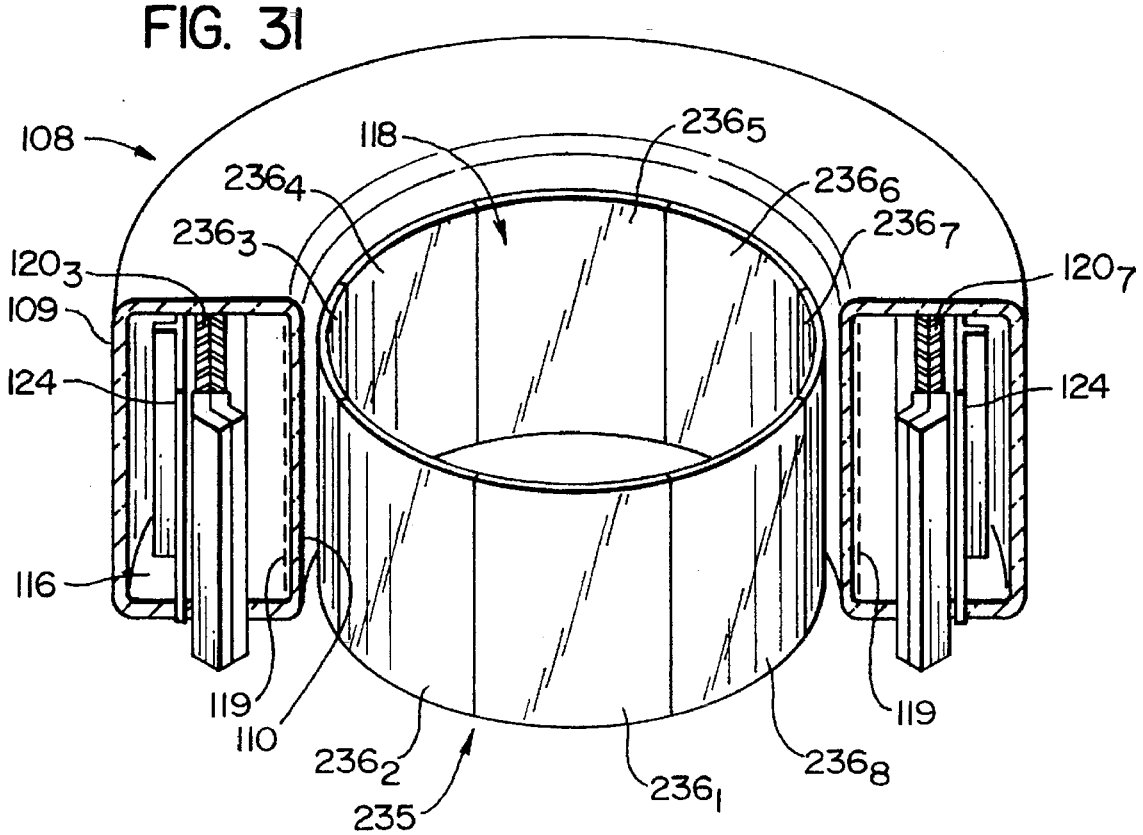
FIG. 31 is a fragmentary isometric view depicting a portion of a photon detector/electron multiplier of the type depicted in FIGS. 13 through 15, but, here including a composite cylindrical assembly of light-transmissive filters each having different wavelength bandpass characteristics, with the composite cylindrical assembly of filters disposed coaxially within the detection chamber and with each filter aligned and matched with a respective one of the plurality of circumferentially spaced electron multipliers, thereby permitting detection and display of the spectral distribution of light emitted from a sample.
Figure 32:
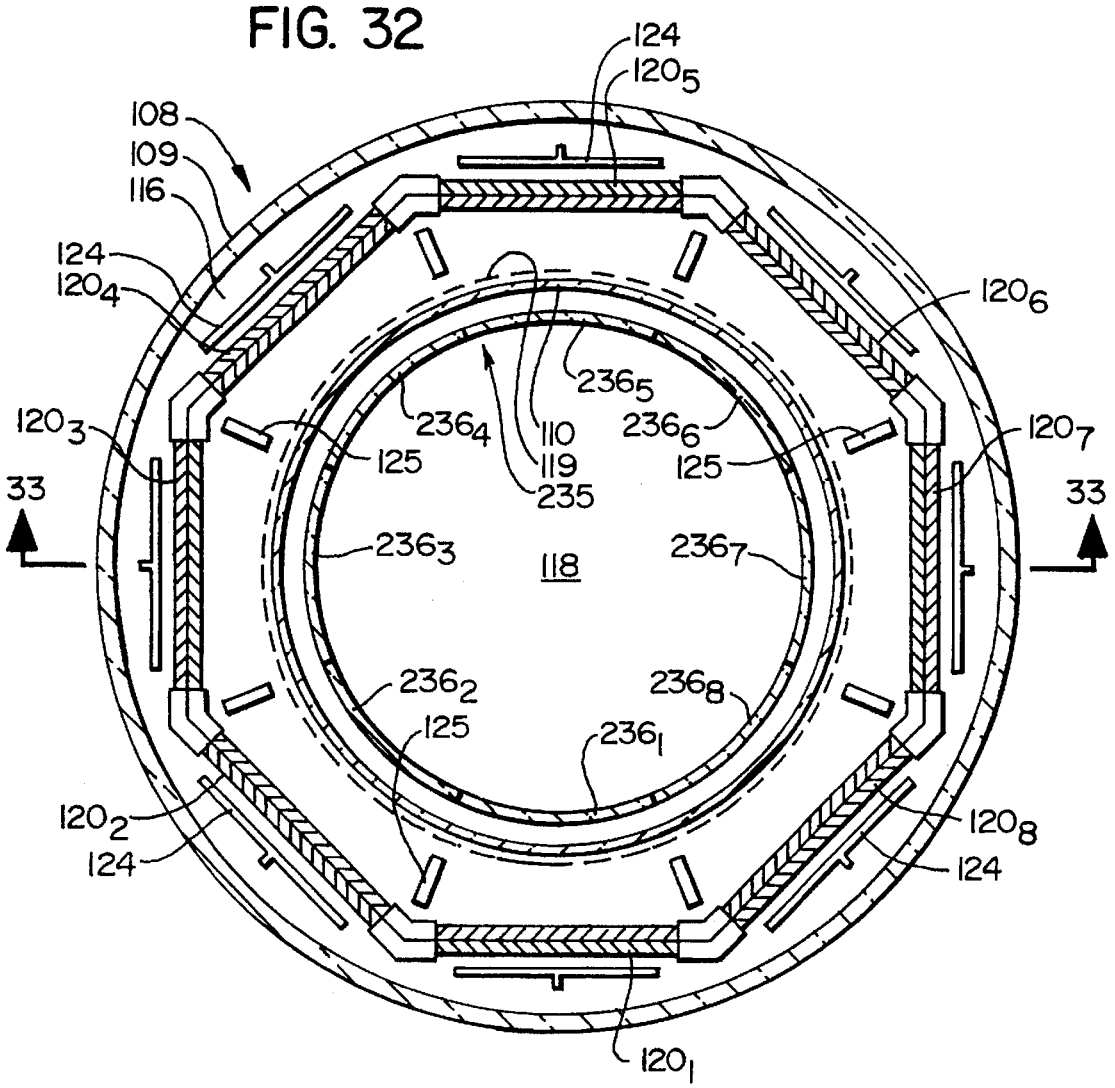
FIG. 32 is a plan view, partially in section with a portion of the annular envelope having been removed, here depicting the photon detector/electron multiplier of FIG. 31 with the composite cylindrical assembly of light-transmissive filters disposed coaxially therein.
Figure 33:
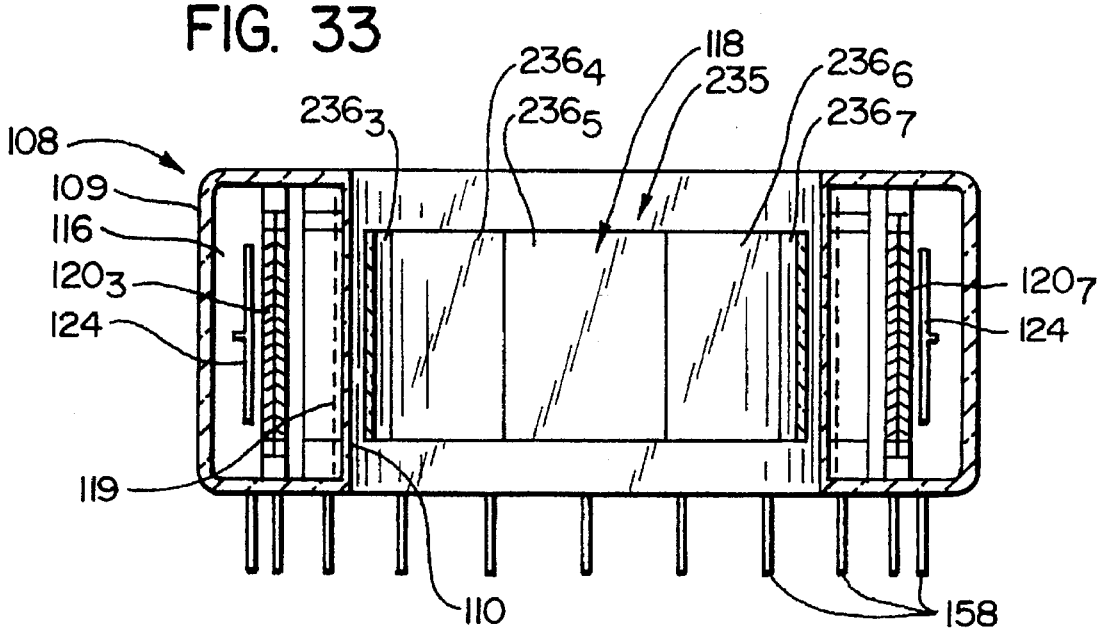
FIG. 33 is a vertical sectional view taken substantially along the line 33—33 in FIG. 32 and depicting details of the photon detector/electron multiplier with the composite cylindrical assembly of light-transmissive filters disposed coaxially therein.

Thus, referring to FIGS. 31 through 33 conjointly, it will be noted that a relatively small photon detector/electron multiplier 108—i.e., an annular multiple-section device having an external diameter on the order of about 50 mm (5 cm), an internal diameter on the order of about 30 mm (3 cm), and a height on the order of about 20 mm (2 cm) defining a central detection chamber 118 about 30 mm (3 cm) in diameter and 20 mm (2 cm) in height—has been illustrated which is essentially identical to the exemplary embodiment of the invention depicted in FIGS. 13 through 15. More particularly, the photon detector/electron multiplier 108 depicted in FIGS. 31–33 also includes: i) an annular evacuated envelope or housing 109 having a light-transmissive cylindrical inner wall 110 surrounding and defining a central coaxial detection chamber 118; ii) a cylindrical photocathode 119 deposited on, or positioned closely adjacent, the vacuum side of the cylindrical wall 110; and iii), a plurality of radially oriented, circumferentially arrayed, electron multipliers (i.e., an octagonal array of electron multipliers $120_1$–$120_8$ in the exemplary form of the invention here illustrated) mounted within the evacuated annulus 116 defined by the housing 109 in surrounding relation to the cylindrical photocathode 119.

As best indicated in FIG. 33, and with reference also to FIG. 32, the exemplary evacuated annular housing 109 is again provided with a plurality of completely conventional connector pins 158 suitable for providing voltage inputs to: i) the cylindrical photocathode 119; ii) the electron multipliers $120_1$–$120_8$; iii) optionally, a plurality of focusing electrodes 125 (if and where employed); and iv), anodes 124 associated with each of the electron multipliers $120_1$–$120_8$; as well as for outputting the voltage pulses accumulated on the anodes 124 to a suitable analyzing and display device or other appropriate and conventional utilization device (not shown).

In order to adapt the photon detector/electron multiplier 108 depicted in FIGS. 31 through 33 for detection and display of the spectral distribution of light emitted from a sample disposed within the detection chamber 118—as contrasted with merely providing output signals indicative of the presence and magnitude of detected light events—and in accordance with another of the important aspects of the present invention, a composite cylindrical light filter array, generally indicated at 235, comprising a plurality of separate, discrete, adjacent, light-transmissive filter segments $236_1$–$236_8$, each having different wavelength bandpass characteristics, is positioned coaxially within the detection chamber 118 defined by the photon detector/electron multiplier's inner cylindrical wall 110 and in closely spaced proximity to the cylindrical wall 110 and its surrounding cylindrical photocathode 119. More specifically, since the purely exemplary form of the invention here illustrated employs an octagonal array of electron multipliers $120_1$–$120_8$, the exemplary composite cylindrical light filter array 235 of filter segments employs eight (8) 45° arcuate filter segments $236_1$–$236_8$ which are respectively aligned and matched with respective different ones of the eight (8) electron multipliers $120_1$–$120_8$.

Those skilled in the art will, of course, appreciate that where the annular photon detector/electron multiplier 108 employs other than eight (8) electron multipliers $120_1$–$120_8$—for example, where it employs sixteen (16) electron multipliers (not shown) or, for that matter, any other number of electron multipliers—the composite cylindrical light filter array 235 of arcuate filter segments may similarly employ a corresponding plurality of discrete, adjacent segments $236_1$–$236_n$ (where "n" is any whole integer equal to the number of electron multipliers employed), with each of the filter segments having different wavelength bandpass characteristics and each being aligned and matched with a different one of the plurality of electron multipliers $120_1$–$120_n$ which are disposed radially outward from, and aligned with, respective different ones of the arcuate filter segments $236_1$–$236_n$.

Thus, the arrangement is such that light photons emitted from a sample or other specimen (not shown in FIGS. 31–33) disposed within the detection chamber 118 and directed laterally from the light source's point of origination will: i) dependent upon the wavelength of the light energy, pass through only those of the filter segments $236_1$–$236_8$ whose wavelength bandpass characteristics match the wavelengths of the emitted light photons; ii) thereafter pass through the light-transmissive cylindrical inner wall 110; and iii), impinge upon, and be absorbed by, the particular arcuate segment(s) of the cylindrical photocathode 119 radially aligned and matched with the particular one(s) of the filter segments $236_1$–$236_8$ which pass the light photons, causing the emission of primary electrons therefrom. Consequently, the primary electrons emitted from the cylindrical photocathode 119 will be multiplied in respective ones of the radially aligned and matched electron multipliers $236_1$–$236_8$, providing output signals on the anodes 124 which are representative of the spectral distribution of light emitted from the sample or other specimen.

Figure 34:
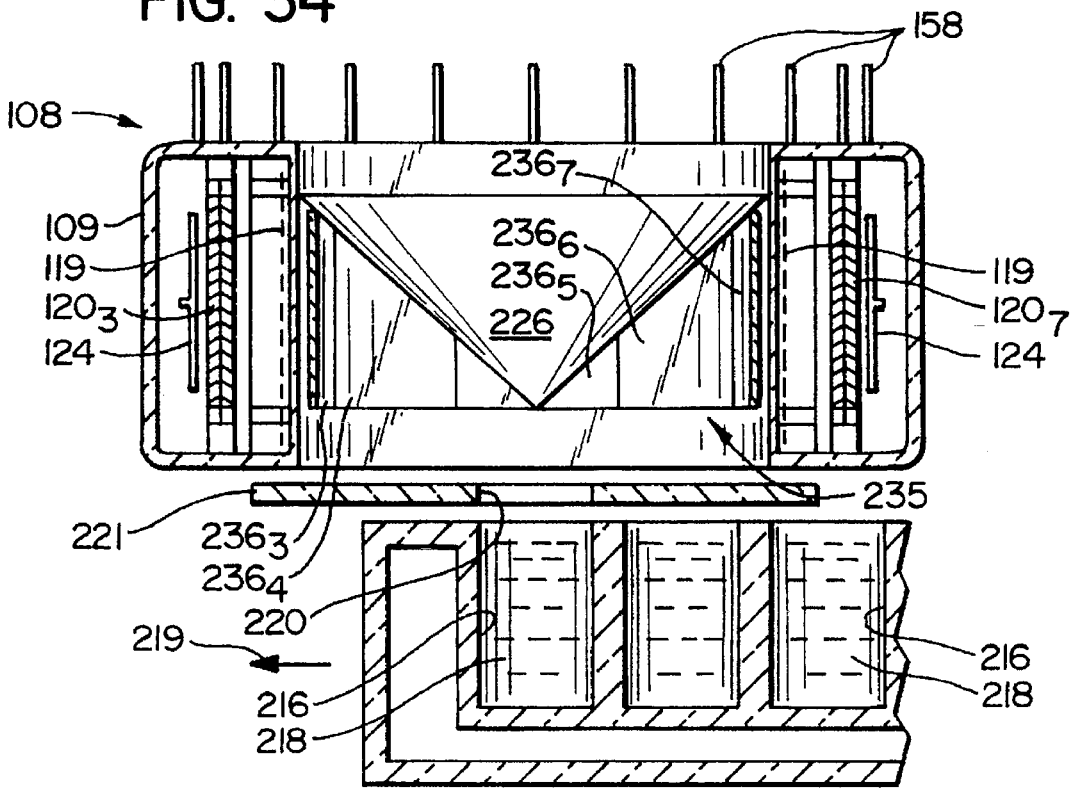

Turning next to FIG. 34, it will be observed that the use of a composite cylindrical light filter array 235 of arcuate filter segments $236_1$–$236_8$, each having different wavelength bandpass characteristics, to permit detection and display of the spectral distribution of light emitted from a sample or other specimen containing a light emitting source, is not limited to use with samples or specimens positioned internally within the central detection chamber 118 located coaxially within the annular photon detector/electron multiplier 108 as shown in FIGS. 31 through 33; but, rather, this feature of the invention is equally advantageous when analyzing samples or specimens disposed externally of the detection chamber 118 in the manner previously described in connection with, for example, FIGS. 28 through 30. Thus, as shown in FIG. 34, the annular photon detector/electron multiplier 108 can be inverted and provided with a central, coaxial, generally conical, or other suitably shaped reflector 226 in the manner previously described for viewing samples disposed in pockets 216 formed in a conventional open type multiple sample tray 215, or samples positioned in or on any other suitable sample carrier, or whose light emissions are collected from a remote source and collimated longitudinally into the detection chamber 118 as shown in FIG. 30, with the microtiter tray 215 or other sample carrier being indexable relative to the photon detector/electron multiplier 108 along rectilinear or other suitable coordinates as indicated by the arrow 219 to sequentially align discrete successive samples with the photon detector/electron multiplier 108.

Thus, in the form of the invention depicted by way of example in FIG. 34, light events occurring in the sample 218 produce light photons which pass through an aperture, 220 in plate 221 and impinge against the surface(s) of the reflector 226, causing the light photons to be reflected laterally towards the composite cylindrical light filter array 235 of arcuate filter segments $236_1$–$236_8$. Dependent upon the wavelength of the light photons reflected laterally from the reflector 226, certain ones of those photons pass through respective different one(s) of the filter segments $236_1$–$236_8$ and, in the manner previously described, this produces output signals from the anodes 124 associated with respective different ones of the electron multipliers $236_1$–$236_8$, which output signals are representative of the spectral distribution of light emitted at the originating light producing event.

In carrying out this aspect of the present invention as described above in connection with FIGS. 31 through 34, it is important that the composite cylindrical light filter array 235 of arcuate filter segments $236_1$–$236_8$ be arranged and dimensioned such that the possibility of light photons bypassing the filter segments $236_1$–$236_8$ and directly impinging upon the cylindrical photocathode 119 is effectively precluded. To this end, the composite cylindrical light filter array 235 of arcuate filter segments $236_1$–$236_8$ preferably has a height at least equal to and, where possible, somewhat greater than, the height of the cylindrical photocathode 119; and, additionally, the composite cylindrical light filter array 235 of arcuate filter segments $236_1$–$236_8$ is positioned as closely as possible to the annular inner wall 10 of the housing and, therefore, as closely as possible to the cylindrical photocathode 119. Moreover, although not shown in the drawings, suitable and completely conventional light shields can, and normally will, be employed to prevent light photons emitted from either the sample undergoing analysis or from any other source from directly impinging upon the photocathode 119.

Figure 35:
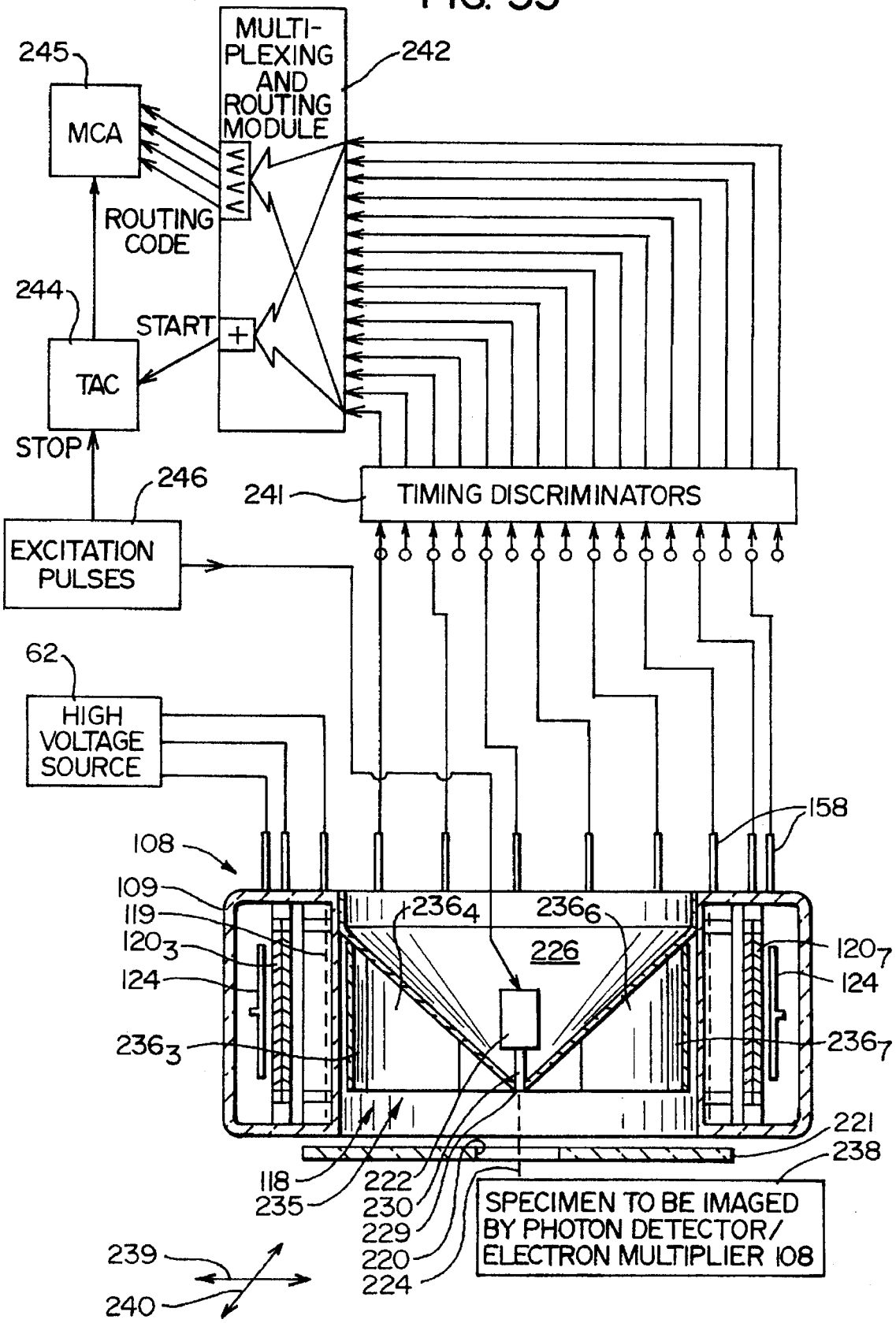

7. 360° Surround Photon Detector/Electron Multiplier Employing a Cylindrical Array of Light-Filters Within and Surrounding the Central Detection Chamber for Enabling Fluorescent Spectroscopic Diagnosis of Small and Large Fluorescent Light-Emitting Areas on a Specimen Undergoing Diagnostic Analysis—FIG. 35

It will be apparent from the foregoing discussion that the use of an annular multiple-section photon detector/electron multiplier 108 embodying features of the present invention in combination with: i) a generally conical reflector 226 disposed coaxially within the detection chamber 118; and ii), a composite cylindrical light filter array 235 comprising a plurality of arcuate filter segments $\mathbf{236}_1$–$\mathbf{236}_n$ having different wavelength bandpass characteristics, and wherein the cylindrical array 235 coaxially surrounds the reflector 226 and is in closely spaced proximity to, and surrounded by, the photon detector/electron multiplier's inner annular wall 110 and cylindrical photocathode 119, finds particularly advantageous application in detection and display of the spectral distribution of light emitted from an external source or sample containing a light emitting source of interest. This fact, coupled with the extremely compact size of the photon detector/electron multiplier 108 which is equally capable of detecting light emissions—e.g., fluorescent, phosphorescent or other light emissions from an external source or sample—makes luminescent spectroscopic analysis an area of special interest and significance where the present invention finds particularly advantageous use.

For example, during the past fifty or more years, extensive research has been conducted involving various attempts to effectively use luminescent spectroscopy in the field of medical diagnostics. One significant, but by no means exclusive, area of such research has involved burn diagnosis wherein the key to proper and cost-effective treatment of burn patients is said to involve quick and accurate diagnosis of the severity of the burn, together with an assessment of whether the burn is capable of self-healing or whether more extensive surgical treatment is required involving excision of damaged tissue and grafting. This diagnostic approach requires an ability to diagnose the thickness of tissue that has been destroyed and a determination of whether or not there is sufficient blood flow in underlying tissue to render the tissue capable of self-regeneration. An article describing the various developments made to date in this area is entitled "Photonic Approaches to Burn Diagnostics" written by Stephen A. May, Biophotonics International, pages 44–50 (May/June 1995).

The foregoing article describes a wide range of different approaches to the problem of rapidly and accurately diagnosing the severity of burns, commencing with the early use of sodium fluorescein for determining burn-wound viability and the various problems that have been encountered. The author also points out that such early work, although not of and by itself the answer to the problem, held out sufficient promise that the scientific community has continued, and is continuing, with efforts to devise a satisfactory optical technique for detecting the severity of burns and the depth of irreparable tissue damage. These approaches have included such techniques as: i) multispectral imaging using a device known as a Burn Depth Indicator ("BDI") to compare and record the reflectivity of red, green and infrared light from a burn-wound area; ii) the use of laser Doppler flowometry; and iii), more recently, the use of indocyanine green ("IG") dye which is intravenously injected into the patient's blood stream where it is rapidly distributed throughout the patient's body.

While the early approaches mentioned above experienced some severe problems, the more recent approach, employing IG intravenous injection, has apparently shown great promise. In this approach, developed and carried out by the Wellman Laboratory for Photomedicine in Boston, Mass., the burn-wound area of a patient who had been intravenously injected with IG dye was then illuminated by a laser diode output of approximately 800 nm; and, that tissue through which blood flow was observed—i.e., tissue capable of self-regeneration—fluoresced at approximately 840 nm. In this case, the fluorescent image was viewed, recorded and stored using, for example, a CCD camera with high sensitivity (i.e., at approximately 840 nm) fitted with a long-pass filter that effectively blocked the reflected laser energy while transmitting the longer wavelength fluorescent energy. According to the aforesaid report, development is continuing in an effort to design a hand-held diagnostic instrument capable of exciting the fluorescent IG dye, displaying the fluorescent image resulting from moving the instrument relative to the burn-wound area, and recording the data observed.

The present invention is particularly well suited for use in luminescent spectroscopic diagnostics of the foregoing type. Thus, referring to FIG. 35, it will be noted that a photon detector/electron multiplier 108 of the type described in connection with FIG. 34 has been illustrated having: i) an annular evacuated housing 109 including an inner cylindrical light-transmissive wall 110 surrounded by a cylindrical photocathode 119 and defining a central coaxial detection chamber 118; ii) a generally conical reflector 226 disposed coaxially within the detection chamber 118; and iii), a composite cylindrical light filter array 235 of arcuate filter segments $\mathbf{236}_1 \ldots \mathbf{236}_n$ [where "n" can be any desired whole integer; but, is eight (8) in the exemplary form of the invention depicted in FIG. 35]. In this instance, however, the photon detector/electron multiplier 108 is further provided with a suitable light source or stimulator 222 disposed coaxially within the reflector 226 and capable of directing a laser or other suitable stimulating or illuminating light beam 224: i) axially through an opening 229 formed in the apical end 230 of the reflector 226; ii) axially out of the detection chamber 118; iii) through an aperture 220 formed in a plate 221; and iv), into impinging relation with the burn-wound area on the patient's body (or other area of interest in or on a suitable source or sample 238) for illuminating the burn-wound area and thus stimulating or exciting the IG dye in the flowing blood stream and causing it to fluoresce.

In such an arrangement, the compact photon detector/electron multiplier 108—which may be on the order of only about 50 mm (5 cm) in diameter and 20 mm (2 cm) in height and wherein the connector pins 158 and input/output leads can be totally contained within any suitable hand-held housing (not shown)—readily meets the requirements for a hand-held diagnostic instrument which can be easily moved along rectilinear or any other desired coordinates relative to the patient's body, sample or other source 238—for example, in the manner indicated by the arrows 239, 240—and wherein: i) the stimulator or light source 222 in the generally conical reflector 226 is actuated, thus producing a laser or other light beam 224 which illuminates the sample area of interest and thus stimulates luminescent activity—e.g., fluorescent activity in the case of a patient intravenously injected with IG dye—in the area(s) of interest; and ii), the luminescent light energy—e.g., fluorescent light energy-produced by such stimulation is thereafter detected and directed through the aperture 220 in plate 221. The fluorescent light energy passing through the aperture 220 impinges against the generally conical reflector 226, and is reflected laterally therefrom towards the composite cylindrical light filter array 235 of arcuate filter segments $\mathbf{236_1}$–$\mathbf{236_n}$. Light energy falling within the wavelength bands defined by the various filter segments $\mathbf{236_1}$–$\mathbf{236_n}$ is, therefore, passed through the filter segment(s), and thence through the light-transmissive inner annular wall 110 of housing 109 and into impinging relation with the cylindrical photocathode 119 where such impinging light energy is absorbed, causing emission of primary electrons that are accelerated and multiplied by respective one(s) of the plurality of radially oriented, circumferentially arrayed, electron multipliers $\mathbf{120_1}$–$\mathbf{120_n}$.

Thus, those skilled in the art will appreciate that the photon detector/electron multiplier 108 depicted in FIG. 35 and as thus far described fully meets the requirements stated in the aforesaid article written by Stephen A. May—see, Biophotonics International, pages 44 through 50 (May/June 1995)—indicating that the goal of the on-going research is to provide a hand-held diagnostic instrument capable of illuminating a burn-wound area on a patient with a laser or other suitable light beam to stimulate IG dye intravenously injected into the patient; and, to thereafter collect, display and store the fluorescent imaging data produced which is indicative of blood flow and, therefore, burn viability—factors of critical importance in rapidly and accurately diagnosing the severity of the burn and the ability, or lack of ability, of the burned tissue to self-regenerate.

In yet another aspect of the present invention, a suitable high voltage source 62 is provided that serves to couple the various electron-emitters—e.g., the cylindrical photocathode 119 and the plurality of electron multipliers $\mathbf{120_1}$–$\mathbf{120_8}$—and the anodes 124 to progressively higher voltage levels. The connector pins 158 associated with each of the eight (8) anodes 124 in the exemplary device 108—which here employs an octagonal array of electron multipliers $\mathbf{120_1}$–$\mathbf{120_8}$—may, where desired, also be used to route the signal pulses output from each of the anodes 124 associated with the eight (8) electron multipliers $\mathbf{120_1}$–$\mathbf{120_8}$ to suitable timing discriminators 241 of completely conventional construction. Such timing discriminators 241 may, of course, include a sufficient number of input and output terminals to accommodate any desired number of electron multiplier/anode combinations 120/124—for example, the eight (8) electron multiplier/anode combinations 120/124 depicted in the exemplary embodiment of the invention; or, sixteen (16) electron multiplier/anode combinations 120/124 (not shown); or, any other desired number of electron multiplier/anode combinations 120/124.

The timing discriminators 241 are, in this illustrative embodiment of the invention, coupled via an ASIC-based multiplexing and routing module 242 of the type developed by IBH Consultants Ltd. of Glasgow, Scotland—see, e.g., the aforementioned anonymous article entitled "Multiplexing Expands Yield from Fluorescence Analysis", Biophotonics International, pages 18 and 20 (March/April 1995)—to standard electronic components employed in a conventional multiplexing system for fluoroscopic analysis—e.g., a time-to-amplitude converter ("TAC") 244 and a multichannel analyzer ("MCA") 245. In this exemplary device, suitable, but completely conventional excitation circuitry illustrated in block form at 246 in FIG. 35 is provided for activating the laser or other light stimulator 222 disposed within the generally conical reflector 226 and for providing "STOP" signals for the TAC circuit 244.

C. SUMMARY

Thus, each and every embodiment of the invention hereinabove described employs: i) a single housing 109 having inner and outer spaced annular walls 110, 111 and integrally sealed washer-shaped top and bottom walls 112, 114 defining an annular internal evacuated space 116 for housing, within a vacuum, all electronic structural components typically employed in a photomultiplier tube, and wherein the inner annular wall 110 is formed of thin-walled, implosion-resistant, glass, quartz, or similar light-transmissive material; ii) a central detection chamber 118 coaxial with, and disposed within, the housing's inner annular wall 110; iii) a common continuous cylindrical photocathode 119 deposited on, or positioned adjacent, the vacuum side of the annular inner wall 110 and which is equidistant at all points from, and in close proximity to, the axis of the detection chamber 118; iv) a plurality of side-by-side, radially oriented, electron multipliers (which are preferably, but not necessarily, compact as viewed from input to output) disposed within the evacuated housing 109, with such electron multipliers subtending adjacent arcs on the cylindrical photocathode 119 (which are preferably, but not necessarily, of substantially equal size) and defining a multi-section photomultiplier tube; v) detection of light photons emanating from samples and/or light sources disposed either within the detection chamber 118 or external to the detection chamber 118, and either adjacent to or remote from the photon detector/electron multiplier 108; and vi), which can, nonetheless, be employed using conventional coincidence counting techniques where desired.

Moreover, and as previously described, when using mesh-type electron multipliers which possess excellent spatial resolution characteristics, the electron multiplier portion of the overall structure may simply comprise a series of closely spaced, concentric, coaxial, cylindrical (or semi-cylindrical, or arcuate portions of a cylinder) mesh-type dynodes which are effectively divisible into adjacent arcuate sections and which cooperate with a plurality of circumferentially spaced discrete anodes positioned outboard of the output mesh-type dynode stage. In such a construction, the excellent spatial resolution characteristics of mesh-type dynodes, coupled with the plurality of circumferentially arrayed anodes, enables the composite cylindrical mesh-type electron multiplier to function as a plurality of discrete electron multipliers disposed in a cylindrical array.

Notwithstanding the foregoing, each of the photon detectors/electron multipliers disclosed in the drawings and described in the forgoing Specification is characterized by its compact small size, resulting in significant reduction in weight and size for shielding materials of the type used to exclude both spurious external light sources and/or spurious external radiations.

Indeed, the remarkable difference in size between: i) a conventional photon detection/electron multiplication system of the type shown in FIG. 1 employing a pair of conventional head-on photomultiplier tubes 52, 54 disposed on diametrically opposite sides of a sample chamber 56; and ii), a photon detector/electron multiplier 108 embodying features of the present invention as shown in FIGS. 13 through 17, 21, 26, 28 through 30 and 31 through 35, can be readily demonstrated and appreciated. Thus, considering a conventional photon detector/electron multiplier system of the type shown in FIG. 1 employing a pair of diametrically opposed head-on photomultiplier tubes 52, 54, it will be appreciated that such tubes will typically have lengths ranging from 10 cm (100 mm) to 20 cm (200 mm) and diameters on the order of 4.5 cm (45 mm). Therefore, assuming an intermediate detection chamber 56 which is 4.5 cm (45 mm) in height and 3 cm (30 mm)×3 cm (30 mm) square, it can be readily calculated that the total volume of space occupied by such a conventional detection system, excluding external shields and sample transport mechanisms, will be on the order of at least 22 in.$^3$. Moreover, where the photomultiplier tubes 52, 54 are 20 cm (200 mm) in length, the total volume of space occupied by the two (2) photomultipliers 52, 54 and the detection chamber 56 will be on the order of 42 in.$^3$.

However, assuming that a photon detector/electron multiplier 108 embodying features of the present invention has an external diameter of 5 cm (50 mm) and a height of 2 cm (20 mm)—realistic dimensions when using compact electron multipliers such, for example, as: MCPs (FIGS. 13–16B); mesh-type dynodes (FIGS. 17–19); hybrid photodiodes (FIGS. 20–23); etc.—then it will be appreciated that the total volume of space occupied by the photon detector/electron multiplier 108, including its central coaxial detection chamber 118, will be only about 2.4 in.$^3$. In other words, a typical photon detector/electron multiplier 108 embodying features of the present invention will occupy a volume of space of only about 11% of that required with a conventional system employing photomultiplier tubes 10 cm in length and only about 6% of that required with a conventional system employing photomultiplier tubes which are 20 cm in length.

Thus, not only are the photon detector/electron multipliers 108 of the present invention remarkably smaller in size than those used in conventional detection systems but, additionally, they provide: i) 360° surround light collection; ii) improved collection geometry and efficiencies; iii) less absorption and random spurious noise attributable to the thickness of the light-transmissive face of the tube and, therefore, improved signal-to-noise ratios; and iv), considerably less size and weight in terms of lead shielding requirements. Those skilled in the art will, therefore, appreciate that there have herein been disclosed unique photomultiplier tube constructions which are capable of use in a wide variety of applications and which take advantage of conventional technology heretofore known in the electron multiplier art for many decades; yet, which have not been combined in a single device of the type herein described prior to the advent of the present invention despite the long-felt need for detection and analysis systems employing: i) improved collection geometry and efficiencies; ii) reduced spurious noise signals in the photomultiplier's structural components; iii) improved signal-to-noise ratios; and iv), smaller more compact sizes.

I claim:

1. A 360° surround photon detector/electron multiplier comprising, in combination:

a) a housing defining a totally enclosed vacuum-tight evacuated annulus;

b) said housing including a cylindrical light-transmissive inner wall;

c) said cylindrical inner wall defining, surrounding, and coaxial with, a central detection chamber;

d) a cylindrical photocathode located within said annulus for absorbing light photons from said central detection chamber and emitting photoelectrons into said annulus, said cylindrical photocathode being adjacent to, and surrounding, said cylindrical light-transmissive inner wall;

e) electron multiplication means mounted within said annulus and circumferentially surrounding said cylindrical photocathode for collecting photoelectrons emitted therefrom and producing output signal currents whose magnitudes are proportional to, and larger than, the energy output of the photoelectrons emitted by said photocathode; and, f) means for routing said output signal currents to a utilization device.

2. A 360° surround photon detector/electron multiplier as set forth in claim 1 wherein said electron multiplication means is capable of functioning as a plurality of electron multipliers mounted within said totally enclosed evacuated annulus, said plurality of electron multipliers: i) each including an output terminal connected to said routing means; ii) being oriented in a circumferential array surrounding said cylindrical photocathode; and iii), effectively subdividing said annulus into a plurality of discrete adjacent arcuate sections each subtending respective different adjacent arcs on said cylindrical photocathode; and, means for coupling: i) said cylindrical photocathode; ii) said electron multipliers; and iii), said output terminals, to progressively higher voltage levels within each of said adjacent arcuate sections.

3. A 360° surround photon detector/electron multiplier comprising, in combination:

a) a housing defining a totally enclosed vacuum-tight evacuated annulus;

b) said housing including a cylindrical light-transmissive inner wall;

c) said cylindrical inner wall defining, surrounding, and coaxial with, a central detection chamber;

d) a cylindrical photocathode located within said annulus for absorbing light photons from said central detection chamber and emitting photoelectrons into said annulus, said cylindrical photocathode being adjacent to, and surrounding, said cylindrical light-transmissive inner wall;

e) mesh-type electron multiplication means mounted within said annulus and circumferentially surrounding said cylindrical photocathode for collecting photoelectrons emitted therefrom and producing output signal currents whose magnitudes are proportional to, and larger than, the energy output of the photoelectrons emitted by said photocathode;

f) a plurality of circumferentially spaced apart anodes mounted within said annulus and circumferentially surrounding said mesh-type electron multiplication means for collecting said output signal currents produced thereby; and, g) means for routing said collected output signal currents from said plurality of anodes to a utilization device.

4. A 360° surround photon detector/electron multiplier as set forth in claim 3 wherein said mesh-type electron multiplication means comprises "n" closely and radially spaced mesh-type dynode stages, where "n" is any whole integer greater than 1, disposed in "n" closely and radially spaced concentric circumferential arrays surrounding said cylindrical photocathode; means for coupling: i) said cylindrical photocathode; ii) each of said "n" dynode stages; and iii), said plurality of anodes to progressively higher voltage levels from said innermost cylindrical photocathode to said outermost anodes; and, wherein said mesh-type electron multiplication means effectively comprises a plurality of side-by-side circumferentially arrayed electron multipliers disposed radially inboard of respective different ones of said plurality of anodes and, together with said anodes, effectively subdivides said annulus into a plurality of discrete adjacent arcuate sections each subtending respective different adjacent areas on said cylindrical photocathode.

5. A 360° surround photon detector/electron multiplier as set forth in claim 1 for use with light sources disposed externally of said detection chamber, said photon detector/electron multiplier further including a reflector mounted coaxially within said detection chamber; said reflector being shaped to reflect light photons, which emanate from a light source external to said detection chamber and enter said detection chamber, towards said cylindrical photocathode.

6. A 360° surround photon detector/electron multiplier as set forth in claim 3 for use with light sources disposed externally of said detection chamber, said photon detector/electron multiplier further including a reflector mounted coaxially within said detection chamber; said reflector being shaped to reflect light photons, which emanate from a light source external to said detection chamber and enter said detection chamber, towards said cylindrical photocathode.

7. A 360° surround photon detector/electron multiplier as set forth in claim 4 for use with light sources disposed externally of said detection chamber, said photon detector/electron multiplier further including a reflector mounted coaxially within said detection chamber; said reflector being shaped to reflect light photons, which emanate from a light source external to said detection chamber and enter said detection chamber, towards said cylindrical photocathode.

8. A 360° surround photon detector/electron multiplier as set forth in claim 5 wherein said electron multiplication means is capable of functioning as a plurality of electron multipliers mounted within said totally enclosed evacuated annulus, said plurality of electron multipliers: i) each including an output terminal connected to said routing means; ii) being oriented in a circumferential array surrounding said cylindrical photocathode; and iii), effectively subdividing said annulus into a plurality of discrete adjacent arcuate sections each subtending respective different adjacent arcs on said cylindrical photocathode; and, means for coupling: i) said cylindrical photocathode; ii) said electron multipliers; and iii), said output terminals, to progressively higher voltage levels within each of said adjacent arcuate sections.

9. A 360° surround photon detector/electron multiplier as set forth in claim 2 further including a composite cylindrical array of a plurality of discrete adjacent light filters each having different wavelength bandpass characteristics for respectively passing different wavelength bands of light photons, said composite cylindrical array of a plurality of light filters being disposed within said detection chamber in close proximity to, and surrounded by, said cylindrical inner wall and being respectively aligned and matched with respective different ones of said plurality of electron multipliers.

10. A 360° surround photon detector/electron multiplier as set forth in claim 4 further including a composite cylindrical array of a plurality of discrete adjacent light filters each having different wavelength bandpass characteristics for respectively passing different wavelength bands of light photons, said composite cylindrical array of a plurality of light filters being disposed within said detection chamber in close proximity to, and surrounded by, said cylindrical inner wall and being respectively aligned and matched with respective different ones of said plurality of electron multipliers.

11. A 360° surround photon detector/electron multiplier as set forth in claim 8 further including a composite cylindrical array of a plurality of discrete adjacent light filters each having different wavelength bandpass characteristics for respectively passing different wavelength bands of light photons, said composite cylindrical array of a plurality of light filters being disposed within said detection chamber in close proximity to, and surrounded by, said cylindrical inner wall and being respectively aligned and matched with respective different ones of said plurality of electron multipliers; and, wherein said reflector is coaxial with, and disposed internally of, said cylindrical array of a plurality of discrete adjacent light filters.

12. A 360° surround photon detector/electron multiplier as set forth in claim 8 for use in luminescent spectroscopic analysis of specimens containing a luminescent light emitter, said photon detector/electron multiplier further including a composite cylindrical array of a plurality of discrete adjacent light filters each having different wavelength bandpass characteristics for respectively passing different wavelength bands of detected light photons, said composite cylindrical array of a plurality of light filters being disposed within said detection chamber in close proximity to, and surrounded by, said cylindrical inner wall and being respectively aligned and matched with respective different ones of said plurality of electron multipliers; and, wherein said reflector is coaxial with, and disposed internally of, said cylindrical array of a plurality of discrete adjacent light filters;

whereby, said 360° surround photon detector/electron multiplier may be: i) positioned externally of, but in closely spaced proximity to, a portion of a patient's body where such patient has been administered a luminescent dye through one of ingestion and injection and, thereafter, stimulated to excite such dye and produce luminescent emissions; and ii), moved relative to that portion of the patient's body to permit detection and display of the spectral distribution of luminescent light energy emitted therefrom.

13. A 360° surround photon detector/electron multiplier as set forth in claim 7 further including a composite cylindrical array of a plurality of discrete adjacent light filters each having different wavelength bandpass characteristics for respectively passing different wavelength bands of light photons, said composite cylindrical array of a plurality of light filters being disposed within said detection chamber in close proximity to, and surrounded by, said cylindrical inner wall and being respectively aligned and matched with respective different ones of said plurality of electron multipliers; and, wherein said reflector is coaxial with, and disposed internally of, said cylindrical array of a plurality of discrete adjacent light filters.

14. A 360° surround photon detector/electron multiplier comprising a vacuum photomultiplier tube having an annular evacuated envelope including a light-transmissive cylindrical inner wall; a detection chamber coaxial with, and surrounded by, said wall; a continuous cylindrical photocathode positioned internally within said annular evacuated envelope and adjacent said wall; means defining a plurality of radially and circumferentially oriented, side-by-side, electron multipliers housed within said envelope outwardly of said photocathode, with said electron multipliers respectively subtending a corresponding plurality of adjacent arcs on said photocathode; each of said electron multipliers including an output terminal; means for coupling said photocathode, said electron multiplier defining means, and said output terminals to progressively higher voltage levels from said photocathode to said output terminals; and, means for coupling said output terminals to a utilization device.

15. A 360° surround photon detector/electron multiplier comprising, in combination:

a) an annular evacuated envelope comprising an annular vacuum tube having an inner light-transmissive annular wall defining a detection chamber disposed coaxially within, and surrounded by, said inner annular wall;

b) photoemissive cathode material deposited on said inner annular wall internally of said annular evacuated envelope, said material defining a cylindrical photocathode;

c) means defining a plurality of electron multipliers each including an output terminal housed in said annular evacuated envelope;

d) said annular evacuated envelope being subdivided by said plurality of electron multipliers into a corresponding plurality of circumferentially spaced adjacent arcuate sections each housing a respective different one of said plurality of electron multipliers and respectively subtending a corresponding plurality of adjacent arcs on said photocathode;

e) means for coupling: i) said photocathode; ii) said electron multiplier defining means; and iii), said output terminals, in each of said plurality of adjacent arcuate sections to progressively higher voltage levels so as to accelerate and multiply electrons emitted from said photocathode in each of said adjacent arcuate sections; and, f) means for conveying voltage signals on each of said output terminals to an external utilization device; whereby, upon impingement on said photocathode of light photons derived from a light source positioned in one of a first position within said detection chamber and a second position external to said detection chamber, said light photons are absorbed by said photocathode causing emission of one or more primary electrons in multiple ones of said subtended arcs and acceleration and multiplication of said primary electrons in multiple ones of said electron multipliers, thereby producing output signals on multiple ones of said output terminals for conveyance to the external utilization device.

16. A 360° surround photon detector/electron multiplier comprising, in combination:

a) an envelope having an annular light-transmissive inner wall and an annular sealed enclosure integral with, and surrounding, said annular inner wall with said annular sealed enclosure having a vacuum drawn therein;

b) said annular inner wall defining a detection chamber disposed coaxially within, and surrounded by, said annular wall;

c) photoemissive cathode material adjacent said annular inner wall internally of said evacuated envelope and defining a continuous cylindrical transmission-type photocathode for emitting electrons in response to impingement and absorption of light photons emanating from a light source;

d) means defining a plurality of electron multipliers housed within said envelope, each of said electron multipliers having at least an input stage, an output stage, and an output terminal;

e) said plurality of electron multipliers effectively subdividing said annular sealed enclosure into a plurality of adjacent arcuate sections each housing a respective different one of said electron multipliers and respectively subtending a corresponding plurality of adjacent arcs on said cylindrical photocathode;

f) means for coupling: i) said cylindrical photocathode; ii) said input stage; iii) said output stage; and iv), said output terminal, in each of said plurality of adjacent arcuate sections to progressively higher voltage levels for accelerating and multiplying electrons emitted by said photocathode in each said section; and, g) means for coupling said output terminal in each of said sections to a utilization device.

17. A 360° surround photon detector/electron multiplier comprising, in combination:

a) a housing having a cylindrical inner wall, an outer wall spaced radially outward from said inner wall, and annular top and bottom walls coupled to said cylindrical inner wall and said outer wall in sealed vacuum-tight relation therewith, with said cylindrical inner wall, said outer wall and said annular top and bottom walls defining a totally enclosed evacuated annulus within which a vacuum is drawn and maintained;

b) said cylindrical inner wall being formed of a light-transmissive material and defining a central detection chamber disposed coaxially within, and surrounded by, said cylindrical inner wall;

c) a cylindrical photocathode positioned within said totally enclosed evacuated annulus adjacent said cylindrical inner wall and surrounding said detection chamber for absorbing light photons generated by a light source whose light energy is directed towards said surrounding cylindrical photocathode;

d) electron multiplication means mounted within said totally enclosed evacuated annulus intermediate said cylindrical photocathode and said outer wall and circumferentially surrounding said cylindrical photocathode for: i) attracting, accelerating and multiplying electrons emitted from any arcuate region of said cylindrical photocathode upon absorption by said cylindrical photocathode of light photons generated by a light source; and ii), providing output signals whose magnitudes are proportional to the number of light photons absorbed by said photocathode; and, e) means for routing said output signals to a utilization device.

18. A 360° surround photon detector/electron multiplier as set forth in claim 17 wherein said electron multiplication means is capable of functioning as a plurality of electron multipliers mounted within said totally enclosed evacuated annulus, said plurality of electron multipliers: i) each including an output terminal connected to said routing means; ii) being oriented in a circumferential array intermediate said cylindrical photocathode and said outer wall; and iii), effectively subdividing said annulus into a plurality of discrete adjacent arcuate sections each subtending respective different adjacent arcs on said cylindrical photocathode; and, means for coupling: i) said cylindrical photocathode; ii) said electron multipliers; and iii), said output terminals, to progressively higher voltage levels within each of said adjacent arcuate sections.

19. A 360° surround photon detector/electron multiplier as set forth in claims 2, 8, 11, 12, 14, 15, 16 or 18 wherein said plurality of electron multipliers are selected from the group of compact electron multipliers including:

a) a single MCP element;

b) tandem MCP elements;

c) mesh-type dynode stages;

d) photodiodes; and, e) circular-cage dynode stages.

20. A 360° surround photon detector/electron multiplier as set forth in claims 2, 4, 7, 8, 11, 12, 13, 14, 15, 16 or 18 for use with a coincidence detection circuit wherein said plurality of electron multipliers are disposed in a circumferential array surrounding said cylindrical photocathode; and, wherein the aggregate output signal(s) from certain selected one(s) of said plurality of electron multipliers provide a first input signal to the coincidence detection circuit, and the aggregate output signal(s) from certain selected other one(s) of said plurality of electron multipliers provide a second input signal to the coincidence detection circuit for enabling detection of the presence or absence of time-coincident signals output from at least two different groups of electron multipliers with each of said groups comprising at least one, but less than all, of said plurality of electron multipliers.

21. A 360° surround photon detector/electron multiplier as set forth in claims 2, 4, 7, 8, 11, 12, 13, 14, 15, 16 or 18 for use with a coincidence detection circuit wherein said plurality of electron multipliers are disposed in a circumferential array surrounding said cylindrical photocathode with alternate ones of said electron multipliers comprising odd-numbered electron multipliers designated "1, 3 . . . m" where "m" is any whole odd integer and intervening ones of said electron multipliers comprising even-numbered electron multipliers designated "2, 4 . . . n" where "n" is any whole even integer; and wherein output signals generated in each of said alternate odd-numbered electron multipliers are summed and provide a first input signal to the coincidence detection circuit, and output signals generated in each of said intervening even-numbered electron multipliers are summed and provide a second input signal to the coincidence detection circuit for enabling detection of the presence or absence of time-coincident signals output from both the odd-numbered and the even-numbered electron multipliers.

22. A 360° surround photon detector/electron multiplier as set forth in claims 2, 8, 11, 12, 14, 15, 16 or 18 further including focusing electrodes positioned intermediate: i) each of said plurality of adjacent subtended arcs on said cylindrical photocathode; and ii), each of said electron multipliers, for funneling one or more primary electron(s) emitted from each of said arcs on said cylindrical photocathode towards the one of said plurality of electron multipliers subtending the arc on said cylindrical photocathode from which the primary electron(s) was(were) emitted.

23. A 360° surround photon detector/electron multiplier as set forth in claims 5, 6, 7, 8, 11, 12 or 13 wherein the light source is disposed immediately adjacent to, but externally of, said detection chamber.

24. A 360° surround photon detector/electron multiplier as set forth in claims 5, 6, 7, 8, 11, 12 or 13 wherein the light source is remote from said detection chamber; and, further including a light collimating device for conveying light photons from the remote source to said detection chamber.

25. 360° surround photon detector/electron multiplier as set forth in claims 1, 3, 14, 15, 16 or 17 wherein said envelope has an external O.D. on the order of 50 mm, an internal I.D., on the order of 30 mm, a height on the order of 20 mm, and defines a central coaxial detection chamber on the order of 30 mm in diameter and 20 mm high.

26. A unitary, multi-section, annular photomultiplier tube comprising, in combination:

a) a housing having an annulus of generally rectilinear cross-section including: i) a light-transmissive cylindrical inner annular wall; ii) an outer annular wall spaced from said inner annular wall; and iii), top and bottom generally flat washer-shaped walls joined at their inner peripheries to said inner annular wall and at their outer peripheries to said outer annular wall to form a totally enclosed evacuated annulus within which a vacuum is drawn and maintained;

b) said inner annular wall defining a central detection chamber disposed coaxially within, and surrounded by, said inner annular wall;

c) a cylindrical photocathode positioned internally within said housing adjacent said light-transmissive cylindrical inner annular wall and surrounding said detection chamber for absorbing light photons generated by a light source whose light energy is directed towards said surrounding cylindrical photocathode;

d) means defining a plurality of electron multipliers positioned within said housing, said plurality of electron multipliers: i) each including an output terminal; ii) being oriented in a circumferential array intermediate said cylindrical photocathode and said outer peripheral wall; and iii), effectively subdividing said annulus into a plurality of discrete adjacent arcuate sections each subtending respective different adjacent arcs on said cylindrical photocathode;

e) means for coupling: i) said photocathode; ii) said electron multiplier defining means; and iii), said output terminals, to progressively higher voltage levels within each of said adjacent arcuate sections; and, f) means for coupling said output terminals to a utilization device;

whereby, absorption of photons in respective different one(s) of said adjacent arcs on said cylindrical photocathode causes emission of primary electrons from each of said respective different one(s) of said adjacent arcs, which emitted primary electrons are attracted to, and accelerated and multiplied as secondary electrons in, the respective one(s) of said electron multipliers subtending the respective one(s) of said arc(s) on said cylindrical photocathode from which said primary electrons were emitted with said accelerated and multiplied secondary electrons being collected on respective one(s) of said output terminals and forming output signal pulses proportional in magnitude to the number of light photons absorbed in respective one(s) of said adjacent arcs on said photocathode.

27. A unitary, multi-section, annular photomultiplier tube as set forth in claim 26 for use with light sources disposed externally of said detection chamber, said annular photomultiplier tube further including a reflector mounted coaxially within said detection chamber; said reflector being shaped to reflect light photons emanating from a light source external to said detection chamber and entering said detection chamber towards said cylindrical photocathode.

28. A unitary, multi-section, annular photomultiplier tube as set forth in claim 26, said annular photomultiplier tube further including a composite cylindrical array of a plurality of discrete adjacent light filters each having different wavelength bandpass characteristics for respectively passing different wavelength bands of detected light photons, said composite cylindrical array of a plurality of light filters being disposed within said detection chamber in close proximity to, and surrounded by, said cylindrical inner wall and being respectively aligned and matched with respective different ones of said plurality of electron multipliers.

29. A unitary, multi-section, annular photomultiplier tube as set forth in claim 27, said annular photomultiplier tube further including a composite cylindrical array of a plurality of discrete adjacent light filters each having different wavelength bandpass characteristics for respectively passing different wavelength bands of detected light photons; said composite cylindrical array of a plurality of light filters being disposed within said detection chamber in close proximity to, and surrounded by, said cylindrical inner wall and being respectively aligned and matched with respective different ones of said plurality of electron multipliers; and, said reflector being disposed coaxially within, and surrounded by, said cylindrical array of a plurality of discrete adjacent light filters.

30. A unitary, multi-section, annular photomultiplier tube as set forth in claims 26, 27, 28 or 29 wherein each of said electron multipliers comprises at least one MCP.

31. A unitary, multi-section, annular photomultiplier tube as set forth in claims 26, 27, 28 or 29 wherein each of said electron multipliers comprises a tandem array of multiple MCPs.

32. A unitary, multi-section annular photomultiplier tube as set forth in claims 26, 27, 28 or 29 wherein each of said electron multipliers comprises a plurality of mesh-type dynode stages.

33. A unitary, multi-section, annular photomultiplier tube as set forth in claims 26, 27, 28 or 29 wherein each of said electron multipliers includes a photodiode.

34. A unitary, multi-section, annular photomultiplier tube as set forth in claims 26, 27, 28 or 29 wherein: i) the external O.D. of said annular housing defined by said outer annular wall is on the order of 50 mm; ii) the I.D. of said annular housing defined by said inner annular wall is on the order of 30 mm; iii) the height of said annular housing defined by said inner and outer annular walls is on the order of 20 mm; and iv), said central detection chamber has a diameter on the order of 30 mm and a height on the order of 20 mm.

* * * * *